US008636628B1

(12) United States Patent
Greene et al.

(10) Patent No.: US 8,636,628 B1
(45) Date of Patent: Jan. 28, 2014

(54) MULTI-FUNCTION EXERCISE MACHINE SUITABLE FOR HOME USE

(75) Inventors: Donald D. Greene, Cleveland, OH (US); Ronald J. Meetin, Mountain View, CA (US)

(73) Assignee: Ab Rider L.L.C., Cleveland, OH (US)

( * ) Notice: Subject to any disclaimer, the term of this patent is extended or adjusted under 35 U.S.C. 154(b) by 11 days.

(21) Appl. No.: 13/343,669

(22) Filed: Jan. 4, 2012

Related U.S. Application Data

(62) Division of application No. 11/888,944, filed on Aug. 3, 2007, now Pat. No. 8,118,715.

(51) Int. Cl.
*A63B 22/06* (2006.01)

(52) U.S. Cl.
USPC ..... 482/57; 482/142

(58) Field of Classification Search
USPC ..... 482/57, 58, 59, 62, 140, 142, 148; 601/23, 24, 25; 297/215.12, 215.13, 297/61, 92, 101
See application file for complete search history.

(56) References Cited

U.S. PATENT DOCUMENTS

| | | | | |
|---|---|---|---|---|
| 2,518,783 | A * | 8/1950 | Hiser | 108/126 |
| 2,546,816 | A * | 3/1951 | Benvissuto | 108/130 |
| 4,140,312 | A | 2/1979 | Buchmann | |
| 4,566,691 | A | 1/1986 | Mahnke | |
| 4,641,837 | A | 2/1987 | Ruth | |
| 4,768,775 | A | 9/1988 | Marshall | |
| 5,039,092 | A | 8/1991 | Olschansky et al. | |
| 5,215,511 | A | 6/1993 | Cheng | |
| 5,514,053 | A | 5/1996 | Hawkins | |
| 5,649,886 | A | 7/1997 | Danylieko | |
| 5,759,137 | A | 6/1998 | Huang | |
| 5,833,582 | A | 11/1998 | Chen | |
| 6,113,522 | A | 9/2000 | Fontenot et al. | |
| 6,270,446 | B1 | 8/2001 | Abelbeck et al. | |
| 6,340,342 | B1 | 1/2002 | Lee | |
| 6,500,099 | B1 | 12/2002 | Eschenbach | |
| 6,805,409 | B2 * | 10/2004 | Parker | 297/377 |

(Continued)

OTHER PUBLICATIONS

"Easy Cycle Mini Exercise & Rehabilitation Cycle", Model EZC-5, net3fitness.com, Mar. 27, 2007, pp. 1 and 2.

(Continued)

*Primary Examiner* — Stephen Crow
(74) *Attorney, Agent, or Firm* — Ronald J. Meetin

(57) ABSTRACT

An exercise machine suitable for exercising a person's muscles contains a frame (100Y), a seat (102) situated over the frame, a seatback (104 or 104Y), a connection mechanism (106 or 106Y) for flexibly and adjustably connecting the seatback to the frame or/and the seat, and a pedaling mechanism (112Y) connectable to the frame and having a pair of movable foot pedals (140). The seatback is capable of swiveling and can be segmented to facilitate swiveling. The machine typically has a pair of retractable frame legs (302) so that the machine can be used for stationary cycling when the legs are retracted and as an elevated exercise bench when the legs extend downward. The machine may include a mechanism for rapidly switching the seatback between inclined and flat positions.

21 Claims, 38 Drawing Sheets

(56) References Cited

U.S. PATENT DOCUMENTS

| | | | | |
|---|---|---|---|---|
| 6,902,515 | B2 | 6/2005 | Howell et al. | |
| 6,966,872 | B2 | 11/2005 | Eschenbach | |
| 7,128,702 | B2 | 10/2006 | Boland et al. | |
| 7,594,881 | B2 | 9/2009 | Shifferaw | |
| 8,118,715 | B2 * | 2/2012 | Greene et al. | 482/57 |
| 2002/0169057 | A1 | 11/2002 | Forcillo | |
| 2004/0192522 | A1 | 9/2004 | Hippensteel | |
| 2005/0101463 | A1 | 5/2005 | Chen | |
| 2005/0202937 | A1 | 9/2005 | Cheng | |
| 2005/0215402 | A1 | 9/2005 | Forcillo | |
| 2006/0084515 | A1 * | 4/2006 | Berliner et al. | 473/12 |
| 2007/0129225 | A1 | 6/2007 | Hammer | |
| 2008/0051274 | A1 * | 2/2008 | Greene | 482/142 |
| 2010/0190623 | A1 * | 7/2010 | Guissin et al. | 482/142 |

OTHER PUBLICATIONS

"Love Handler", Product SI224SIL, sharperimage.com, Dec. 1, 2006, pp. 1 and 2.

"Pro Form GT 95 X Recumbent Bike—Converts to a workout Bench!", Dick's Sporting Goods, dickssportinggoods.com, Jul. 15, 2008, 2 pp.

"Stamina 4755 Magnetic Recumbent Bike with Heart Rate Monitor", walmart.com, Mar. 27, 2007, pp. 1-3 and one p. with enlarged image.

"ST 2-in-1 combo rowing machine & recumbent bike Recumbent Bike", fitnessblowout.com, Mar. 27, 2007, pp. 1-5.

"What Your Body Needs", Panasonic Core Trainer, *SkyMall*, 2006, p. 9.

* cited by examiner 9
9
122
8
7
110L
134X
124
104
192
186
184
128
106
120
α
130X
116
132X
108L
102
100
160L
126
162C
162B
162A
168
168
168
7
8
122
220
232
238R
228U
228L
228
238L
222
226L
224L
236
224R
226R
230
232
232
232
232
232
232
230
226L
224L
236X
234
220
222
228U
228L
228
238L Fig. 29c
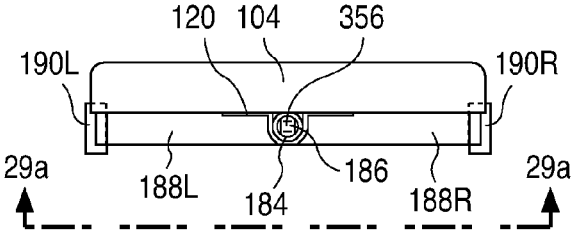
Fig. 29b
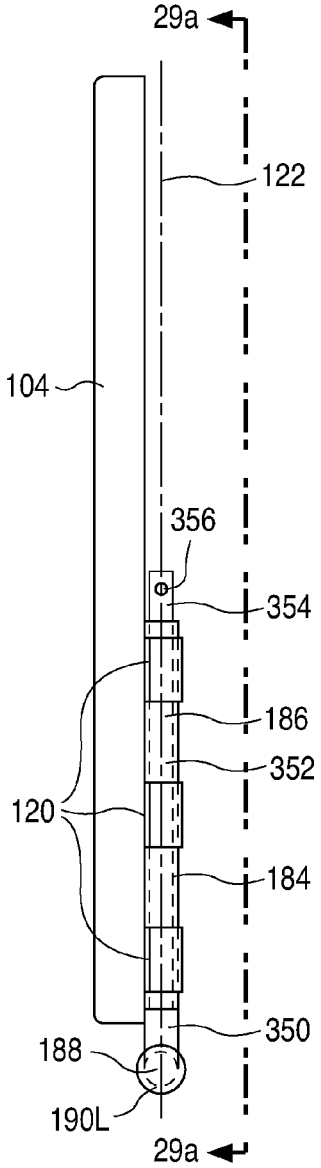
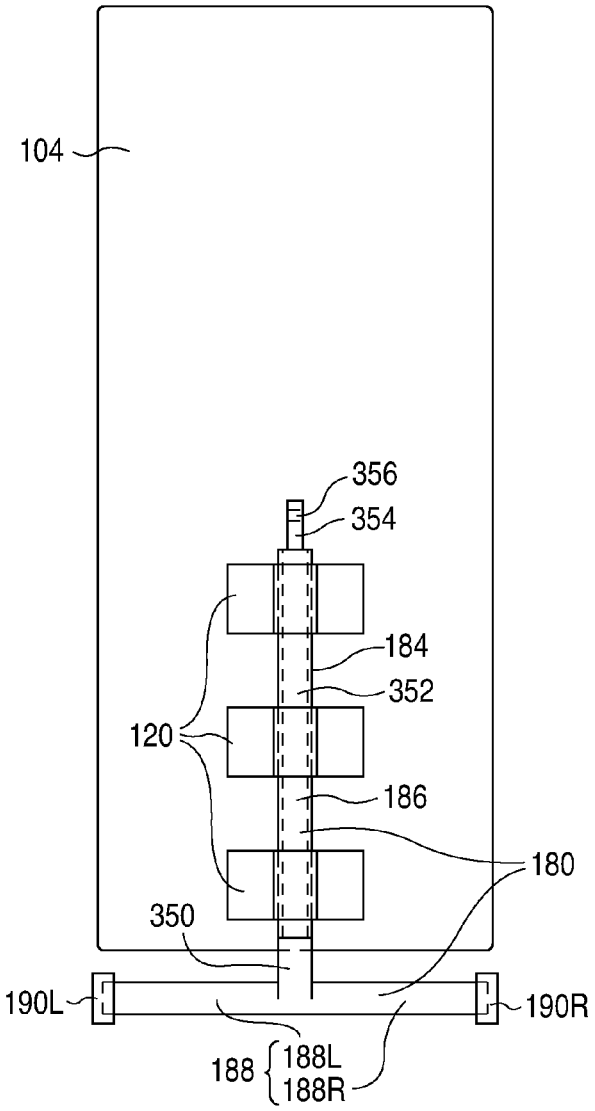
Fig. 29a

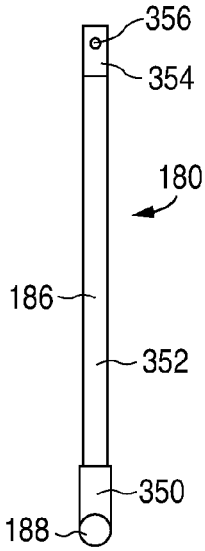
Fig. 30b
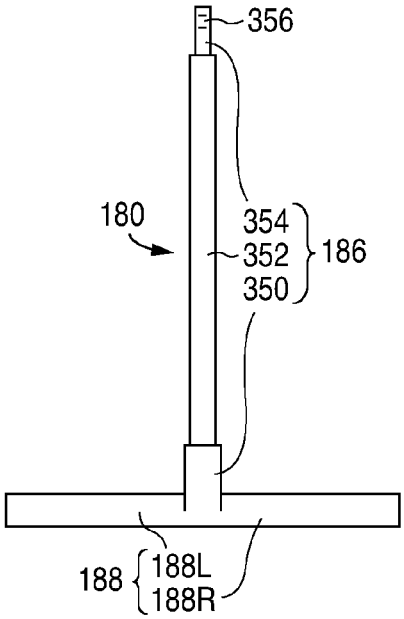
Fig. 30a
Fig. 31a
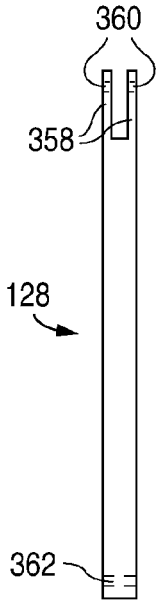
Fig. 31b
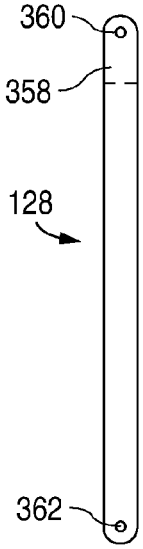
Fig. 32c
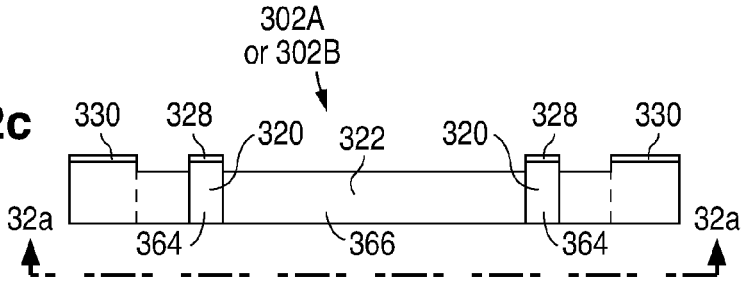
Fig. 32b
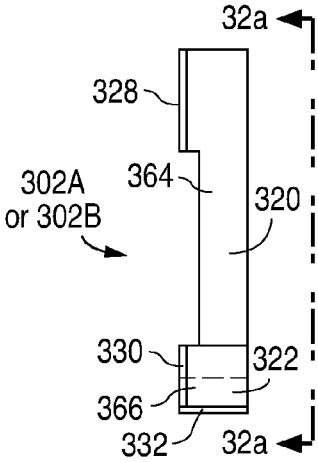
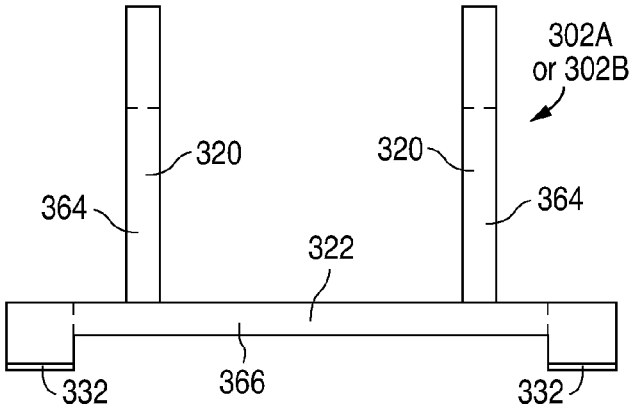
Fig. 32a

MULTI-FUNCTION EXERCISE MACHINE SUITABLE FOR HOME USE

CROSS-REFERENCE TO RELATED APPLICATION

This is a division of U.S. patent application Ser. No. 11/888,944, filed 3 Aug. 2007, now U.S. Pat. No. 8,118,715 B2.

FIELD OF USE

This invention relates to exercise equipment for strengthening muscles of the human body.

BACKGROUND ART

Physical exercise is important to the human body. In addition to increasing strength and stamina, physical exercise can increase longevity. Physical exercise commonly makes humans feel good physically and mentally.

Exercise machines have been developed to enable physical exercising to be done in a time-efficient manner. Some exercise machines target largely only a single feature of the human anatomy such as the legs.

Other exercise machines are designed to enable multiple features of the human anatomy, e.g., the legs and arms/shoulders, to be exercised. FIG. 1 illustrates such a multi-function exercise machine as disclosed in U.S. Pat. No. 6,902,515 B2. The prior art exercise machine of FIG. 1 consists of base assembly 20, pedal-revolving pedaling mechanism 22, seat 24, seatback 26, upper-body assembly 28, and rotational arm-shoulder device 30. Pedaling mechanism 22 includes a pair of pedals 32. When actuated by the feet of a person, pedals 32 revolve about an axis to exercise the person's legs. Arm-shoulder device 30 includes a pair of off-center handles 34 which can similarly be revolved about an axis by the person's hands to exercise the person's arms and shoulders.

FIGS. 2*a* and 2*b* illustrate two way in which upper-body assembly 28 can be connected to the back of seatback 26 (not shown in FIG. 2*a* or 2*b*) to enable portion 36 of assembly 28 to be moved in various ways while a person is exercising with the machine of FIG. 1. In the embodiment of FIG. 2*a*, back member 38 of movable portion 36 is connected by pin 40 to seatback 26 for enabling portion 36 to pivot from side to side about axis 42 that extends generally parallel to the length of base assembly 20. A pair of springs 44 connected between back member 38 and fixed base member 46 of upper-body assembly 28 provide resistance for the side-to-side movement.

In the embodiment of FIG. 2*b*, back member 38 is connected by bearing mechanism 48 to fixed base member 50 of upper-body assembly 28 for enabling movable portion 36 to pivot in various manners about bearing mechanism 48 in order to exercise the arms and shoulders. For example, movable portion 36 can pivot from front to back and vice versa about axis 52 that extends generally perpendicular to the length and height of the exercise machine. Movable portion 36 in FIG. 2*b* can also pivot about axis 54 that extends generally parallel to back member 38. Coil torsion spring 56 provides resistance to the movement of portion 36 in FIG. 2*b*. Although seat 24 and seatback 26 can be adjusted horizontally along the length of base assembly 20 to accommodate persons of different size, seat 24 and seatback 26 are substantially stationary during exercising usage when upper-body assembly 28 is implemented as shown in both FIG. 2*a* and FIG. 2*b*.

The abdominal muscles of the human body often need strengthening. While the multi-function exercise machine of FIG. 1 appears capable of providing the legs and arms/shoulders with good exercise, the machine of FIG. 1 is not particularly targeted toward the abdominal muscles. It would be desirable to have an exercise machine that can exercise both the legs and abdominal muscles.

GENERAL DISCLOSURE OF THE INVENTION

U.S. patent application Ser. No. 11/508,424, filed 22 Aug. 2006, discloses multi-function exercise machines invented by Donald D. Greene, one of the inventors on the present application, for exercising the legs and abdominal muscles of a person. The present application discloses improvements and enhancements on certain of the exercise machines in U.S. application Ser. No. 11/508,424 in order to make the resulting multi-function exercise machines particularly suitable for use in homes and other places typically having limited exercising space.

In accordance with the invention, an exercise machine capable of exercising both the legs and abdominal muscles of a person contains a frame, a seat situated over the frame, a seatback likewise situated over the frame, a connection mechanism for flexibly or/and adjustably connecting the seatback to the frame or/and the seat, and a pedaling mechanism connectable to the frame. The seat is located laterally between the pedaling and seatback-to-frame/seat connection mechanisms. The pedaling mechanism has a pair of pedals. A user of the exercise machine does stationary cycling, typically with the seatback inclined to the seat, by actuating the pedals with the user's feet so as to exercise the user's legs.

The seatback-to-frame/seat connection mechanism can normally turn about a swivel axis that extends generally parallel to the length of the torso of a typical user seated on the seat with the user's back lying generally against the seatback. This enables the seatback to swivel about the swivel axis, thereby exercising the user's abdominal muscles as the user's torso swivels about the swivel axis generally in synchronism with the swiveling of the seatback.

The connection mechanism is preferably adjustable for adjusting the incline of the seatback to the seat. Appropriately adjusting the seatback-to-seat incline assists in exercising the user's abdominal muscles. For instance, reducing the seatback-to-seat incline so that the seatback slants further downward away from the seat typically increases the exercise of the user's abdominal muscles. The incline and swiveling of the seatback thereby typically cause the abdominal muscles to be strengthened as the pedaling mechanism exercises the legs.

In a first aspect of the invention, a pair of frame legs are flexibly connected to the frame. Each frame leg is switchable between (a) an extended position in which extended-position surface area of that leg substantially contacts the surface underlying the frame and (b) a retracted position in which retracted-position surface area of that leg substantially contacts the underlying surface so that the frame and seat are farther from the underlying surface when the legs are in their extended positions than when the legs are in their retracted positions. In their extended positions, the frame legs normally extend generally downward to the underlying surface.

With the frame legs in their extended positions, the main assembly formed with the frame, seat, seatback, seatback-to-frame/seat connection mechanism, and frame legs can be conveniently used as an exercise bench for doing various non-cycling exercises. In some exercise-bench exercises, the seatback is significantly inclined to the seat. In other exercise-bench exercises, the seatback is largely flat against the frame and thus largely not inclined to the seat.

The pedaling mechanism may be connected to, or separated from, the main assembly when it is used as an exercise bench with the frame legs extending generally downward to the underlying surface. In a second aspect of the invention, the pedaling mechanism is tiltably connected to the frame. As the frame legs switch between their extended and retracted positions with the pedaling mechanism attached to the frame, the pedaling mechanism switches between tilted and non-tilted positions while remaining substantially in contact with the underlying surface. By having the pedaling mechanism tilt downward when the frame legs go to their extended positions, the pedaling mechanism typically interferes little with non-cycling exercises done with the main assembly when it is used as an exercise bench.

In a third aspect of the invention, the seatback-to-frame/seat connection mechanism includes (a) a seatback-attaching portion attached to the seatback and (b) a support rod extending between the seatback-attaching portion and the frame. The support rod is of adjustable length so as to adjust the incline of the seatback to the seat. Use of an adjustable-length support rod facilitates adjusting the seatback-to-seat incline and also facilitates improvements and enhancements provided in other aspects of the invention.

A fourth aspect of the invention entails utilizing a leg-position control mechanism actuatable by a person for switching the frame legs between their extended and retracted positions. A fifth aspect of the invention entails utilizing a seatback-incline control mechanism actuatable by a person for switching the seatback between (a) a flat position in which the seatback is largely non-inclined to the seat, preferably lying largely flat against the frame, and (b) an inclined position in which the seatback is significantly inclined to the seat. These two control mechanisms significantly reduce the time needed by a user to go from certain types of exercises to other types of exercises, thereby increasing the attractiveness of the present exercise machine for home use.

In a sixth aspect of the invention, the seatback is segmented into a swivelable segment and a seat-adjacent segment situated between the seat and the swivelable segment. As part or all of the seatback-to-frame/seat connection mechanism turns about the swivel axis, the swivelable seatback segment swivels about the swivel axis without significant swivel of the seat-adjacent segment. Configuring the seatback in this segmented manner facilitates design of the seatback-to-frame/seat connection mechanism.

A seventh aspect of the invention entails having the frame legs extend down to the underlying surface during exercise-machine operation so as to elevate the frame, seat, and seatback above the underlying surface. The frame legs are thus typically connected fixedly, rather than flexibly, to the frame.

A further leg is flexibly connected to the pedaling mechanism in the seventh aspect of the invention. The further leg is switchable between (a) an extended position in which extended-position surface area of the further leg substantially contacts the underlying surface and (b) a retracted position in which the pedaling mechanism or/and retracted-position surface area of the further leg substantially contacts the underlying surface. The pedaling mechanism is farther from the underlying surface when the further leg is in its extended position than when the further leg is in its retracted position. This exercise-machine configuration avoids the need to switch the frame legs between retracted and extended positions. The time needed by a user to go from certain types of exercises to other types of exercises is reduced so as to increase the attractiveness for home use.

In short, stationary cycling can be done on the exercise machines of the invention to exercise the legs and abdominal muscles. The present exercise machines can generally be used as exercise benches to perform various non-cycling exercises. The exercise machines of the invention are well designed for home use. Accordingly, the present exercise machines provide a substantial advance over the prior art.

BRIEF DESCRIPTION OF THE DRAWINGS

FIG. 24 illustrates the connection of the pedaling mechanism to the frame of the exercise machine's main assembly with hidden features indicated in dashed line.

FIGS. 29*a*-29*c* are respective back, side, and top views of the seatback and seatback-adjoining portion of the seatback-to-frame/seat connection mechanism in the exercise machine of FIGS. 21 and 25 with hidden features indicated in dashed line. The back view of FIG. 29*a* is taken along plane 29*a*-29*a* in FIGS. 21, 26, 29*b*, and 29*c*.

FIGS. 30*a* and 30*b* are respective back and side views of the T-shaped bar portion of the seatback-to-frame/seat connection mechanism in the exercise machine of FIGS. 21 and 25 with hidden features indicated in dashed line.

FIGS. 31*a* and 31*b* are respective back and side views of the support rod of the seatback-to-frame/seat connection mechanism in the exercise machine of FIGS. 21 and 25 with hidden features indicated in dashed line.

FIGS. 32*a*-32*c* are respective back (or front), side, and top views of one of the frame legs in the exercise machine of FIGS. 21 and 25 with hidden features indicated in dashed line. The back (or front) view of FIG. 32*a* is taken along plane 32*a*-32*a* in FIGS. 25, 27, 32*b*, and 32*c*.

Like reference symbols are employed in the drawings and in the description of the preferred embodiments to represent the same, or very similar, item or items. All planes, axes, and reference lines are indicated in dashed line in the drawings.

DESCRIPTION OF THE PREFERRED EMBODIMENTS

Exercise Machines of U.S. patent application Ser. No. 11/508,424

The multi-function exercise machines of the present invention incorporate certain features of the multi-function exercise machines disclosed by inventor Greene in U.S. patent application Ser. No. 11/508,424, cited above. In light of this, an understanding of the present exercise machines is facilitated by first examining certain of the exercise machines disclosed in U.S. application Ser. No. 11/508,424. To the extent not repeated here, the contents of U.S. application Ser. No. 11/508,424 are incorporated by reference.

Figure 1:
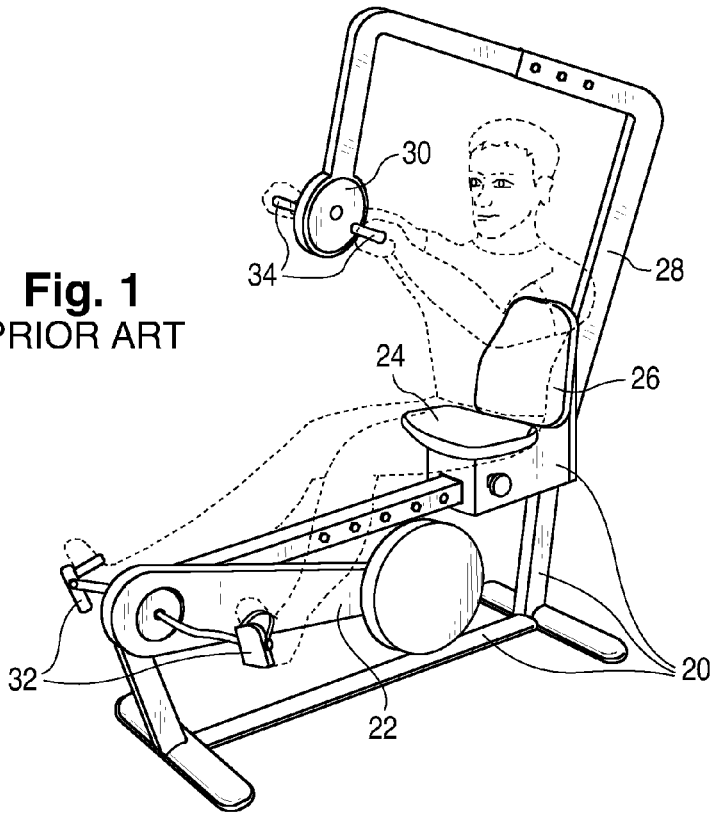
Fig. 1 PRIOR ART
FIG. 1 is a perspective view of a conventional multi-function exercise machine for exercising the legs and arms/shoulders of a user.
Figure 2A:
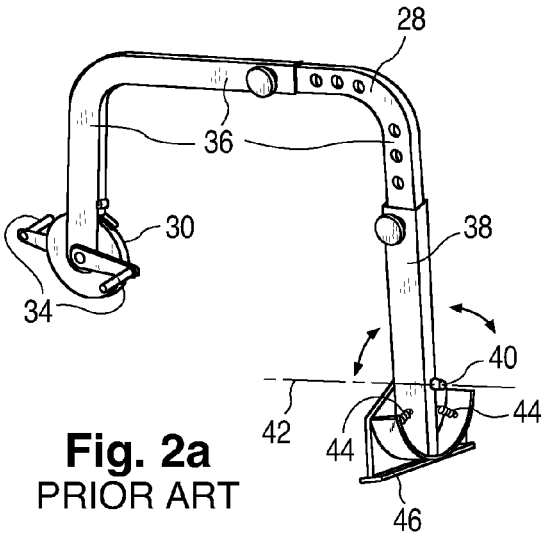
Fig. 2a PRIOR ART
FIGS. 2*a* and 2*b* are perspective views of two respective implementations of the upper-body assembly and rotational arm-shoulder device in the exercise machine of FIG. 1.
Figure 2B:
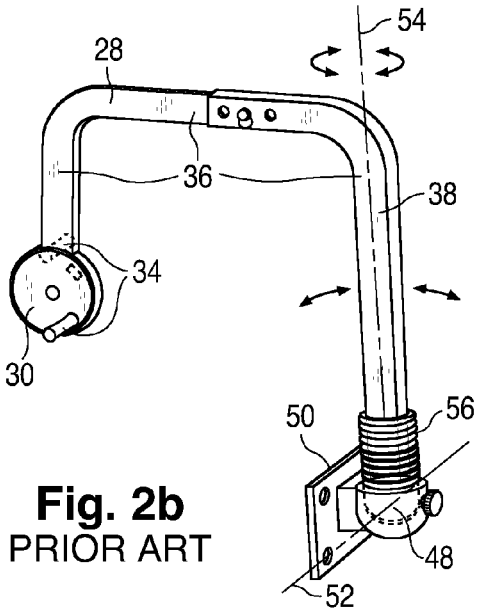
Fig. 2b PRIOR ART
Figure 3:
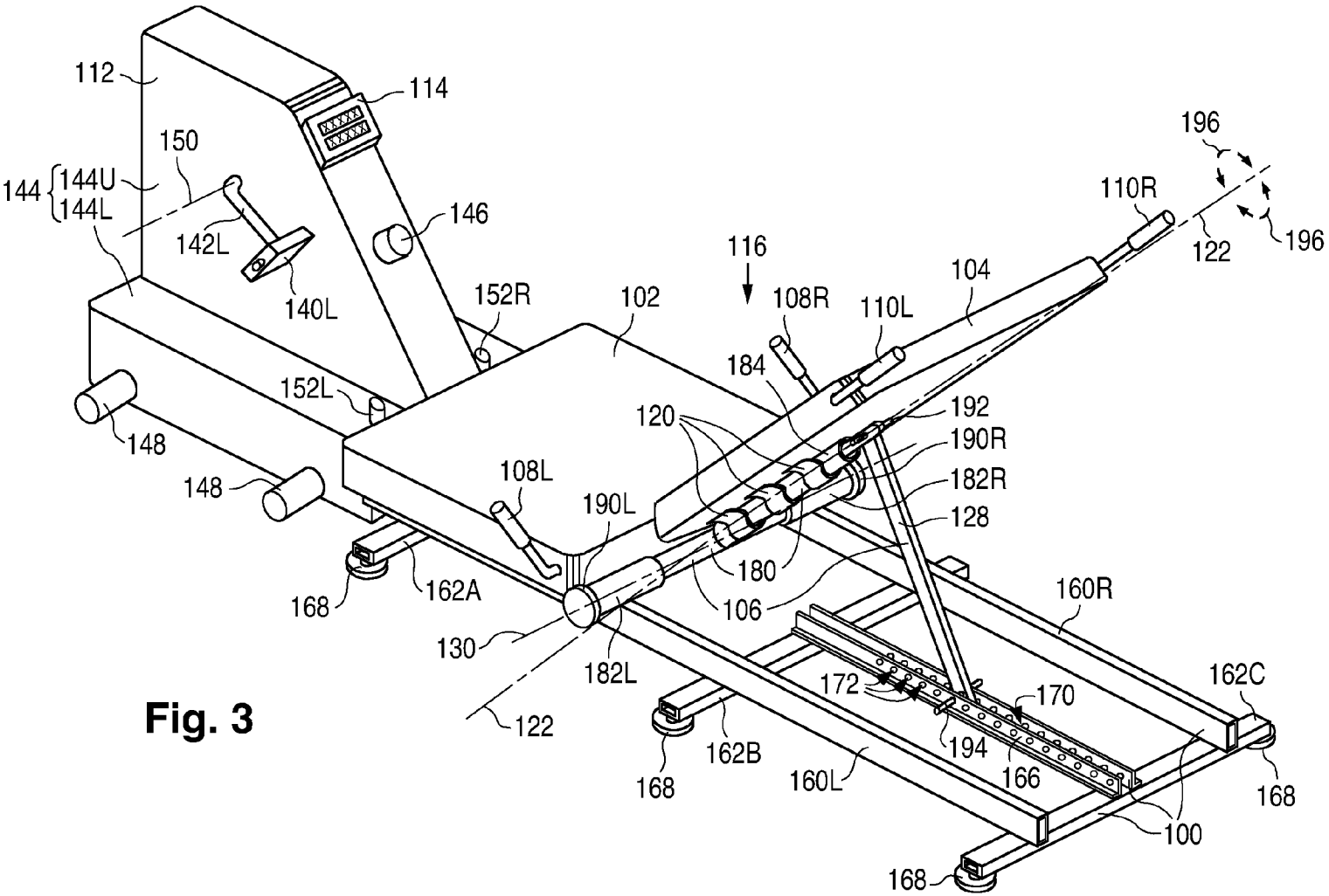
FIGS. 3-5 are respective perspective, side, and top views of a multi-function exercise machine disclosed in U.S. patent application Ser. No. 11/508,424 for exercising various muscles, including the legs and abdominal muscles, of a user.
Figure 4:
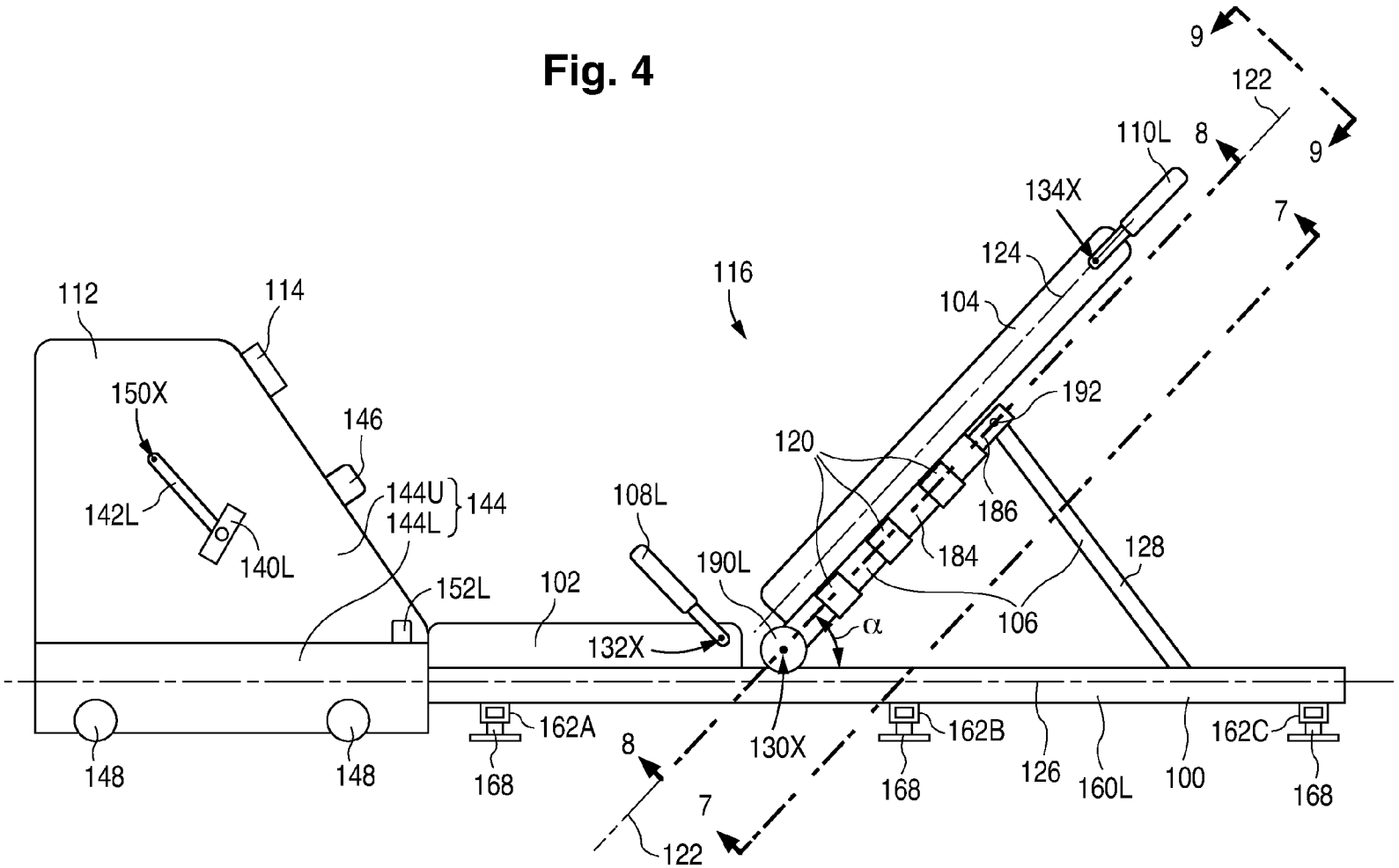
Figure 5:
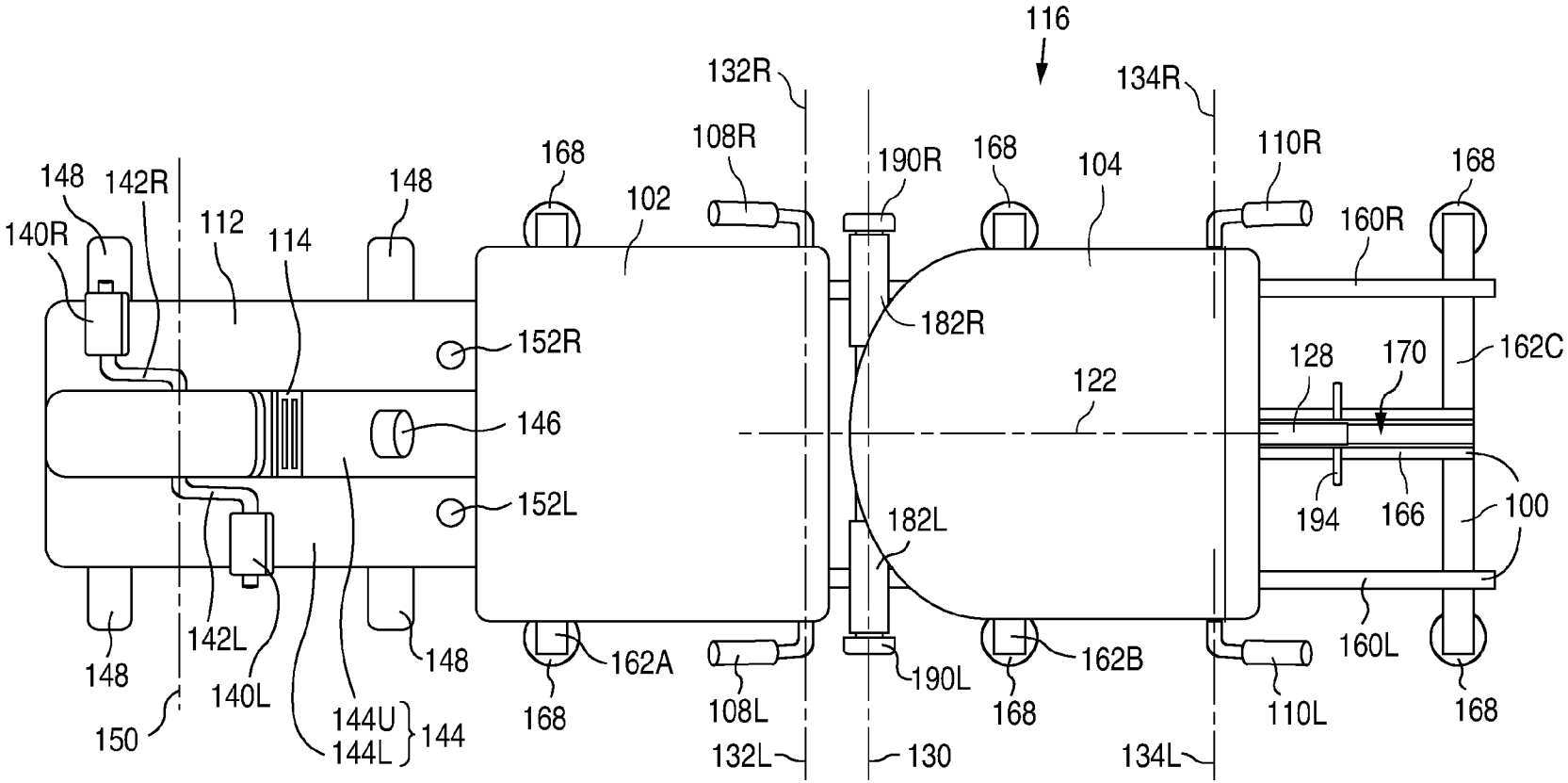

FIGS. 3-5 illustrate a multi-function exercise machine disclosed in U.S. patent application Ser. No. 11/508,424 for enabling a user to exercise various muscles, including the user's legs and abdominal muscles. The exercise machine of FIGS. 3-5 consists of a frame 100, a generally rectangular seat 102, a seatback 104, a mechanism 106 for connecting seatback 104 to frame 100 or/and seat 102, a first pair of handles 108L and 108R (collectively "handles 108"), a second pair of handles 110L and 110R (collectively "handles 110"), a pedal-revolving pedaling mechanism 112, and a visual readout display 114. Frame 100, seat 102, seatback 104, seatback-to-frame/seat connection mechanism 106, first handles 108, and second handles 110 form a main assembly 116.

The length of the exercise machine of FIGS. 3-5, including the length of frame 100 and main assembly 116, is taken in the horizontal direction in FIG. 4. The width of the exercise machine, including the width of each of frame 100, seat 102, and seatback 104, is taken in the vertical direction in FIG. 5 and thus perpendicular to the plane of FIG. 4.

Seat 102 is fixedly mounted on frame 100 near the front end of frame 100. Seatback-to-frame/seat connection mechanism 106 is fixedly connected to frame 100 near the back edge of seat 102. Connection mechanism 106 can alternatively or additionally be connected to seat 102 along its back edge. In either case, seat 102 is situated laterally between connection mechanism 106 and pedal-revolving pedaling mechanism 112. Connection mechanism 106 includes a group of outwardly curved attachment brackets 120 that fixedly connect connection mechanism 106 to the back of seatback 104. Three attachment brackets 120 are so utilized in the example of FIGS. 3-5.

Seatback-to-frame/seat connection mechanism 106 has a swivel axis 122 that extends generally parallel to the longitudinal centerline 124 (see FIG. 4) of seatback 104 and thus generally perpendicular to the width of seatback 104. That is, swivel axis 122 extends generally parallel to the length of the torso of a typical user seated on seat 102 with the user's back lying generally flat against seatback 104. Consequently, swivel axis 122 lies in a vertical plane which extends approximately through the longitudinal centerline 124 of seatback 104 and thus also approximately through a machine reference line 126 (also see FIG. 4) that extends along the length of the exercise machine through its center widthwise.

FIGS. 3-5 depict the situation in which seatback 104 is inclined backward relative to seat 102. In particular, the incline angle $\alpha$ between swivel axis 122 and machine reference line 126 (again see FIG. 4) is between 0° and 90°. When so oriented, seatback 104 is often referred to here as being in the inclined position.

Connection mechanism 106 includes a support rod 128 which is adjustably and flexibly connected to frame 100 so that mechanism 106 can be turned about a connection axis 130 depicted in FIGS. 3 and 5. Connection axis 130, whose location is indicated by dot 130X in FIG. 4, extends generally parallel to the width of the exercise machine and thus generally perpendicular to both machine reference line 126 and longitudinal centerline 124 of seatback 104. Connection axis 130 is close to the back of seat 102 and the bottom of seatback 104. This enables the incline of seatback 104 to seat 102 to be adjusted from an $\alpha$ value close to 0° to an $\alpha$ value in the vicinity of 90°. In other words, the seatback-to-seat incline can be varied between a position in which seatback 104 lies nearly flat on frame 100 and a position in which seatback 104 is nearly perpendicular to frame 100 and seat 102. As discussed further below, connection mechanism 106 is also configured so that seatback 104 can swivel (revolve, essentially rotate, through some angle) about swivel axis 122 as a user exercises with the machine of FIGS. 3-5.

First handles 108, referred to here generally as "seat" handles, are shown in FIGS. 3-5 as being received by seat 102 at generally opposite locations along the side (longitudinal) edges of seat 102 near its back edge and thus near the bottom of seatback 104. Seat handles 108 are preferably movable relative to seat 102. Alternatively, seat handles 108 can be received by frame 100 at corresponding opposite locations below the reception locations shown in FIGS. 3-5 near the back edge of seat 102. Seat handles 108 are then preferably movable relative to frame 100.

FIGS. 3-5 show second handles 110, referred to here generally as "seatback" handles, as being received by seatback 104 at generally opposite locations along the side (longitudinal) edges of seatback 104 near its top edge. Seatback handles 110 are preferably movable relative to seatback 104. Depending on the configuration of connection mechanism 106, seatback handles 110 can alternatively be received by connection mechanism 106 at corresponding generally opposite locations close to the reception locations shown in FIGS. 3-5. In that case, seatback handles 110 are preferably movable relative to connection mechanism 106.

Handles 108 and 110 can move in various ways. Seat handles 108L and 108R can be respectively turned about first handle axes 132L and 132R depicted in FIG. 5. First handle axes 132L and 132R, whose locations are generally indicated by dot 132X in FIG. 4, can be a common first handle axis extending generally parallel to the width of the exercise machine. Seat handles 108 can be rigidly connected together inside or below seat 102. Handles 108 then turn simultaneously (in synchronism) about the common first handle axis. Alternatively, handles 108L and 108R can be respectively turned about first handle axes 132L and 132R independently of each other. Handle axes 132 can then be inclined or/and slightly laterally offset from each other.

Similar comments apply to seatback handles 110. Seatback handles 110L and 110R can be respectively turned about second handle axes 134L and 134R depicted in FIG. 5. Second handle axes 134L and 134R, whose locations are generally indicated by dot 134X in FIG. 4, can be a common second handle axis extending generally parallel to the width of the exercise machine. Seatback handles 110 can be rigidly connected together inside or behind seatback 104. Handles 110 then turn simultaneously (in synchronism) about the common second handle axis. Alternatively, handles 110L and 110R can be respectively turned about second handle axes 134L and 134R independently of each other. In that case, handle axes 134 can be inclined or/and slightly laterally offset from each other.

Pedal-revolving pedaling mechanism 112 consists of a pair of foot pedals 140L and 140R (collectively "pedals 140"), a pair of pedal cranks 142L and 142R (collectively "cranks 142"), a cycle housing 144, an internal cycling apparatus (not shown) situated inside cycle housing 144, a resistance-adjustment knob 146 for adjusting the pedaling resistance, and a group of housing feet 148. Cycle housing 144 consists of a relatively high upper portion 144U and a wider lower portion 144L that provides pedaling mechanism 112 with mechanical stability. The longitudinal sides of lower housing portion 144L are approximately equidistant from the longitudinal sides of upper housing portion 144U.

Upper housing portion 144U has a slanted back surface on which resistance-adjustment knob 146 and readout display 114 are situated. Depending on the configuration of the internal cycling apparatus, resistance-adjustment knob 146 can alternatively be located on top of housing 144 or at some other suitable housing location readily accessible to a user. The slanting of the back surface of upper housing portion 144U makes it easy for the user to read readout display 114 while seated on seat 102.

Pedal cranks 142 are connected to the internal cycling apparatus of pedaling mechanism 112 through respective openings in the sides of upper housing portion 144U. Foot pedals 140L and 140R are respectively connected to pedal cranks 142L and 142R so as to allow each pedal 140L or 140R to rotate around a portion of that pedal's crank 142L or 142R. Another portion of each pedal crank 142L or 142R rotates around a pedaling axis 150 depicted in FIGS. 3 and 5. Pedaling axis 150, whose location is indicated by dot 150X in FIG. 4, extends generally parallel to the width of the exercise machine. As a result, pedals 140 revolve around pedaling axis 150.

The internal cycling apparatus of pedaling mechanism 112 can be implemented in various ways. Similar to what occurs in U.S. Pat. No. 6,902,515 B2 mentioned above, the internal cycling apparatus can include a flywheel and a pulley in which a belt runs around a pair of pulley wheels. One of the pulley wheels is connected to pedal cranks 142 so as rotate around pedaling axis 150. The other pulley wheel is connected center-to-center to the flywheel. When caused to rotate by the pulley, the flywheel provides cycling resistance. An internal extension of adjustment knob 146 can press on the belt to enable the cycling resistance to be adjusted by turning knob 146. The pulley wheel connected to pedal cranks 142 is typically of considerably greater diameter than the pulley wheel connected to the flywheel.

Housing feet 148 are implemented here as circular cylinders connected to the lower housing portion 144L along its lower surface so as to extend downward slightly farther than cycle housing 144. This implementation of housing feet 148 facilitates sliding housing 144 along the underlying surface. Pedaling mechanism 112 has four housing feet 148 in the example of FIGS. 3-5. Two of housing feet 148 are on each side of housing 144.

Pedaling mechanism 112 is adjustably connected to the front end of main assembly 116, specifically the front end of frame 100, as further described below in connection with FIG. 6 for enabling the distance from seat 102, e.g., the back edge of seat 102, to pedaling axis 150 to be adjusted in order to accommodate the size of the user. FIGS. 3-5 depict the situation in which pedaling mechanism 112 substantially touches seat 102 and thus the situation in which the distance from seat 102 to pedaling axis 150 is at a minimum value. Pedaling mechanism 112 and seat 102 are spaced apart from each other when the distance from seat 102 to pedaling axis 150 is adjusted to exceed the minimum value.

In the example of FIGS. 3-5, the distance from seat 102 to pedaling axis 150 is adjusted with a pair of knobs 152L and 152R (collectively "knobs 152") situated on lower housing portion 144L on opposite sides of upper housing portion 144U. Distance-adjustment knobs 152 are depicted in FIGS. 3-5 as being close to the back of pedaling mechanism 112 but, depending on how the seat-to-pedaling-axis distance is adjusted, can be closer to the front of pedaling mechanism 112. Depending on how the seat-to-pedaling-axis distance is adjusted, one or more devices other than distance-adjustment knobs 152 can be utilized to adjust the distance from seat 102 to pedaling axis 150.

Readout display 114 visually presents exercise information that occurs during operation of the exercise machine of FIGS. 3-5. Information provided by display 114 typically includes the instantaneous cycling rate, the duration of an exercise period by a user actuating pedaling mechanism 112, and the estimated caloric energy expended by the user during the exercise period. The instantaneous cycling rate is the number of pedaling cycles per unit time, typically per minute, where each cycle is a full revolution of either of pedals 140. Display 114 may present the total number of pedaling cycles during the exercise period. Display 114 may also present the user's pulse rate by way of a device (not shown) which can be attached to an appropriate part of the user's body to measure the user's pulse rate. The pulse-rate measuring device can be permanently or detachably connected to display 114.

One or more on/off switches (not separately shown) are provided on readout display 114 for enabling a user to control presentation of certain of the displayed exercise information. For instance, display 114 may present the duration of an exercise period and the user's estimated caloric energy expended during the exercise period only upon manually turning such an on/off switch on to start the exercise period. The on/off switch can later be manually turned off to stop the exercise period. The on/off switch may also automatically turn off when the instantaneous cycling rate has dropped substantially to zero for a selected period of time, e.g., 5-10 minutes. Display 114 may present the instantaneous cycling rate only when the on/off switch is turned on, or whenever the instantaneous cycling rate is significantly above zero, e.g., at least 5 cycles per minute, for a sufficiently long period, e.g., 10 seconds.

The top of seat 102 and the front of seatback 104 typically consist of leather or leather-like material. The insides of seat 102 and seatback 104 typically consist of cushion-like material formed with suitable foam or/and cotton.

Figure 6:
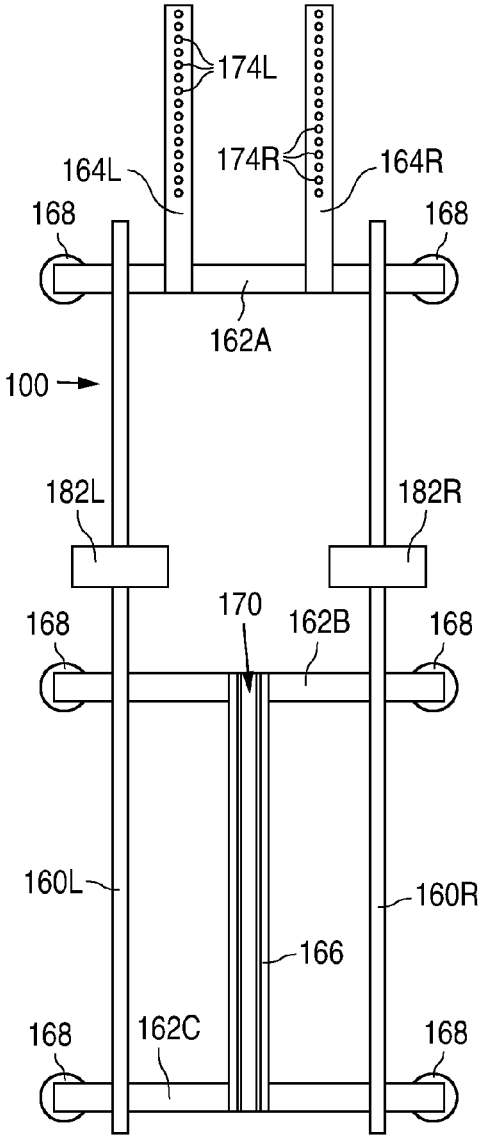
FIG. 6 is a top plan view of the frame in the exercise machine of FIGS. 3-5.

FIG. 6 particularly illustrates the layout of frame 100. As shown in FIGS. 3-6, frame 100 is an assembly consisting of two straight long longitudinal rails 160L and 160R (collectively "long rails 160") extending generally parallel to each other, three straight cross rails 162A, 162B, and 162C (collectively "cross rails 162") extending generally perpendicular to long rails 160, a pair of straight short longitudinal rails 164L and 164R (collectively "short rails 164") extending generally perpendicular to long rails 160, a straight channel portion 166 extending generally parallel to long rails 160, and six generally circular frame feet 168.

Long rails 160 are situated on, and rigidly connected to, cross rails 162 at spaced-apart locations along the length of frame 100 from front to back. Short rails 164 (only depicted in FIG. 6) are situated on, and rigidly connected to, front cross rail 162A at locations between long rails 160 and extend forward beyond long rails 160. Alternatively, short rails 164 can be flexibly connected to cross rail 162A so that they can be placed in a position in which they do not extend forward beyond long rails 160 when they are not connected to pedal-revolving mechanism 112. Channel portion 166 is situated on, and rigidly connected to, center cross rail 162B and back cross rail 162C at locations approximately mid-way between long rails 160. Two of frame feet 168 are connected to the bottom of each cross rail 162A, 162B, or 162C respectively close to its ends.

Rails 160, 162, and 164 typically consist of metal and are illustrated in FIGS. 3-5 as hollow but can be solid. Channel portion 166 likewise typically consists of metal and is shown in FIGS. 3, 5, and 6 as being formed with two members of L-shaped cross-section but can be a single member of U-shaped cross-section. In either case, channel portion 166 has an upward-extending channel 170. A plurality of pairs of oppositely situated horizontal circular openings 172 extend respectively through the side members of channel portion 166. As further described below, channel portion 166 acts as an interface to connection mechanism 106. The bottoms of frame feet 168 consist of rubber or/and rubber-like material that helps inhibit feet 168 from sliding on the underlying surface.

Standard mechanical connecting elements (not shown) such as bolts, nuts, and screws are used to connect rails 160, 162, and 164 and channel portion 166 to one another and to connect seat 102 to long rails 160. Metal-fusing techniques such as welding can be used in connecting components 160, 162, 164, and 166 to one another.

Short rails 164 respectively extend into a pair of openings (not shown) in the back of pedaling mechanism 112 for adjustably connecting mechanism 112 to the front end of frame 100 of main assembly 116 to accommodate the user's size, primarily the length of the user's legs. For use in making this adjustable connection, a plurality of vertical circular openings 174L situated generally in a line extend through short rail 164L. A like plurality of vertical circular openings 174R situated generally in a line extend through short rail 164R. Openings 174R are respectively situated substantially directly opposite openings 174L so that openings 174L and 174R (collectively "openings 174") are allocated into pairs of oppositely situated openings 174.

Distance-adjustment knob 152L (see FIGS. 3-5) is situated generally above the line of openings 174L in short rail 164L while distance-adjustment knob 152R (likewise see FIGS. 3-5) is situated generally above the line of openings 174R in short rail 164R. Knobs 152 have respective internal extensions (not shown) which respectively pass through a selected one of the pairs of oppositely situated openings 174 thereby connecting pedaling mechanism 112 to the front end of frame 100 of main assembly 116. The knob extensions also respectively pass through a pair of openings in an underlying piece of material rigidly connected to cycle housing 144 so as to make the connection solid.

The connection of pedaling mechanism 112 to the front end of main assembly 116 is adjusted by first pulling distance-adjustment knobs 152 sufficiently upward to release the connection. The depth to which short rails 164 extend into the openings in pedaling mechanism 112 is changed. Knobs 152 are then pushed downward so that the knob extensions respectively pass through another selected pair of oppositely situated openings 174 and through the two openings in the underlying piece of material connected to housing 144. In addition to being adjustably connected to main assembly 116, pedaling mechanism 112 can be readily disconnected from assembly 116 to facilitate storing the exercise machine of FIGS. 3-5 and to enable another exercise mechanism, such as that described below in connection with FIGS. 11-13, to be adjustably connected to the front end of assembly 116 via short rails 164.

Figure 7:
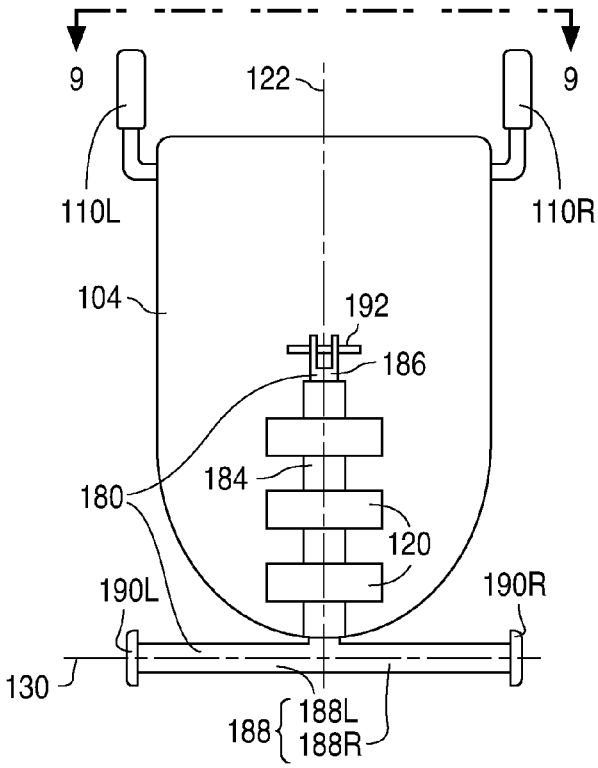
FIG. 7 is a backside plan view of the seatback and seatback-adjoining portion of the seatback-to-frame/seat connection mechanism in the exercise machine of FIGS. 3-5. The plan view of FIG. 7 is taken along plane 7-7 in FIGS. 4 and 9.
Figure 8:
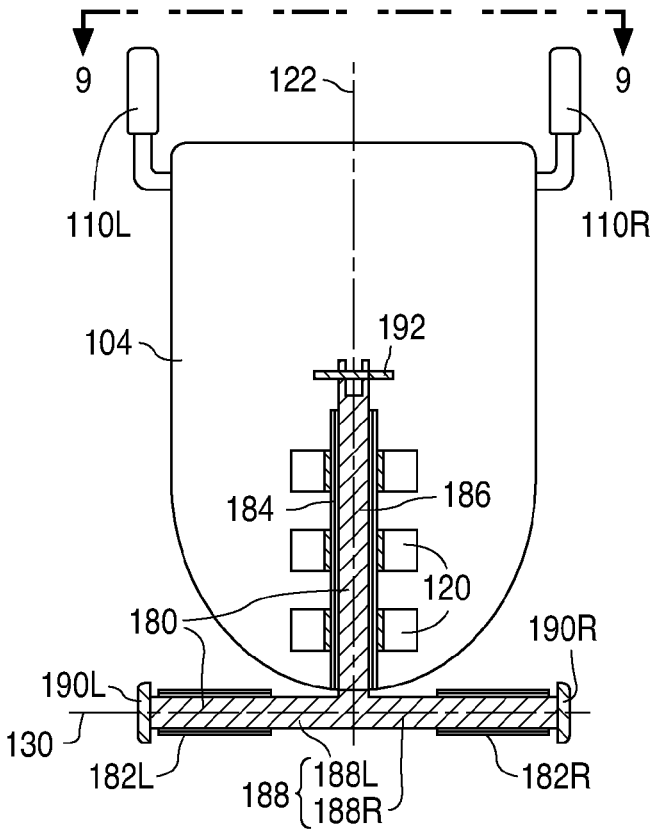
FIG. 8 is a cross-sectional plan view of the seatback and seatback-adjoining portion of the seatback-to-frame/seat connection mechanism in the exercise machine of FIGS. 3-5. The cross-sectional view of FIG. 8 is taken along plane 8-8 in FIGS. 4 and 9.
Figure 9:
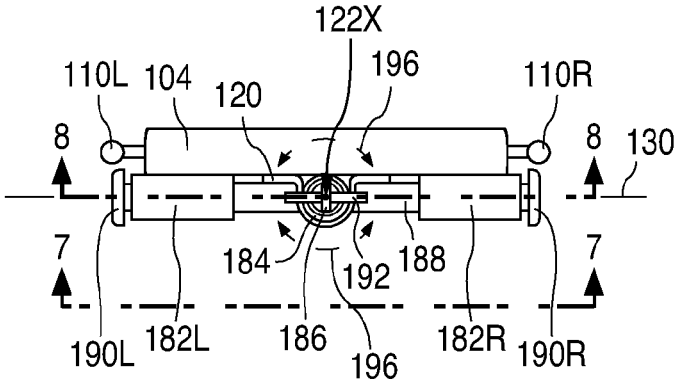
FIG. 9 is an end view of the seatback and seatback-adjoining portion of the seatback-to-frame/seat connection mechanism in the exercise machine of FIGS. 3-5. The end view of FIG. 9 is taken along plane 9-9 in FIGS. 4, 7, and 8.

FIGS. 7-9 particularly illustrate the structure of the seatback-adjoining portion of seatback-to-frame/seat connection mechanism 106 in conjunction with seatback 104. In addition to attachment brackets 120 and support rod 128, connection mechanism 106 includes a T-shaped bar portion 180, a pair of circular cylindrical cross-bar sleeves 182L and 182R (collectively "cross-bar sleeves 182"), and a circular cylindrical axial sleeve 184. T-shaped bar portion 180 is formed with a solid axial bar 186 extending generally along swivel axis 122, a solid circular cylindrical cross bar 188 extending generally along connection axis 130, and a pair of cross-bar end caps 190L and 190R (collectively "end caps 190"). Axial bar 186 meets cross bar 188 between its ends to divide cross bar 188 into a pair of cross-bar portions 188L and 188R of approximately the same length. Cross-bar sleeves 182L and 182R are respectively rigidly connected, e.g., welded, to long rails 160A and 160B (see FIGS. 3 and 6) and respectively flexibly receive cross-bar portions 188L and 188R in such a way that cross bar 188 can turn, i.e., rotate through some angle less than 360°, in sleeves 182.

Cross-bar end caps 190L and 190R respectively cover the ends of cross bar 188 as cross-bar portions 188L and 188R respectively just protrude out of cross-bar sleeves 182L and 182R. This acts to maintain longitudinal centerline 124 of seatback 104 and the longitudinal centerline of the seatback-adjoining portion of connection mechanism 106 in largely the same vertical plane as the longitudinal centerline of frame 100. Consequently, swivel axis 122 is in largely the same vertical plane as the longitudinal centerline of frame 100.

Axial sleeve 184 is rigidly connected to seatback 104 via attachment brackets 120. Axial bar 186 is circularly cylindrical for most of its length. Axial sleeve 184 flexibly receives axial bar 186 where it is cylindrical in such a way that axial sleeve 184 can turn, i.e., rotate through some angle less than 360°, around axial bar 186.

The remote end of axial bar 186, i.e., the end spaced apart from cross bar 188, splits into a pair of tines through which a pair of oppositely situated circular openings respectively extend. Letting the two ends of support rod 128 (see FIGS. 3 and 4) be respectively referred to as the seatback-associated end and the frame-associated end, a circular opening extends through the seatback-associated end of rod 128. With the seatback-associated end of support rod 128 positioned between the tines at the remote end of axial bar 186, support rod 128 is flexibly connected to axial bar 186 via a seatback-associated solid circular cylindrical pin 192 (especially see FIG. 3) that passes through the opening in the seatback-associated end of rod 128 and through the openings in the tines at the remote end of axial bar 186. Suitable movement-limiting elements (not shown), such as U bolts, cotter pins, or the like, are present at or near the ends of seatback-associated pin 192 to keep it permanently in place.

A circular opening also passes through the frame-associated end of support rod 128. The plurality of pairs of oppositely situated openings 172 in the side members of channel portion 166 of frame 100 define a like plurality of respectively corresponding frame-associated interface connection locations at which the frame-associated end of support rod 128 can be placed in channel 170. With the frame-associated end of support rod 128 placed at a selected one of those interface connection locations, support rod 128 is flexibly connected to channel portion 166 via a frame-associated solid circular cylindrical pin 194 (especially see FIG. 3) that passes through the opening in the frame-associated end of rod 128 and through the resulting selected pair of oppositely situated openings 172. Suitable movement-limiting elements (not shown), such as U bolts or the like, are present at or near the ends of frame-associated pin 194 to keep it in place during an exercise period. One of these movement-limiting elements can be readily removed by a person or, while the movement-limiting element stays in contact with pin 194, can be readily manipulated by a person for removing pin 194 from the exercise machine but otherwise prevents pin 194 from being removed from the machine during the exercise period.

Selection of a pair of oppositely situated openings 172 that receive frame-associated pin 194 establishes a particular value for the incline of seatback 104 to seat 102. The seatback-to-seat incline is adjusted by removing frame-associated pin 194 from the selected pair of openings 172 and from the opening in the frame-associated end of support rod 128, selecting another pair of oppositely situated openings 172, and then placing pin 194 through the new selected pair of openings 172 and through the opening in the frame-associated end of rod 128. This causes T-shaped bar portion 180 to turn about connection axis 130 by an angle typically no more than approximately 90°, thereby changing the seatback-to-seat incline defined quantitatively by angle $\alpha$ between swivel axis 122 and reference line 126. In particular, cross bar 188 extending along connection axis 130 turns in cross-bar sleeves 182L and 182R. Since the frame-associated end of support rod 128 can be flexibly connected to channel portion 166 at any one of the frame-associated interface connection locations defined by the pairs of oppositely situated openings 172, the frame-associated end of rod 128 is both flexibly and adjustably connected to channel portion 166. In addition, channel portion 166 acts as an interface portion of frame 100 for enabling the seatback-to-seat incline to be adjusted by selecting different ones of those interface locations.

With support rod 128 connected to interface channel portion 166 of frame 100, axial sleeve 184 of connection mechanism 106 can turn, i.e., rotate through some angle less than 360°, about axial bar 186 of T-shaped bar portion 180 and thus can similarly turn around swivel axis 122. The turning of axial sleeve 184 around axial bar 186 and swivel axis 122 is indicated by dashed-line curved arrows 196 in FIG. 3. In FIG. 9 where dot 122X indicates the location of swivel axis 122 because it extends perpendicular to the plane of the figure, curved arrows 196 also indicate how axial sleeve 184 can turn around axial bar 186 and swivel axis 122. One or more rings of ball bearings (not shown) can be inserted between axial bar 186 and axial sleeve 184 to facilitate the turning of sleeve 184 around bar 186. Since seatback 104 is rigidly connected to axial sleeve 184, seatback 104 can swivel about axial bar 186 and therefore also about swivel axis 122. Arrows 196 in FIGS. 3 and 9 also indicate the swiveling of seatback 104 about axial bar 186 and swivel axis 122.

The bottom edge of seatback 104 is shaped in such a way as to enable seatback 104 to swivel through a substantial angle about swivel axis 122 depending on the incline of seatback 104 to seat 102. The angle through which seatback 104 can swivel about swivel axis 122 generally increases as the seatback-to-seat incline, as measured by incline angle $\alpha$, increases. The maximum seatback swivel thus typically occurs when seatback 104 is approximately perpendicular to seat 102, i.e., incline angle $\alpha$ is approximately 90°. FIGS. 5, 7, and 8 illustrate the bottom edge of seatback 104 as being curved in a generally convex manner. However, the bottom edge of seatback 104 can be shaped in other ways for facilitating the seatback swivel.

Figure 10:
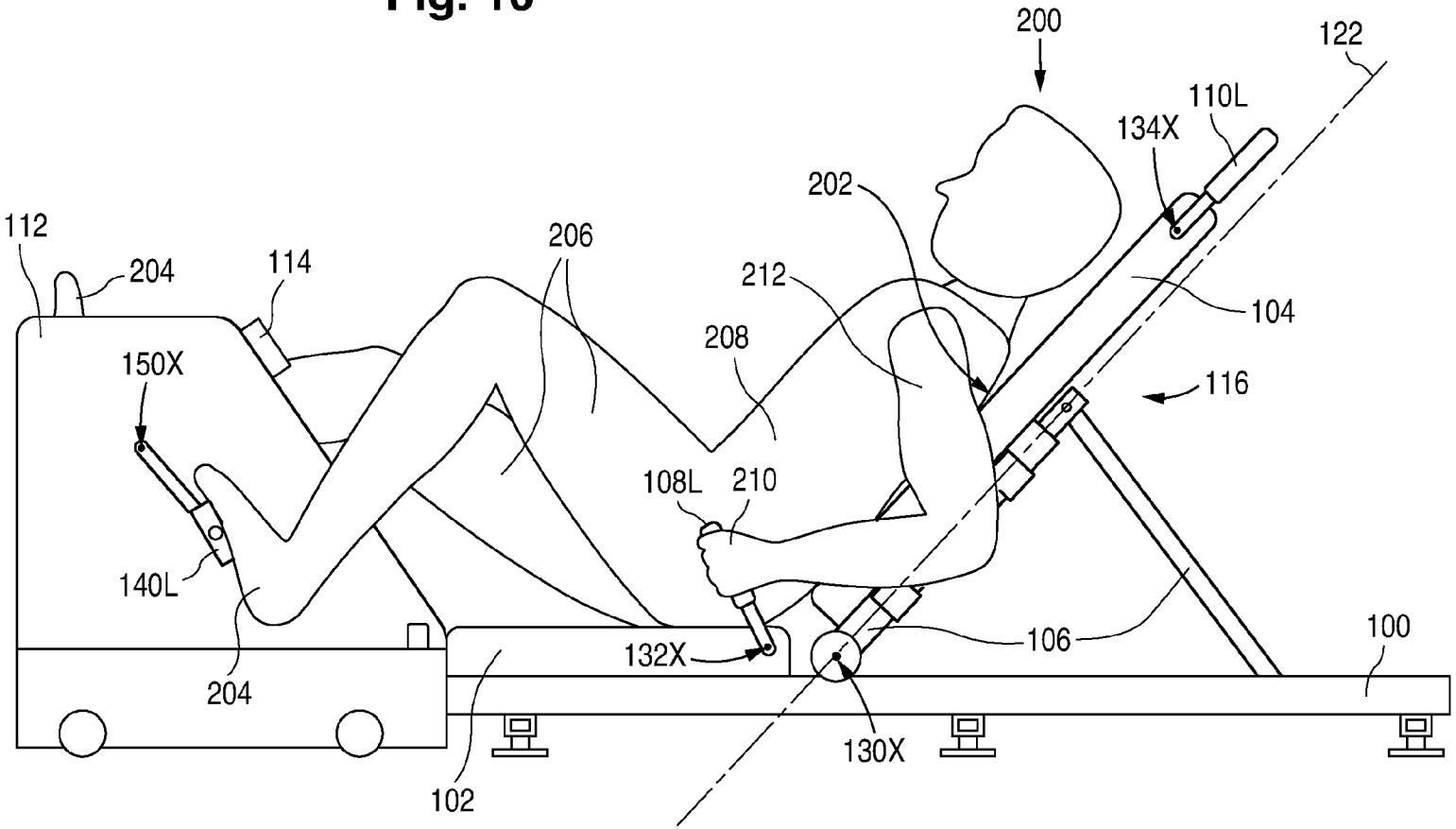
FIG. 10 is a side view of an example of how the exercise machine of FIGS. 3-5 is used for exercising.

FIG. 10 presents an example of how a typical human adult 200 uses the multi-function exercise machine of FIGS. 3-5 to exercise in a seated exercise position. In this example, user 200 is seated on seat 102 with user's back 202 lying generally against seatback 104. With user's feet 204 respectively on foot pedals 140, user 200 pumps pedals 140 respectively with user's feet 204 to cause pedals 140 to revolve. This exercises user's legs 206. While exercising user's legs 206, user 200 can check readout display 114 for the various information presented on display 114, including an estimate of the caloric energy consumed by user 200 as a result of pumping pedals 140.

User 200 exercises the user's abdominal muscles by swiveling user's torso 208 about swivel axis 122 while user 200 is in the seated exercise position so as to cause seatback 104 to swivel about axis 122. The incline of seatback 104 to seat 102 is adjusted prior to an exercise period to adjust the exercise of the user's abdominal muscles during the exercise period. Reducing the seatback-to-seat incline so that seatback 104 slants further downward away from seat 102 typically increases the exercise of the user's abdominal muscles.

User 200 can pump foot pedals 140 at the same time that user's torso 208 swivels about swivel axis 122, thereby simultaneously exercising user's legs 206 and the user's abdominal muscles. Alternatively, user 200 can do only one of these two exercising actions during an exercise period.

User's hands 210 can be in various places. For example, user's hands 210 can respectively grip seat handles 108 as indicated in FIG. 10. This may facilitate pumping of foot pedals 140 by user's feet 204. User 200 can also move seat handles 108 with user's hands 210 to exercise user's arms 212. Alternatively, user's hands 210 can respectively grip seatback handles 110 to enhance swiveling user's torso 208 about swivel axis 122, thereby increasing the exercise of the user's abdominal muscles. User's hands 210 can, of course, grip other parts of the exercise machine or no part(s) of the machine.

Figure 11:
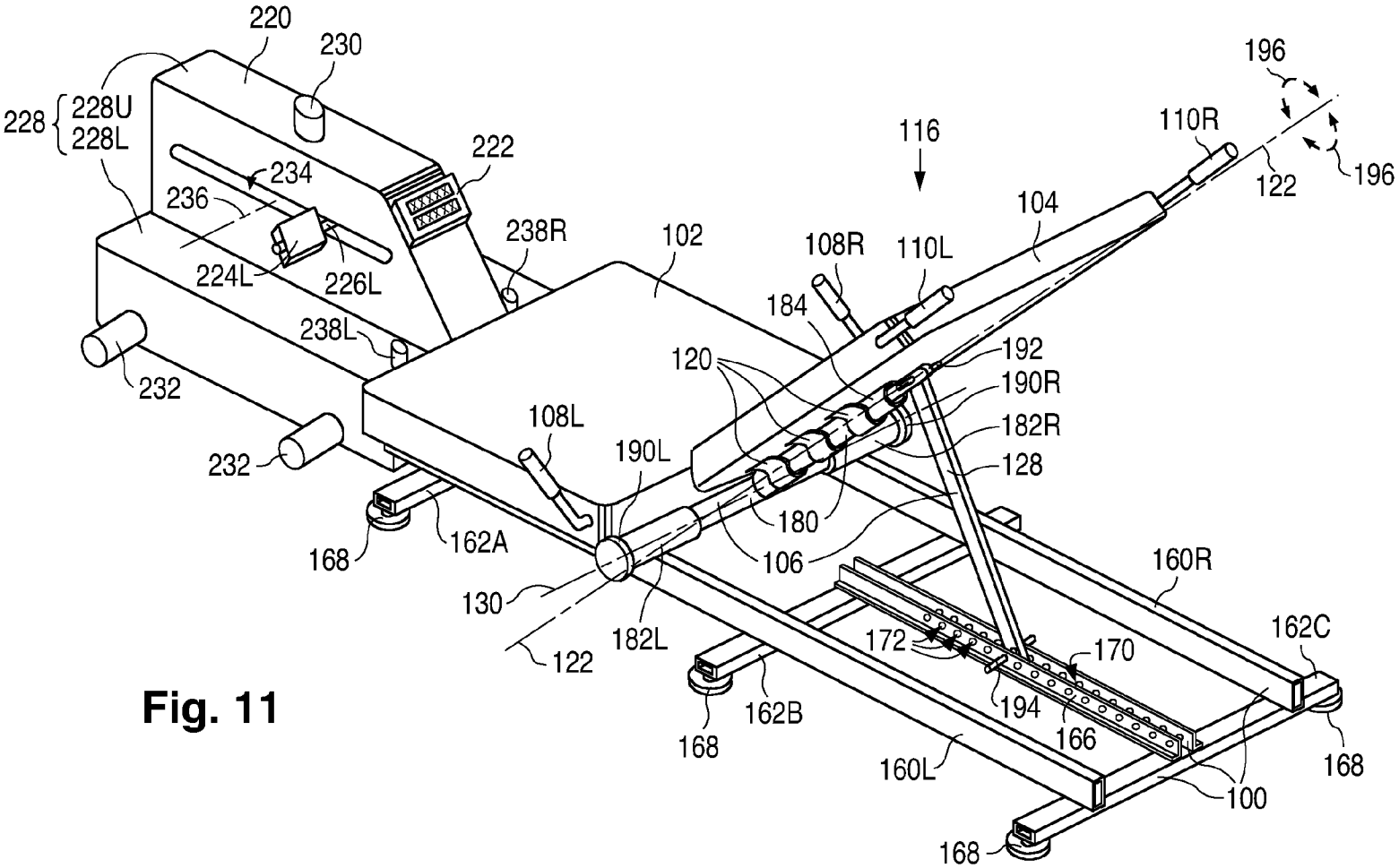
FIGS. 11 and 12 are respective perspective and side views of another multi-functional exercise machine disclosed in U.S. patent application Ser. No. 11/508,424 for exercising various muscles, including the legs and abdominal muscles, of a user.
Figures 12, 13:
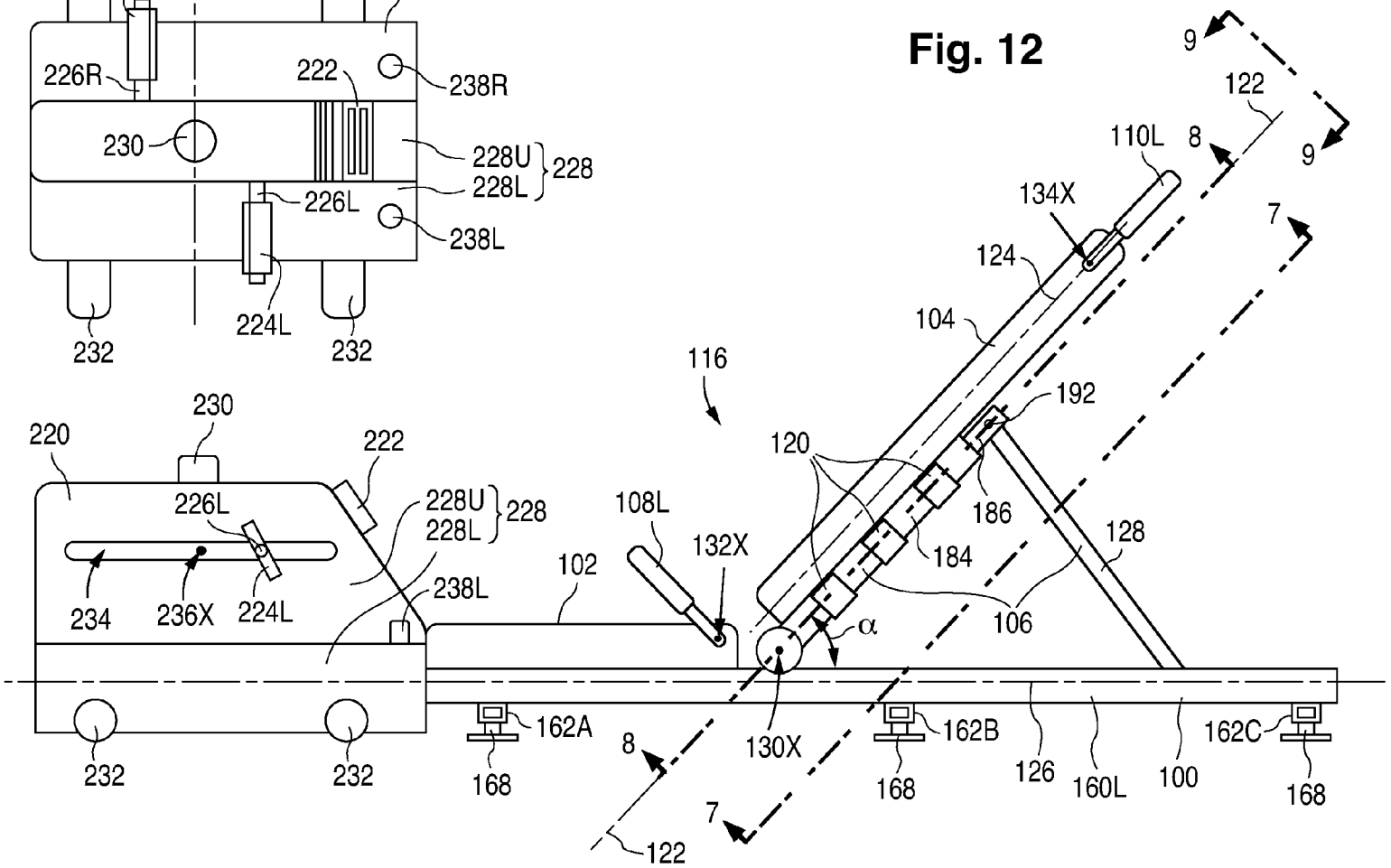
FIG. 13 is a top view of the pedal-translating mechanism in the exercise machine of FIGS. 11 and 12.

FIGS. 11 and 12 illustrate another multi-function exercise machine disclosed in U.S. patent application Ser. No. 11/508,424 for enabling a user to exercise various muscles, including the user's legs and abdominal muscles. The exercise machine of FIGS. 11 and 12 consists of frame 100, seat 102, seatback 104, mechanism 106 for connecting seatback 104 to frame 100 or/and seat 102, seat handles 108, seatback handles 110, a pedal-translating pedaling mechanism 220, and a visual readout display 222. Frame 100, seat 102, seatback 104, seatback-to-frame/seat connection mechanism 106, and handles 108 and 110 in main assembly 116 of the exercise machine of FIGS. 11 and 12 are configured, interconnected, and operable the same as in the exercise machine of FIGS. 3-5. Readout display 222 in the machine of FIGS. 11 and 12 provides largely the same exercise information as readout display 114 in the machine of FIGS. 3-5. The two exercise machines differ in that pedal-translating mechanism 220 in the exercise machine of FIGS. 11 and 12 replaces pedal-revolving mechanism 112 in the exercise machine of FIGS. 3-5.

Pedal-translating pedaling mechanism 220 is further illustrated in FIG. 13. With reference to FIGS. 11-13, pedaling mechanism 220 consists of a pair of foot pedals 224L and 224R (collectively "pedals 224"), a pair of pedal connectors 226L and 226R (collectively "connectors 226"), a translator housing 228, an internal translating apparatus (not shown) situated inside translator housing 228, a resistance-adjustment knob 230 for adjusting the pedaling resistance, and a group of housing feet 232. Translator housing 228 consists of an upper portion 228U and a wider lower portion 228L that provides pedaling mechanism 220 with mechanical stability. The longitudinal sides of lower housing portion 228L are approximately equidistant from the longitudinal sides of upper housing portion 228U.

Upper housing portion 228U has a slanted back surface on which readout display 222 is situated to make it easy for a user to read readout display 222 while the user is seated on seat 102. Resistance-adjustment knob 230 is situated on top of translator housing 228 but, depending on the configuration of the internal translator apparatus, can be located at some other suitable housing location readily accessible to the user.

Pedal connectors 226 are connected to the internal translating apparatus of pedaling mechanism 220 through two respective generally straight opposing connector slots 234 in the sides of upper housing portion 228U. Connector slots 234 typically extend largely in the longitudinal direction of the exercise machine of FIGS. 11 and 12, i.e., parallel to reference line 126, but can extend at a small angle to the exercise machine's longitudinal direction. Connector slots 234 are typically of largely the same length.

Foot pedals 224L and 224R are respectively connected to pedal connectors 226L and 226R so as to allow each pedal 224L or 224R to rotate around a portion of that pedal's connector 226L or 226R. Pedal connectors 226 translate (move linearly) back and forth in connector slots 234. Foot pedals 224 thereby translate back and forth in the direction of connector slots 234 within a distance range slightly less than the lengths of slots 234. More particularly, foot pedals 224 have a common center of mass that translates back and forth generally in a plane extending through connector slots 234. Each cycle of the instantaneous cycling rate presented on readout display 222 consists of a full back and forth translation of one of pedals 224.

Foot pedals 224 can translate back and forth in various ways. Pedals 224 are preferably controlled to operate in synchronism so that one of them translates back as the other translates forward. As measured from a position at which pedals 224 are directly opposite (and thus closest to) each other, the amounts (distances) of forward and backward translation are largely equal at any instant of time. In FIGS. 11 and 13, this pedal-opposing position is indicated by a translator reference line 236 extending parallel to the width of the exercise machine. Translator reference line 236, whose location is indicated by dot 236X in FIG. 12, normally lies in the plane through which the common center of mass of pedals 224 translates back and forth.

Foot pedals 224 can operate independently of each other. In that case, the internal translating apparatus of pedaling mechanism 220 may automatically causes pedals 224 to translate backward after they have translated forward and foot pressure on pedals 224 has been reduced sufficiently. Consequently, translator reference line 236 generally represents the neutral location for pedals 224 when they are directly opposite each other.

The internal translating apparatus of pedaling mechanism 220 can be implemented in various ways. In the preferred embodiment where foot pedals 224 operate in synchronism so that one of them translates back as the other translates forward, the internal translating apparatus can include a pulley arrangement that causes each pedal connector 226L or 226R to translate backward as the other pedal connector 226R or 226L translates forward. As measured from translator reference line 236 at which pedals 224 are directly opposite each other so that pedal connectors 226 are largely in line with each other, the pulley arrangement causes the amounts of forward and backward translation of pedal connectors 226 to be largely equal. An internal extension of resistance-adjustment knob 230 can press on a belt of the pulley arrangement to enable the translator resistance to be adjusted by turning knob 230.

As with housing feet 148 in the exercise machine of FIGS. 3-5, housing feet 232 are implemented here as circular cylinders connected to the lower housing portion 228L along its lower surface so as to extend downward slightly farther than translator housing 228. This implementation of housing feet 232 thereby facilitates sliding housing 228 along the underlying surface. Pedaling mechanism 220 has four housing feet 232 in the example of FIGS. 11-13. Two of housing feet 232 are on each side of housing 228.

Pedal-translating mechanism 220 is adjustably connected to the front end of frame 100 of main assembly 116 in the same manner as pedal-revolving mechanism 112 in the exercise machine of FIGS. 3-5. This enables the distance from seat 102 to translator reference line 236 in the exercise machine of FIGS. 11 and 12 to be adjusted in order to accommodate the size of the user. In particular, short rails 164 respectively extend into a pair of openings (not shown) in the back of pedaling mechanism 220. The distance from seat 102 to reference line 236 in the example of FIGS. 11 and 12 is adjusted with a pair of knobs 238L and 238R (collectively "knobs 238") situated on lower housing portion 228L on opposite sides of upper housing portion 228U typically close to the back of pedaling mechanism 220. Distance-adjustment knobs 238 have respective internal extensions and function the same as distance-adjustment knobs 152 in the exercise machine of FIGS. 3-5.

FIGS. 11 and 12 depict the situation in which pedaling mechanism 220 substantially touches seat 102 and thus the situation in which the distance from seat 102 to translator reference line 236 is at a minimum value. Pedaling mechanism 220 and seat 102 are spaced apart from each other when the distance from seat 102 to reference line 236 is adjusted to exceed the minimum value. Likewise analogous to pedal-revolving mechanism 112, pedal-translating mechanism 220 can be readily disconnected from main assembly 116 to enable another exercise mechanism, such as pedal-revolving mechanism 112, to be connected to the front end of assembly 116 via short rails 164.

Figure 14:
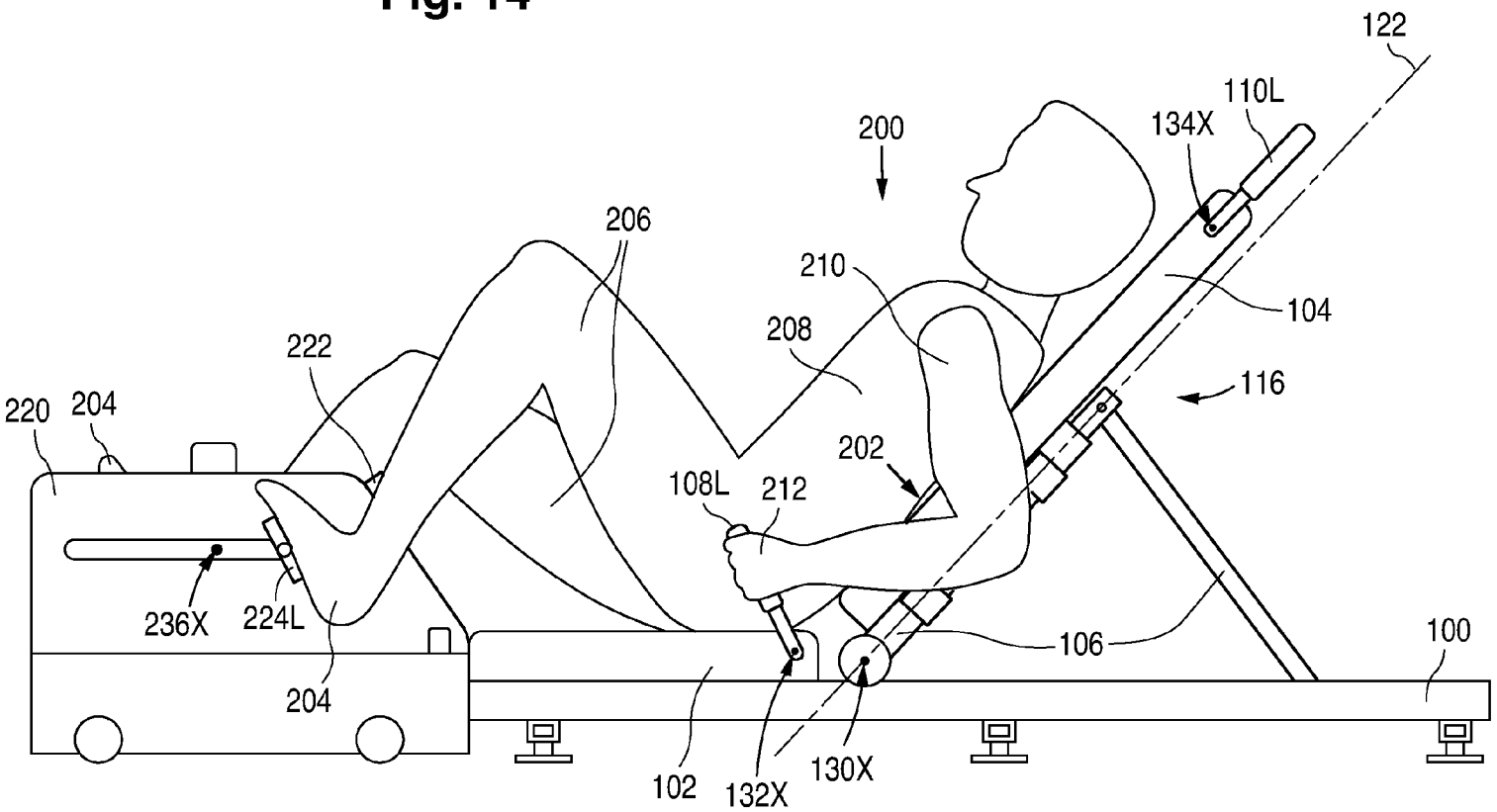
FIG. 14 is a side view of an example of how the exercise machine of FIGS. 11 and 12 is used for exercising.

FIG. 14 presents an example of how human adult 200 uses the multi-function exercise machine of FIGS. 11 and 12 in a seated exercise position. As in the seated-position example of FIG. 10, user 200 in the example of FIG. 14 is seated on seat 102 so that user's back 202 lies generally against seatback 104. With user's feet 204 respectively on foot pedals 224, user 200 pumps pedals 224 respectively with user's feet 204 to cause pedals 224 to translate back and forth. User's legs 206 are thereby exercised. Exercise of other parts of the user's body, including the user's abdominal muscles, with the exercise machine of FIGS. 11 and 12 is performed in substantially the way described above in connection with FIG. 10 for the exercise machine of FIGS. 3-5.

Upon disconnecting the frame-associated end of support rod 128 from channel portion 166 of frame 100 in the exercise machine of FIGS. 3-5 or in the exercise machine of FIGS. 11 and 12, seatback 104 can be rotated backward so as to lie flat or nearly flat against frame 100 in order to reduce the space occupied by main assembly 116. When so oriented, seatback 104 is often referred to herein as being in the flat position. Placing seatback 104 in the flat position facilitates storage of the exercise machine. When support rod 128 is so disconnected from frame 100, the frame-associated end of rod 128 is normally moved backward so as to lie close to the back end of frame 100. Storage can be further facilitated by disconnecting pedaling mechanism 112 or 220 from main assembly 116.

In the earlier drawings depicting the exercise machines disclosed in U.S. patent application Ser. No. 11/508,424, seatback-to-frame/seat connection mechanism 106 was shown as extending significantly backward beyond the back of seatback 104 in order to facilitate visual illustration of the structure of connection mechanism 106. Alternatively, the axial section of the seatback-adjoining portion of connection mechanism 106 can be recessed partially or fully into the back of seatback 104. This enables seatback 104 to lie flatter against frame 100 when the frame-associated end of support rod 128 is disconnected from channel portion 166, and seatback 104 is rotated backward toward frame 100. Main assembly 116 then occupies even less space so as to further facilitate exercise machine storage, especially when pedaling mechanism 112 or 220 is disconnected from main assembly 116.

Figure 15A:
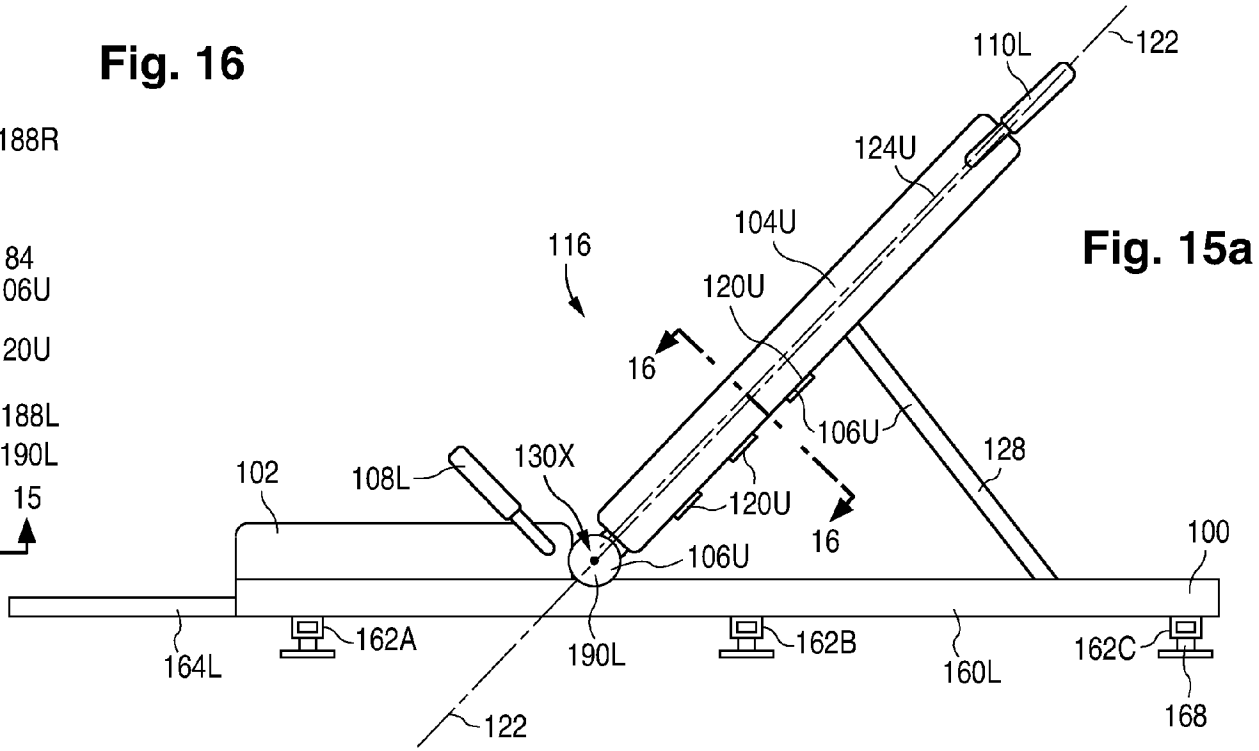
FIGS. 15*a* and 15*b* are side views of the main assembly (frame, seat, seatback, seatback-to-frame/seat connection mechanism, and handles) in the exercise machine of FIGS. 3-5 or FIGS. 11 and 12 as implemented with an alternative embodiment of the seatback and seatback-to-frame/seat connection mechanism.
Figure 15B:
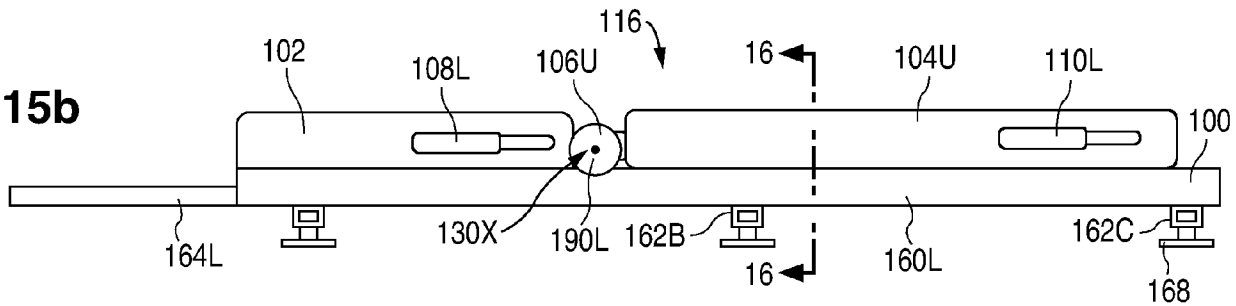
Figure 16:
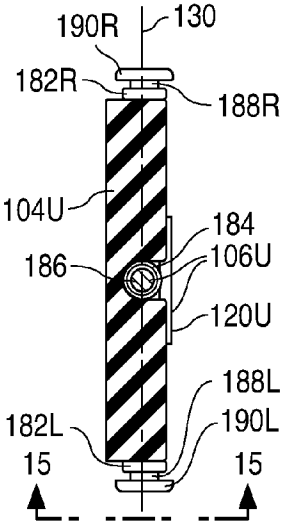
FIG. 16 is a cross-sectional end view of the seatback and seatback-adjoining portion of the seatback-to-frame/seat connection mechanism in FIGS. 15*a* and 15*b*. The cross-sectional view of FIG. 16 is taken along plane 16-16 in FIGS. 15*a* and 15*b*. The side views of the seatback and seatback-adjoining portion of the seatback-to-frame/seat connection mechanism of FIGS. 15*a* and 15*b* are taken along plane 15-15 in FIG. 16.

FIGS. 15*a* and 15*b* (collectively "FIG. 15") illustrate a version of main assembly 116 in which the axial section of the seatback-adjoining portion of a variation 106U of seatback-to-frame/seat connection mechanism 106 is recessed fully into the back of a variation 104U of seatback 104. FIG. 16 cross-sectionally illustrates seatback 104U and seatback-to-frame/seat connection mechanism 106U.

Seatback-to-frame/seat connection mechanism 106U is formed with support rod 128, T-shaped bar portion 180, cross-bar sleeves 182L and 182R, axial sleeve 184, pins 192 and 194, and a group of attachment brackets 120U corresponding to attachment brackets 120 in seatback-to-frame/seat connection mechanism 106U. As in connection mechanism 106, T-shaped bar portion 180 in connection mechanism 106U consists of axial bar 186, cross bar 188 formed with cross-bar portions 188L and 188R, and cross-bar end caps 190L and 190R. Components 182L, 182R, 184, 186, 188L, and 188R of connection mechanism 106U are visible in FIG. 16 but not in FIG. 15*a* or 15*b*.

The axial section of the seatback-adjoining portion of connection mechanism 106U consists of axial sleeve 184 and axial bar 186. As indicated in FIG. 16, axial section 184 and 186 of the seatback-adjoining portion of connection mechanism 106U is fully recessed into a channel in the back of seatback 104U. The channel in the back of seatback 104U typically extends up to its top edge. Attachment brackets 120U fixedly connect mechanism 106U, specifically axial sleeve 184, to the back of seatback 104U. In contrast to attachment brackets 120 which are curved outward to hold axial sleeve 184 against the back of seatback 104, attachment brackets 120U here are typically curved slightly inward but can be largely flat. Three attachment brackets 120U are shown in FIGS. 15*a* and 16. Due to the recessing of the axial section of the seatback-adjoining portion of connection mechanism 106U into seatback 104U, the longitudinal centerline 124U of seatback 104U is closer to swivel axis 122 than is longitudinal centerline 124 of seatback 104.

Aside from the differences just indicated, seatback 104U is configured largely the same as seatback 104. Consequently, the bottom edge of seatback 104U is shaped generally as shown in FIGS. 7 and 8 for seatback 104 to avoid inhibiting the swivel of seatback 104U about swivel axis 122. Support rod 128, T-shaped bar portion 180, cross-bar sleeves 182, axial sleeve 184, and pins 192 and 194 in connection mechanism 106U are respectively configured, interconnected, and operable the same as in connection mechanism 106.

FIG. 15*a* presents an example of how main assembly 116 appears when seatback 104U is in the inclined position. FIG. 15*b* shows how main assembly 116 appears when (a) seatback 104U is in the flat position and (b) the frame-associated end of support rod 128 has been disconnected from channel portion 166 (not visible in FIG. 15*b*) of frame 100. The top of seat 102 and the front of seatback 104U are largely coplanar. Support rod 128 (not visible in FIG. 15*b*) now lies in the portion of the seatback channel extending up to, or close to, the top edge of seatback 104U. Seat handles 108 and seatback handles 110 have been arranged in FIG. 15*b* to be no higher than the top of seat 102 and the front of seatback 104U. As FIG. 15*b* indicates, main assembly 116 is of relatively small height in this compressed position so as to facilitate storage of assembly 116.

Main assembly 116 in certain of the exercise machines of U.S. patent application Ser. No. 11/508,424 serves as an exercise bench regardless of whether pedal-revolving pedaling mechanism 112 or another exercise mechanism is, or is not, connected to the front end of assembly 116. In addition to seat handles 108 and seatback handles 110, one or more pairs of further handles may variously be provided on main assembly 116 to facilitate exercising in an exercise-bench configuration. A user can variously utilize handles 108 and 110 and the further handles to do various exercises without actuating pedaling mechanism 112. The user can also do exercises on main assembly 116 without employing any of handles 108 and 110 and the further handles.

Figure 17:
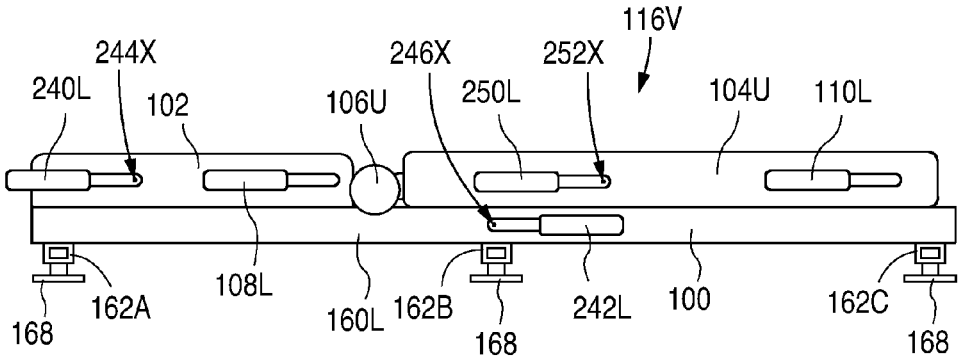
FIG. 17 is a side view of a multi-function exercise bench configured as a variation of the main assembly in the exercise machine of FIGS. 3-5 or FIGS. 11 and 12 using the seatback-to-frame/seat connection mechanism of FIGS. 15*a*, 15*b*, and 16.

FIG. 17 illustrates a variation 116V, as disclosed in U.S. patent application Ser. No. 11/508,424, of main assembly 116. Main assembly 116V can be substituted for main assembly 116 in any of the exercise machines of U.S. application Ser. No. 11/508,424. In addition, main assembly 116V is particularly suitable for use as an exercise bench.

Main assembly 116V includes frame 100, seat 102, seatback 104U, connection mechanism 106U, and handles 108 and 110 respectively configured, interconnected, and operable as described above except for the connections of short rails 164 to front cross rail 162A in frame 100. Short rails 164 are flexibly connected to front cross rail 162A for enabling short rails 164 to be placed in a retracted (or non-use) position in which they do not extend forward beyond long rails 160. Placement of short rails 164 in their retracted positions facilitates use of main assembly 116V as an exercise bench.

FIG. 17 specifically depicts the situation in which flexibly connected short rails 164 are in their retracted positions. Because short rails 164 are thereby hidden by long rails 160 when main assembly 116V is viewed from the side, short rails 164 do not appear in the side view of FIG. 17. Short rails 164 are in an extended (or use) position when they extend fully forward beyond the front ends of long rails 160.

The flexible connection of short rails 164 to front cross rail 162A can be implemented by slidably connecting short rails 164 to front cross rail 162A so that they can slide in sliding members rigidly connected to cross rail 162A. Sliding short rails 164 to locations fully between long rails 160 places short rails 164 in their retracted positions. In their retracted positions as viewed from above (or below) frame 100, most of each short rail 164 lies between front cross rail 162A and middle cross rail 162B.

If seat 102 can be readily removed from frame 100, the flexible connection of short rails 164 to front cross rail 162A can alternatively be implemented by hingedly connecting short rails 164 to cross rail 162A. Short rails 164 can then be rotated upward around respective hinges attached to front cross rail 162A and downward so that they end up in retracted positions largely between cross rails 162A and 162B as viewed from above frame 100.

Regardless of how short rails 164 are respectively flexibly connected to front cross rail 162A, locking members hold short rails 164 in place when they are in their extended and retracted positions. When short rails 164 are locked in their extended positions, main assembly 116V is suitable for receiving pedal-revolving mechanism 112.

Main assembly 116V further includes a third pair of handles 240L and 240R (collectively "handles 240"), a fourth pair of handles 242L and 242R (collectively "handles 242"), and an optional fifth pair of handles 250L and 250R (collectively "handles 250"). Only one of each pair of handles 240, 242, and 250 appears in FIG. 17.

Third handles 240, referred to here generally as "seat" handles, are indicated in FIG. 17 as being received by seat 102 at generally opposite locations along the side edges of seat 102 near its front edge. Front seat handles 240 are preferably movable relative to seat 102. Alternatively, frame 100 can receive seat handles 240 at corresponding opposite locations below the reception locations indicated in FIG. 17 near the front edge of seat 102. In that case, seat handles 240 are preferably movable relative to frame 100.

Fourth handles 242, referred to here generally as "frame" handles, are indicated in FIG. 17 as being received by frame 100 at generally opposite locations respectively along the longitudinal side edges of long rails 160 roughly halfway along their length. Long rails 160 can alternatively respectively receive frame handles 242 along the top edges of rails 160, again roughly halfway along their length. In either case, frame handles 242 are located longitudinally somewhat beyond the back edge of seat 102. Frame handles 242 are preferably movable relative to frame 100.

Similar to what was said above about handles 108 and 110, handles 240 and 242 can move in various ways. Front seat handles 240 can be respectively turned about a pair of third handle axes whose location is generally indicated by dot 244X in FIG. 17. The third handle axes can be a common third handle axis extending generally parallel to the exercise machine width. Seat handles 240 can be rigidly connected together inside or below seat 102. Handles 240 then turn simultaneously (in synchronism) about the common third handle axis. Alternatively, handles 240 can be respectively turned about the third handle axes independently of each other. The third handle axes can then be inclined or/and slightly laterally offset from each other.

Frame handles 242 can be respectively turned about a pair of fourth handle axes whose location is generally indicated by dot 246X in FIG. 17. The fourth handle axes can be a common fourth handle axis extending generally parallel to the width of the exercise machine. Frame handles 242 can be rigidly connected together so that they turn simultaneously (in synchronism) about the common fourth handle axis. Instead, handles 242 can be respectively turned about the fourth handle axes independently of each other. Accordingly, the fourth handle axes can be inclined or/and slightly laterally offset from each other.

FIG. 17 indicates that fifth handles 250, referred to here generally as "seatback" handles, are received by seatback 104U at generally opposite locations along the side edges of seatback 104U closer to its bottom edge than to its top edge. Lower seatback handles 250 are preferably movable relative to seatback 104U. Depending on the configuration of seatback-to-frame/seat connection mechanism 106U, seatback handles 250 can alternatively be received by connection mechanism 106U at corresponding generally opposite locations close to the reception locations indicated in FIG. 17. In that case, seatback handles 250 are preferably movable relative to connection mechanism 106U.

Analogous to what was said above about upper seatback handles 110, lower seatback handles 250 can move in various ways. Seatback handles 250 can be respectively turned about a pair of fifth handle axes whose location is generally indicated by dot 252X in FIG. 17. The fifth handle axes can be a common fifth handle axis extending generally parallel to the width of the exercise machine. Handles 250 can be rigidly connected together inside or behind seatback 104U. Handles 250 then turn simultaneously (in synchronism) about the common fifth handle axis. Alternatively, handles 250 can be respectively turned about the fifth handle axes independently of each other. The fifth handle axes can then be inclined or/and slightly laterally offset from each other.

Figure 18A:
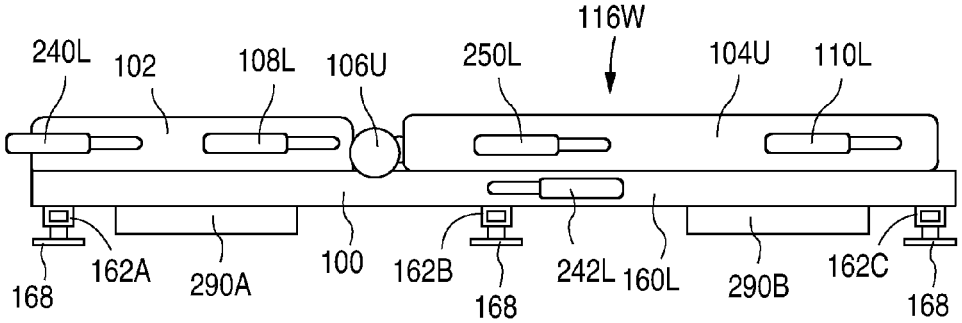
FIGS. 18*a* and 18*b* are side views of a variation of the multi-function exercise bench of FIG. 17 in which the main assembly is provided with legs.
Figure 18B:
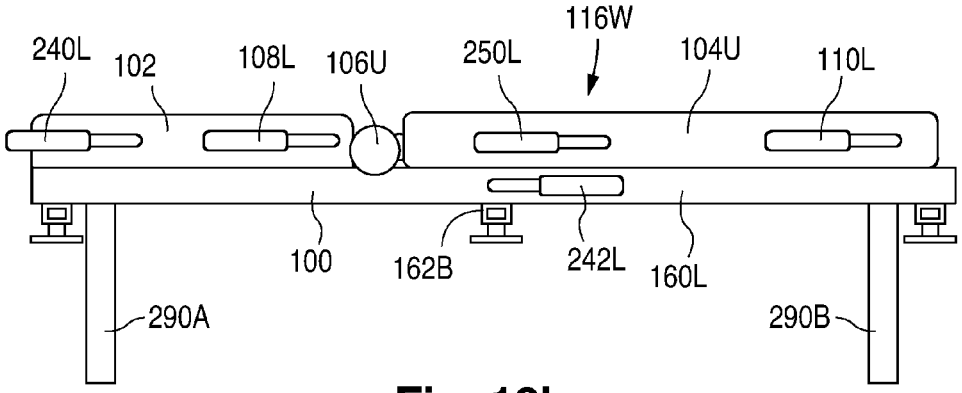

FIGS. 18*a* and 18*b* (collectively "FIG. 18") illustrate a variation 116W, as disclosed in U.S. patent application Ser. No. 11/508,424, of exercise bench 116V and thus another variation of main assembly 116. As with main assembly 116V, main assembly 116W can be substituted for main assembly 116 in any of the exercise machines of U.S. application Ser. No. 11/508,424. Additionally, main assembly 116W is especially suitable for use as an exercise bench whose upper surface is in the vicinity of 30-50 cm above the surface on which assembly 116W is situated.

Main assembly 116W consists of frame 100, seat 102, seatback 104U, connection mechanism 106U, and handles 108, 110, 240, 242, and 250 respectively configured, interconnected, and operable as in main assembly 116V subject to connection of frame 100 to a set of retractable frame legs that enable the top of seat 102 to be roughly 30-50 cm above the underlying surface when the legs are in their extended (or use) positions. FIG. 18 illustrates two such retractable frame legs 290A and 290B (collectively "legs 290"). Each of frame legs 290 is shaped generally like a "U" with a generally straight cross member connecting the two side members of the "U". The two side members of leg 290A are respectively flexibly connected, typically by hinges (not shown), to the bottoms of long rails 160 near front cross rail 162A. The two side members of leg 290B are respectively flexibly connected, likewise typically by hinges (also not shown), to the bottoms of long rails 160 near back cross rail 162C.

FIG. 18*a* depicts how main assembly 116W appears when frame legs 290 are in their retracted (or non-use) positions so that the two side members of each of legs 290 respectively lie against, or nearly against, long rails 160. Frame feet 168 extend further downward than legs 290 when they are in their retracted positions. Legs 290 are switched to their extended positions by rotating them approximately 90° downward away from middle cross rail 162B. FIG. 18*b* depicts how assembly 116W appears when legs 290 are in their extended positions so that the two side members of each of legs 290 extend downward approximately perpendicular to long rails 160. The bottoms of the cross members of legs 290 may be configured to inhibit legs 290 from slipping on the underlying surface. Locking members (not shown) hold legs 290 in place when they are in their retracted and extended positions.

When main assembly 116V or 116W serves as an exercise bench, a user can utilize exercise bench 116V or 116W in performing various exercises. More particularly, the user can utilize handles 108, 110, 240, 242, and 250 to do various exercises in which the user's hands respectively grip handles 108, 110, 240, 242, or 250. Seatback 104U can be in the inclined or flat position. When seatback 104U is in the inclined position, the user can be seated on bench 116V or 116W with the user's back lying against seatback 104U so that the user's abdominal muscles are exercised by swiveling seatback 104U about swivel axis 122. One or more of the pairs of handles 108, 110, 240, 242, and 250 may also be readily removed from bench 116V or 116W to facilitate doing exercises which do not involve those particular handles 108, 110, 240, 242, or/and 250.

Figure 19A:
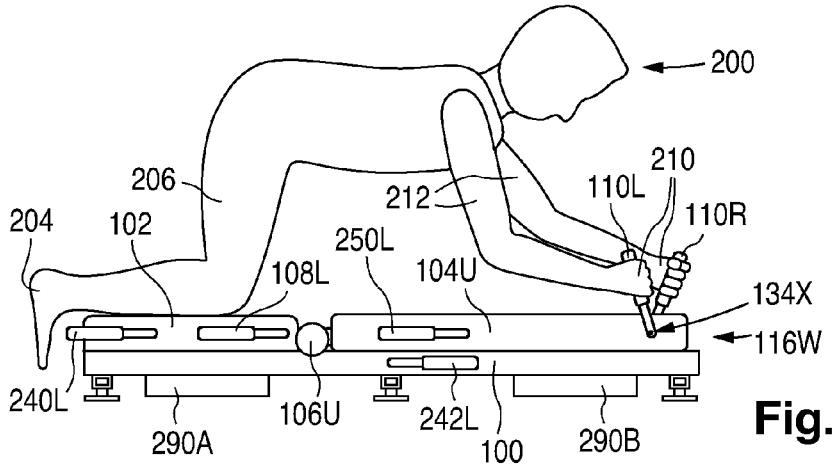
FIGS. 19*a*-19*c* are side views of three respective examples of how the exercise bench of FIGS. 18*a* and 18*b* is used for exercising with the bench's handles.
Figure 19B:
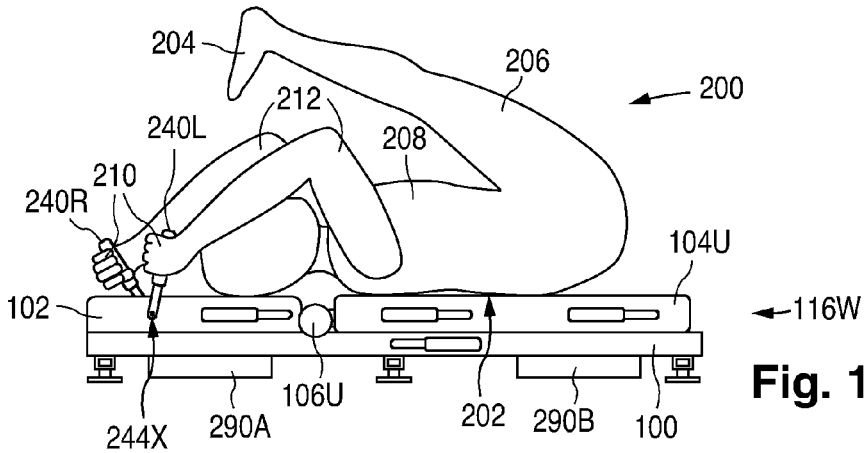
Figure 19C:
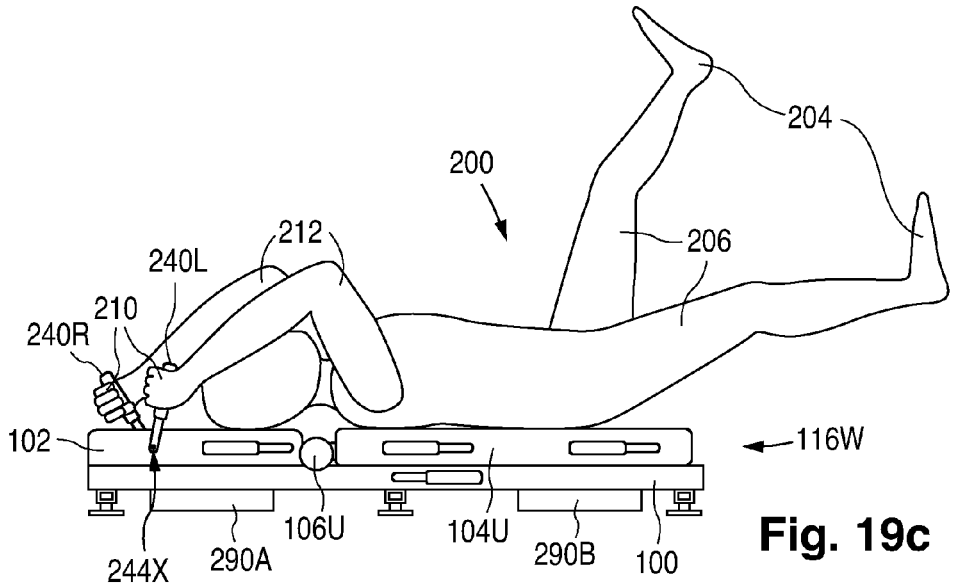

FIGS. 19*a*-19*c* illustrate three examples of exercises performed with exercise bench 116W while seatback 104U is in the flat position and short rails 164 and frame legs 290 are in their respective retracted positions. In the exercise of FIG. 19*a*, user 200 is in a crawl position with the lower parts of user's legs 206 on top of bench 116W. User 200 moves upper seatback handles 110 with user's hands 210 to exercise user's arms 212. The exercise of FIG. 19*b* involves moving front seat handles 240 while user's back 202 is top of bench 116W with user's legs 206 above user's torso 208. The exercise of FIG. 19*c* is the same as that of FIG. 19*b* except that user's legs 206 move back and forth. The exercises of FIGS. 19*b* and 19*c* exercise user's arms 212, user's legs 206, and the user's abdominal muscles. User 200 can perform the exercises of FIGS. 19*a*-19*c*, or exercises similar to those of FIGS. 19*a*-19*c*, by gripping others of handles 108, 110, 240, 242, and 250 than those gripped in FIGS. 19*a*-19*c* and/or with the user's body oriented opposite to what is shown in FIGS. 19*a*-19*c*.

Figure 20A:
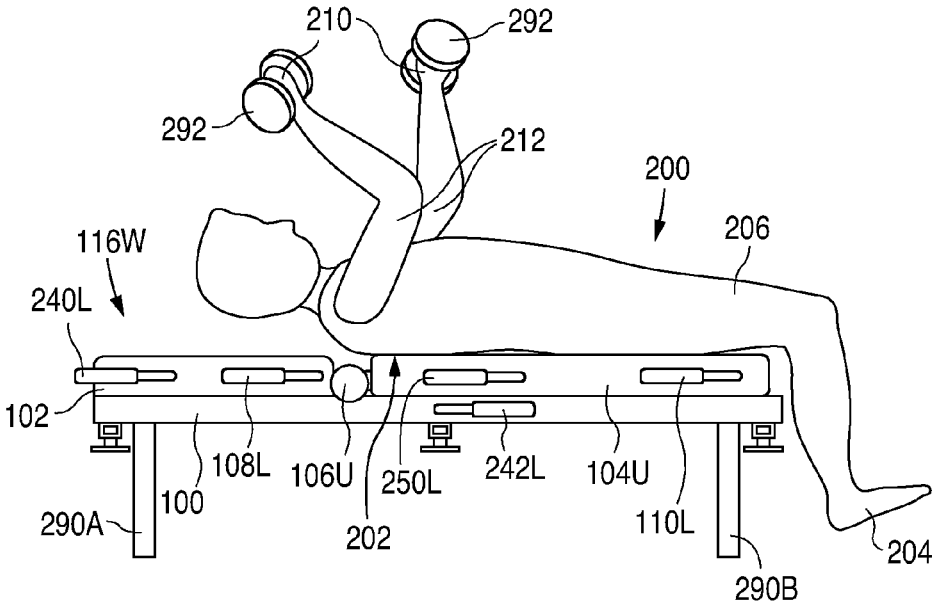
FIGS. 20*a* and 20*b* are side views of two respective examples of how the exercise bench of FIGS. 18*a* and 18*b* is used for exercising with free weights.
Figure 20B:
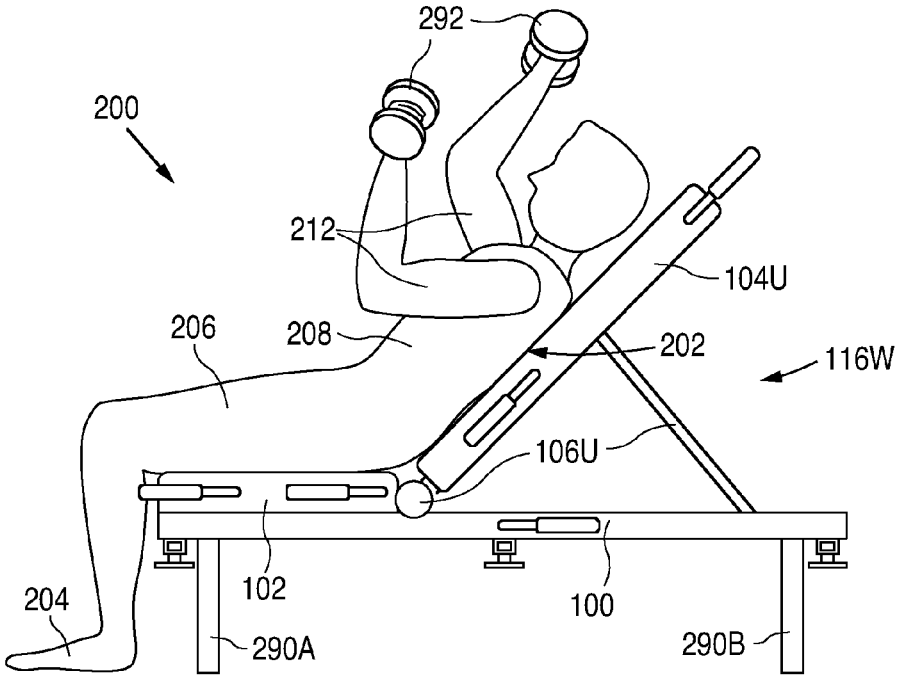

A user can also utilize exercise bench 116V or 116W to do exercises that do not involve moving any of handles 108, 110, 240, 242, and 250. FIGS. 20*a* and 20*b* examples of such exercises performed with exercise bench 116W while short rails 164 are in their retracted positions and frame legs 290 are in their extended positions. In the exercise of FIG. 20*a*, user's back 202 is on top of bench 116W while seatback 104U is in the flat position. In the exercise of FIG. 20*b*, seatback 104U is in the inclined position with user 200 seated on bench 116W so that user's back 202 lies against seatback 104U. User's hands 210 move free weights 292 of the dumbbell type in both exercises to exercise user's arms 212.

Exercise Machines in Accordance with Invention

A. General Considerations

The remaining drawings illustrate exercise machines, including components of those machines, in accordance with the invention. The exercise machines of the invention are particularly suitable for use in homes and other places where exercising space is typically limited.

Components and other items of the exercise machines of the invention are, for simplicity in explanation, respectively identified here with the reference symbols respectively used for substantially corresponding components and other items in the exercise machines of U.S. patent application Ser. No. 11/508,424. New features and other new items in the exercise machines of the invention are identified with new reference symbols.

Only seat handles 108 and upper seatback handles 110 are depicted in the drawings as being present on the exercise machines of the invention. However, each of the exercise machines of the invention may have one or more pairs of seat handles 240, frame handles 242, and lower seatback handles 250.

B. Exercise Machine with Retractable Legs

Figure 21:
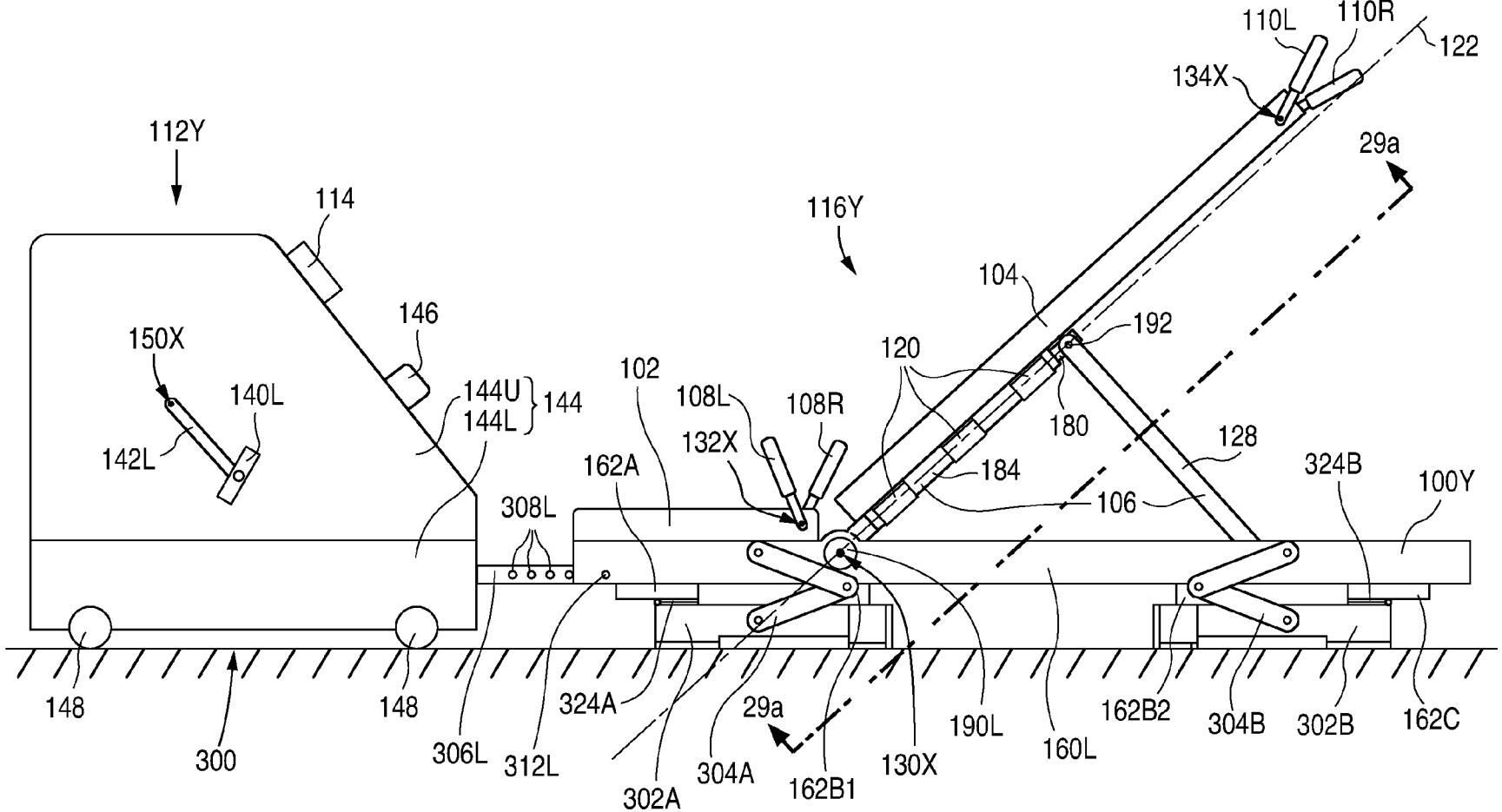
FIG. 21 is a side view of a multi-function exercise machine in accordance with the invention for exercising various muscles, including the legs and abdominal muscles, of a user. The exercise machine of FIG. 21 is depicted in the cycling configuration.

With the foregoing in mind, FIG. 21 illustrates a multi-function exercise machine configured in accordance with the invention for enabling a user to exercise various muscles, including the user's legs and abdominal muscles. The exercise machine of FIG. 21 is situated on an underlying surface 300 such as a floor, including one covered with a rug or other floor covering.

The principal components of the exercise machine of FIG. 21 are a frame 100Y, seat 102, seatback 104, seatback-to-frame/seat connection mechanism 106, seat handles 108, seatback handles 110, a pedal-revolving pedaling mechanism 112Y, visual readout display 114, a retractable front frame leg 302A, a retractable back frame leg 302B, two front frame-leg locking struts 304A, and two back frame-leg locking struts 304B. Frame 100Y, seat 102, seatback 104, connection mechanism 106, handles 108 and 110, frame legs 302A and 302B (collectively "frame legs 302"), and frame-leg locking struts 304A and 304B (collectively "locking struts 304") form a main assembly 116Y. Components 100Y, 102, 104, 106, 108, and 110 of main assembly 116Y are respectively configured, interconnected, and operable substantially the same as components 100, 102, 104, 106, 108, and 110 of main assembly 116 in the exercise machine of FIGS. 3-5 subject to the below-described differences, particularly the manner in which pedaling mechanism 112Y is adjustably connected to frame 100Y and the accompanying absence of short rails 164 in frame 100Y.

The exercise machine of FIG. 21 can be arranged in several configurations for doing exercises. FIG. 21 illustrates what is generally referred to here as the cycling configuration because the user can do stationary cycling in a recumbent exercise position. In the cycling configuration, seatback 104 is in its inclined position. That is, seatback 104 is significantly inclined to seat 102 and thus is also significantly inclined to frame 100Y. Frame legs 302 are in retracted positions in which they extend largely horizontal along frame 100Y. Parts of one side of each frame leg 302A or 302B contact the bottom of frame 100Y while parts of the opposite side of that leg 302A or 302B contact underlying surface 300.

A user stationary cycles on the exercise machine of FIG. 21 in substantially the same manner, as shown in FIG. 10, that user 200 stationary cycles on the exercise machine of FIGS. 3-5. Likewise, readout display 114 in the exercise machine of FIG. 21 can be checked for cycling exercise information in substantially the same way that user 200 checks readout display 114 during stationary cycling with the exercise machine of FIGS. 3-5.

Figure 25:
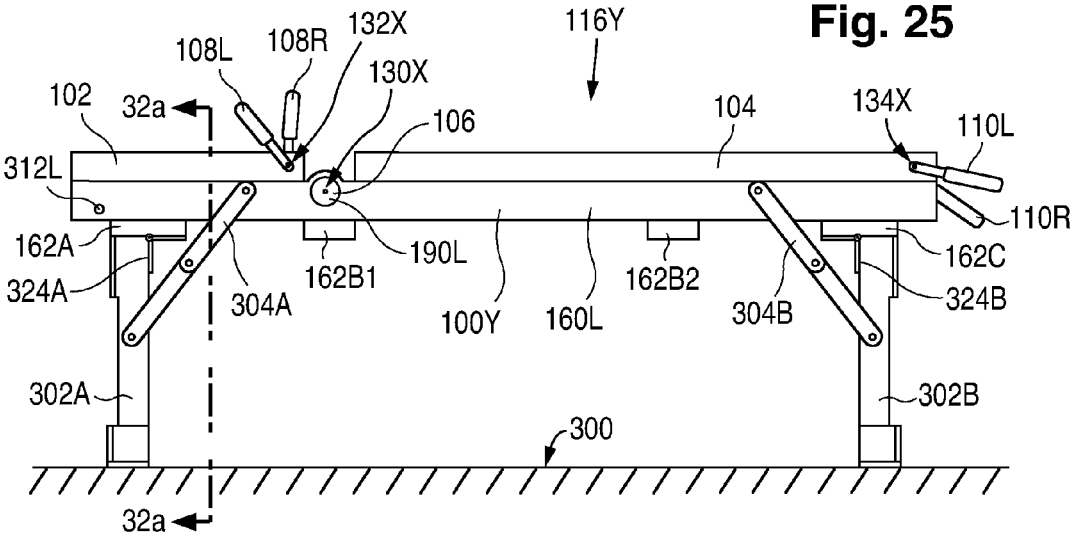
FIG. 25 is a side view of the exercise machine of FIG. 21 as it appears in an exercise-bench configuration with the pedaling mechanism detached and with the frame legs extended downward.

Seatback 104 in the exercise machine of FIG. 21 may lie largely flat against frame 100Y and thus be in the flat position. FIG. 25, discussed below, depicts a configuration of the machine of FIG. 21 in which seatback 104 is in its flat position. In that case, seatback 104 is largely not inclined to seat 102. Hence, the flat position of seatback 104 may alternatively be referred to as its non-inclined position.

Figure 22:
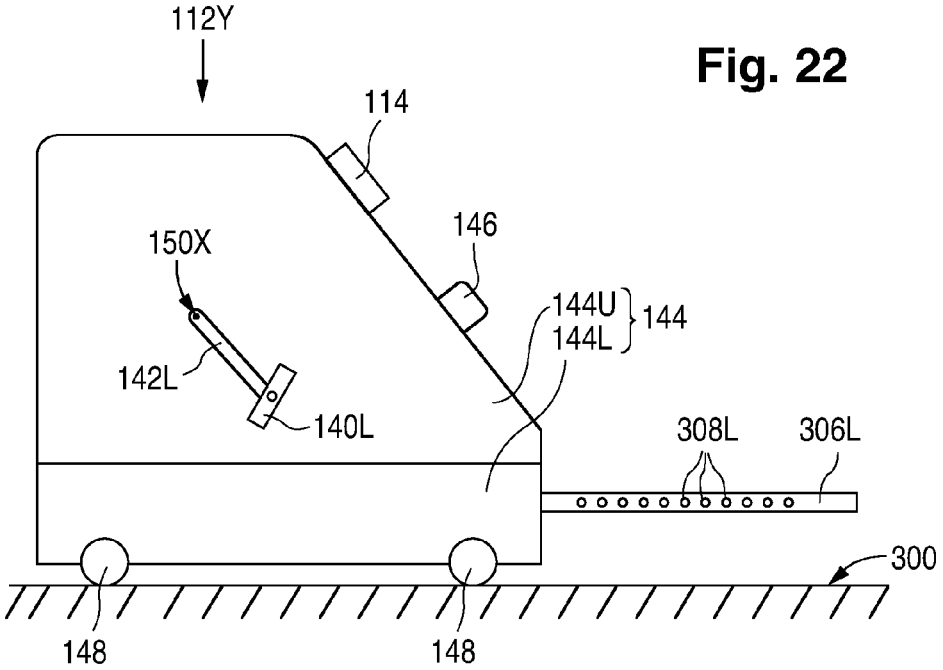
FIGS. 22 and 23 are respective side and top views of the pedal-revolving pedaling mechanism in the exercise machine of FIG. 21.
Figure 23:
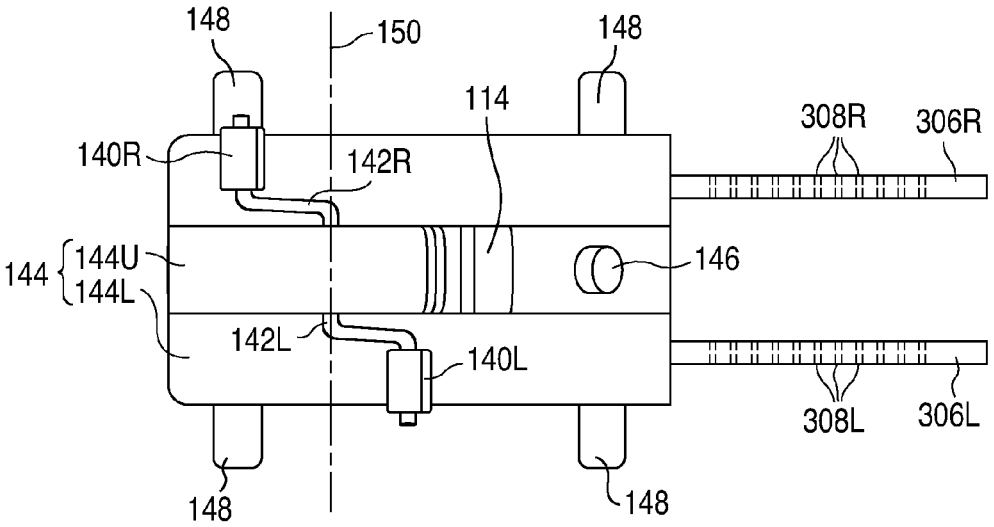

FIGS. 22 and 23 illustrates pedal-revolving pedaling mechanism 112Y as separated from main assembly 116Y. Pedaling mechanism 112Y is formed with foot pedals 140, pedal cranks 142, cycle housing 144, an internal cycling apparatus (not shown) situated inside cycle housing 144, resistance-adjustment knob 146 for adjusting the pedaling resistance, housing feet 148, and a pair of connector rails 306L and 306R (collectively "connector rails 306"). Components 140, 142, 144, 146, and 148 and the internal cycling apparatus in pedaling mechanism 112Y are configured, interconnected, and operable substantially the same as in pedal-revolving pedaling mechanism 112 of the exercise machine of FIGS. 3-5 subject to modification of pedaling mechanism 112Y to include connector rails 306 in place of channels that receive short rails 164 in the exercise machine of FIGS. 3-5. Cycle housing 144 again consists of high upper portion 144U and wider lower portion 144L. As in pedaling mechanism 112, readout display 114 is mounted on the slanted back surface of upper housing portion 144U.

Pedaling mechanism 112Y is adjustably connected to the front end of main assembly 116Y, specifically the front end of frame 100Y, to accommodate the user's size, primarily the length of the user's legs, via connector rails 306 provided at the back end of lower housing portion 144L. For making this adjustable connection, a plurality of horizontal circular connector openings 308L situated generally in a line extend through connector rail 306L. A like plurality of horizontal circular connector openings 308R situated generally in a line extend through connector rail 306R. Connector openings 308R are respectively situated substantially directly opposite connector openings 308L so that connector openings 308L and 308R (collectively "connector openings 308") are allocated into pairs of corresponding oppositely situated connector openings 308. The lines of connector openings 308 extend generally longitudinally along connector rails 306.

Figure 24:
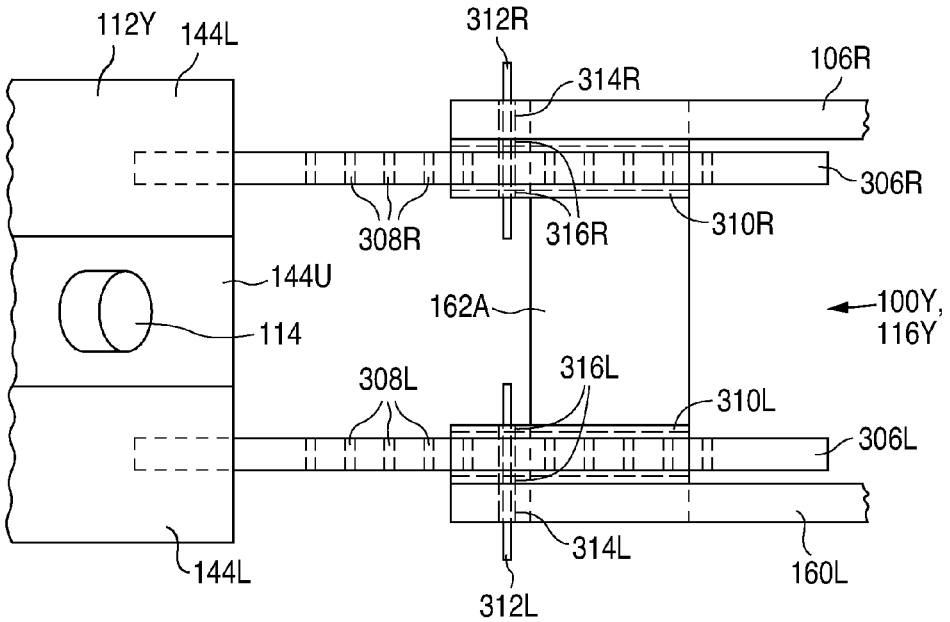
FIG. 24 is an expanded partial top view of the exercise machine of FIG. 21.

FIG. 24 illustrates how pedaling mechanism 112Y is adjustably connected to main assembly 116Y. Hidden features in FIG. 24 are indicated in dashed line. Connector rails 306L and 306R respectively extend into a pair of straight pedaling-mechanism-reception channels portions 310L and 310R (collectively "channel portions 310") at the front end of frame 100Y. Each of pedaling-mechanism-reception channel portions 310 has a pair of sidewalls between which part of the corresponding one of connector rails 306 is inserted. Channel portions 310 are described further below in connection with FIGS. 26-28.

Connector rail 306L is connected to frame 100Y via a circular cylindrical connector pin 312L inserted through a horizontal circular pin opening 314L in the left side of frame 100Y near its front end, through a horizontal circular pin opening 316L in the left sidewall of pedaling-mechanism-reception channel portion 310L, through a selected one of connector openings 308L in rail 306L, and then through a horizontal circular pin opening 316L in the right sidewall of channel portion 310L. Connector rail 306R is similarly connected to frame 100Y via a circular cylindrical connector pin 312R inserted through a horizontal circular pin opening 314R in the right side of frame 100Y near its front end, through a horizontal circular pin opening 316R in the right sidewall of pedaling-mechanism-reception channel portion 310R, through the corresponding one of connector openings 308R in rail 306R, and then through a horizontal circular opening 316R in the left sidewall of channel portion 310R. Connector pins 312L and 312R (collectively "connector pins 312") normally have respective locking mechanisms (not shown) that prevent connector pins 312 from sliding out of connector openings 308, pin openings 314L and 314R (collectively "pin openings 314"), and pin openings 316L and 316R (collectively "pin openings 316"). The distance between pedaling mechanism 112Y and main assembly 116Y is adjusted by appropriately selecting the pair of openings 308 into which connector pins 312 are respectively inserted.

In the example of FIGS. 22 and 23, each connector rail 306L or 306R has eleven connector openings 308L or 308R. The spacing between openings 308L or 308R is 1.5-3.5 cm, preferably 2-3 cm, typically 2.5 cm. This enables the distance between main assembly 116Y and pedaling mechanism 112Y to be adjusted by 15-35 cm, preferably 20-30 cm, typically 25 cm. That is, main assembly 116Y and pedaling mechanism 112Y can substantially touch each other or be spaced apart by a distance of up to 15-35 cm, preferably up to 20-30 cm, typically up to 25 cm.

FIG. 25 illustrates how the exercise machine of FIG. 21 appears in one of several exercise-bench configurations. In the exercise-bench configuration of FIG. 25, frame legs 302 are in extended positions in which they extend downward. As viewed from the side, legs 302 are largely perpendicular to frame 100Y. The bottoms of legs 302 contact underlying surface 300. This exercise-bench configuration is generally referred to here as an extended-leg exercise-bench configuration.

In the exercise-bench configurations, seatback 104 may lie largely flat against frame 100Y or may be significantly inclined to seat 102 and thus to frame 100Y. FIG. 25 specifically presents an exercise-bench configuration in which seatback 104 lies largely flat against frame 100Y. Although pedaling mechanism 112Y is connected to main assembly 116Y in some of the later-described versions of the exercise machines of the invention when they are used in exercise-bench configurations, pedaling mechanism 112Y is typically separated from main assembly 116Y when the exercise machine of FIG. 21 is used in an exercise-bench configuration. Hence, the exercise bench of FIG. 25 is formed with main assembly 116Y.

The terms "exercise-bench configuration" and "cycling configuration" are somewhat arbitrary. In general, "cycling configuration" means the configuration of the exercise machine of FIGS. 21 and 25 in which pedaling mechanism 112Y is connected to main assembly 116Y with frame legs 302 retracted so that main assembly 116Y is close to underlying surface 300 and with seatback 104 at a significant incline to seat 102 so that the user can conveniently stationary cycle on the exercise machine. All other configurations of the machine of FIGS. 21 and 25 generally constitute "exercise-bench configurations".

Main assembly 116Y can, nonetheless, be used as an exercise bench when the machine of FIGS. 21 and 25 is in the cycling configuration. Also, stationary cycling can (with some difficulty) be done on the machine of FIGS. 21 and 25 when it is in the exercise-bench configuration in which seatback 104 is largely flat against frame 100Y provided, of course, that pedaling mechanism 112Y is connected to main assembly 116Y. These comments about exercise-bench and cycling configurations generally apply to the below-described variations of the exercise machine of FIGS. 21 and 25 in which main assembly 116Y and frame legs 302 are present.

A user can employ main assembly 116Y in the exercise machine of FIGS. 21 and 25 as an exercise bench for doing exercises in basically the same ways, described above, that a user can employ main assembly 116V or 116W as an exercise bench. In this regard, additional handles 240, 242, and 250 may be present on main assembly 116Y to increase the number of exercises that can be done when it serves as an exercise bench. Upon substituting main assembly 116Y in FIG. 25 for main assembly 116W in FIGS. 19*a*-19*c*, these three figures illustrate examples of exercises that can be variously done with handles 108, 110, 240, 242, and 250 when main assembly 116Y is used as an exercise bench. Upon similarly substituting main assembly 116Y in FIG. 25 for main assembly 116W in FIGS. 20*a* and 20*b*, these two additional figures illustrate examples of how user 200 can exercise with free weights 292 in utilizing main assembly 116Y as an exercise bench.

Figure 26:
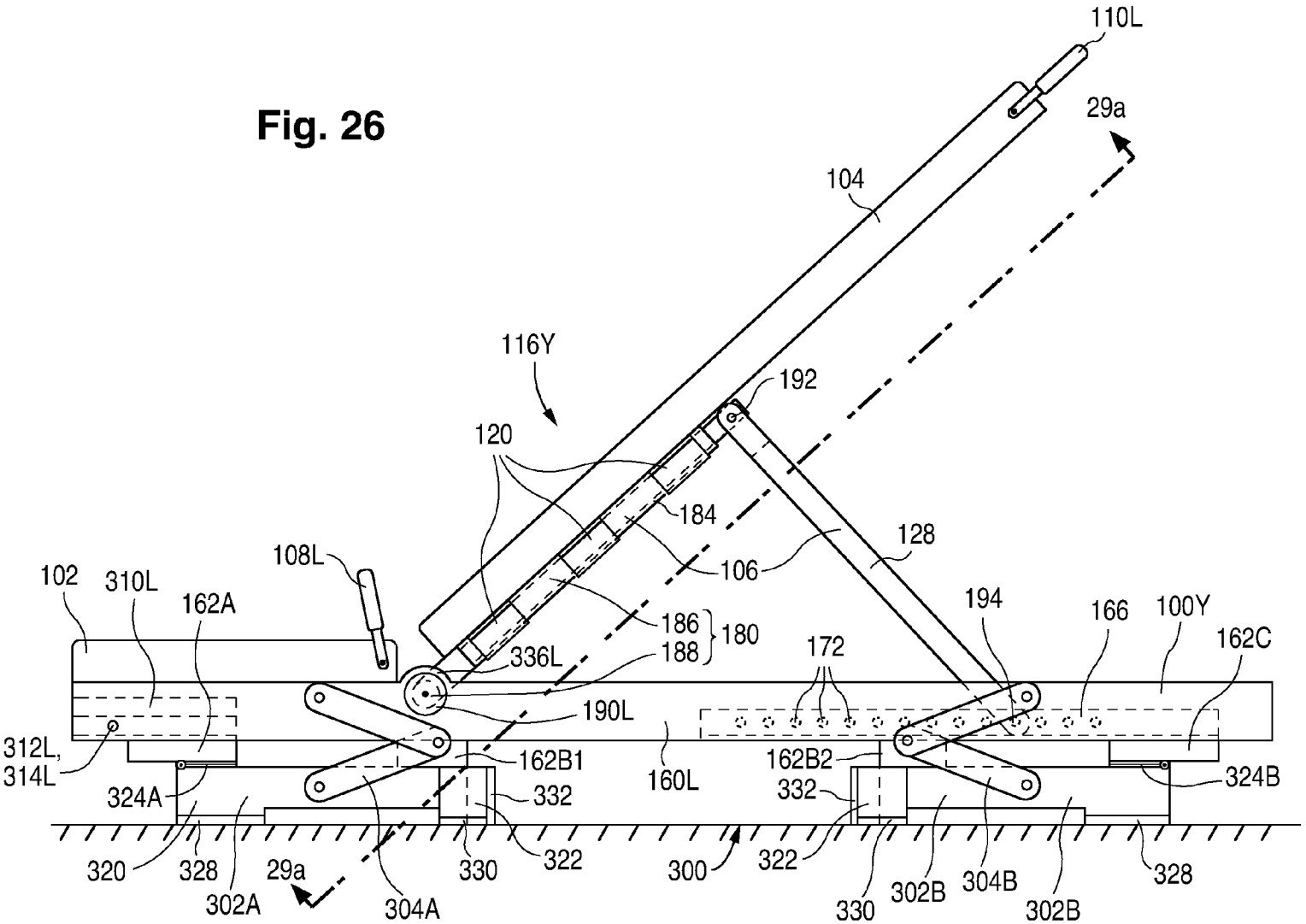
FIGS. 26 and 27 are expanded side views of the main assembly of the exercise machine of FIGS. 21 and 25 as it appears in conditions respectively suitable for the cycling and extended-leg exercise-bench configurations with hidden features indicated in dashed line.
Figure 27:
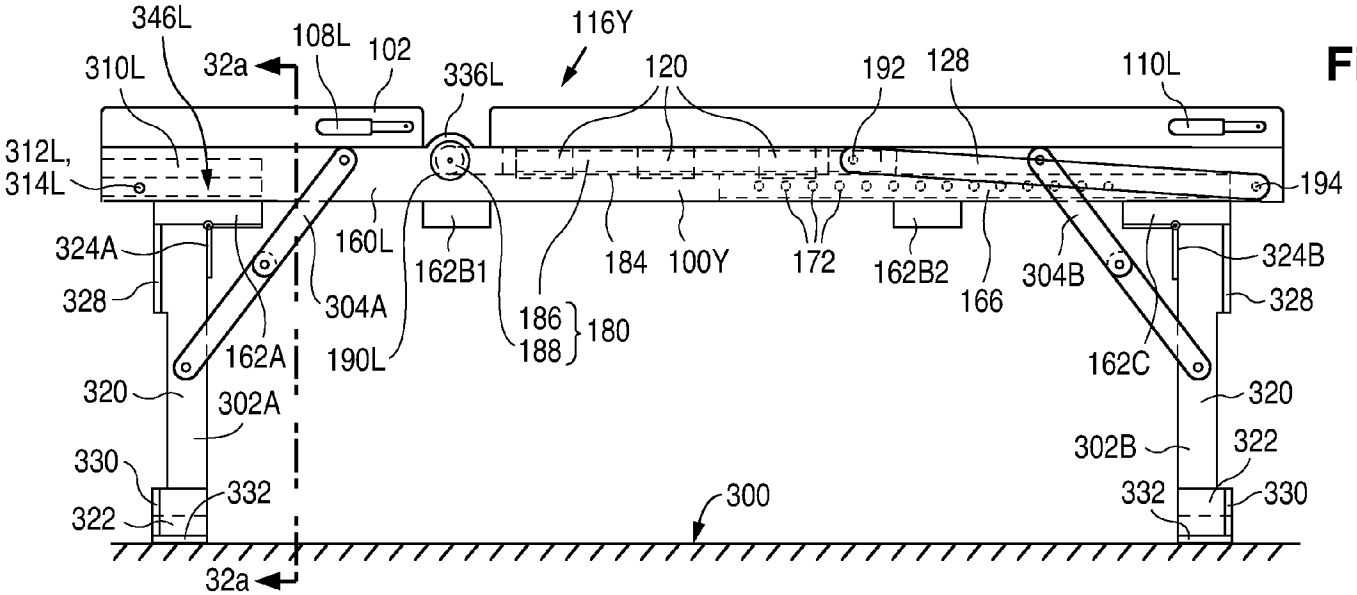

FIGS. 26 and 27 illustrate main assembly 116Y of the exercise machine of FIGS. 21 and 25 as it appears in conditions respectively suitable for the cycling configuration and an extended-leg exercise-bench configuration with hidden features indicated in dashed line. Unlike the exercise machines described in U.S. patent application Ser. No.

11/508,424, the exercise machine of FIGS. 21 and 25 does not have any frame feet analogous to frame feet 168 in the exercise machine of FIGS. 3-5. Instead, frame legs 302 are configured to perform the function of frame feet when the exercise machine of FIGS. 21 and 25 is in the cycling configuration.

FIG. 26 depicts frame legs 302 in their retracted positions with seatback 104 in its inclined position as occurs when the exercise machine of FIGS. 21 and 25 is the cycling configuration. FIG. 27 depicts legs 302 in their extended positions as occurs in some of the exercise-bench configurations. In switching between the main-assembly configurations of FIGS. 26 and 27, legs 302 thus switch between their retracted and extended positions. Frame 100Y is further away from underlying surface 300 when legs 302 are in their extended positions than when legs 302 are in their retracted positions.

Frame legs 302 are typically substantially identical. Each frame leg 302A or 302B consists of a pair of elongated side members 320 and a cross member 322. Only one side member 320 of each leg 302A or 302B and one end of its cross member 322 is visible in FIGS. 26 and 27. The structure of legs 302 is further illustrated in FIGS. 32*a*-32*c* discussed below.

Side members 320 of each frame leg 302A or 302B respectively lie generally below long rails 160. One end of each side member 320 of front leg 302A is flexibly connected to front cross rail 162A of frame 100Y via a hinge 324A. One end of each side member 320 of back leg 302B is similarly flexibly connected to back cross rail 162C of frame 100Y via a hinge 324B. The other ends of side members 320 of each leg 302A or 302B are connected to that leg's cross member 322. Each side member 320 of each leg 302A or 303B has a retracted-position pad 328. Cross member 322 of each leg 302A or 302B has a pair of retracted-position pads 330 and a pair of extended-position pads 332.

When frame legs 302 are in their retracted positions, the surface area of retracted-position pads 328 and 330 normally substantially contacts underlying surface 300. The surface area of extended-position pads 332 normally substantially contacts surface 300 when legs 302 are in their extended positions. In other words, each leg 302A or 302B has (a) retracted-position surface area, provided by that leg's retracted-position pads 328 and 330, which normally substantially contacts surface 300 when legs 302 are in their retracted positions and (b) extended-position surface area, provided by that leg's extended position pads 332, which normally substantially contacts surface 300 when legs 302 are in their extended positions.

Frame legs 302 are further flexibly connected to frame 100Y via frame-leg locking struts 304 in order to lock legs 302 in their extended positions after they are placed in their extended positions. Each locking strut 304A or 304B consists of an elongated upper strut member and an elongated lower strut member flexibly connected together through a center pin joint. The upper strut member of one of each pair of struts 304A or 304B is flexibly connected to long rail 160L through an upper pin joint. The upper strut member of the other of each pair of struts 304A or 304B is similarly flexibly connected to long rail 160R through an upper pin joint. The lower members of front struts 304A are respectively flexibly connected to side members 320 of front leg 302A through respective lower pin joints. The lower members of back struts 304B are similarly respectively flexibly connected to side members 320 of back leg 302B through respective lower pin joints.

Locking struts 304 are in compressed positions, as shown in FIGS. 21 and 26, when frame legs 302 are in their retracted positions. Struts 304 go into extended positions, as depicted in FIGS. 25 and 27, when legs 302 go into their extended positions. Locking mechanisms (not shown) are provided on struts 304 to lock them in their extended positions after being placed in their extended positions. As a result, legs 302 are prevented from unintentionally returning to their retracted positions until the locking mechanisms on struts 304 are released. The locking mechanisms may also lock struts 304 in their compressed positions after being placed there.

As in the exercise machine of FIGS. 3-5, support rod 128 of seatback-to-frame/seat connection mechanism 106 in the exercise machine of FIGS. 21 and 25 is adjustably connected to support-rod channel portion 166 of frame 100Y via frame-associated pin 194 which passes through an opening in the frame-associated end of support rod 128 and through a selected pair of oppositely situated openings 172 in channel portion 166. This connection is indicated in dashed line in FIG. 26. Channel portion 166 of frame 100Y is further illustrated in FIG. 28 discussed below. The incline of seatback 104 to seat 102 is adjusted by changing the pair of oppositely situated openings 172 through which pin 194 is connected to the frame-associated end of support rod 128.

Taking note of how the seatback-to-seat incline is controlled, the exercise machine of FIGS. 21 and 25 is changed from the cycling configuration of FIGS. 21 and 26 in which seatback 104 is in an inclined position to an extended-leg exercise-bench configuration such as that of FIGS. 25 and 27 in the following way. Pedaling mechanism 112Y is disconnected from main assembly 116Y by first removing connector pins 312 from connector rails 306 and channel portions 310 of frame 100Y. Connector rails 306 are then removed from channel portions 310 to separate pedaling mechanism 112Y from main assembly 116Y.

The bottoms of frame legs 302 are pushed longitudinally outward until legs 302 reach their extended positions and locking struts 304 reach their extended positions. The locking mechanisms on struts 304 are actuated to lock struts 304 in their extended positions. Extended-position pads 332 now substantially contact underlying surface 300. If seatback 104 is to lie largely flat against frame 100Y in the extended-leg exercise-bench configuration, frame-associated pin 194 is removed from support rod 128 and channel portion 166. The frame-associated end of support rod 128 is moved backward until seatback 104 reaches its flat or non-inclined position. All of these activities are done by one or more persons such as the user of the machine of FIGS. 21 and 25.

Largely the opposite is done in changing from an extended-leg exercise-bench configuration to the cycling configuration of FIGS. 21 and 26. The locking mechanisms on locking struts 304 are released. The bottoms of frame legs 302 are pushed longitudinally inward until legs 302 reach their retracted positions and struts 304 reach their compressed positions. This causes retracted-position pads 328 and 330 to substantially contact underlying surface 300. In some situations, retracted-position pads 328 of frame leg 302A or 302B may contact surface 300 while one or both of retracted-position pads 330 of that leg 302A or 302B do not substantially contact surface 300, and vice versa.

Connector rails 306 are respectively inserted into channel portions 310. Connector pins 312 are inserted into connector rails 306 and channel portions 310 to connect pedaling mechanism 112Y to main assembly 116Y. If seatback 104 is lying largely flat against frame 100Y, the frame-associated end of support rod 128 is moved to the location of a selected pair of oppositely situated openings 172 in channel portion 166 to select a suitable seatback-to-seat incline. Frame-associated pin 194 is inserted through the selected pair of openings 172 and through the opening in the frame-associated end of support rod 128 to fixedly place seatback 104 at the selected incline. All of these activities can likewise be done by one or more persons such as the exercise-machine user.

Figure 28:
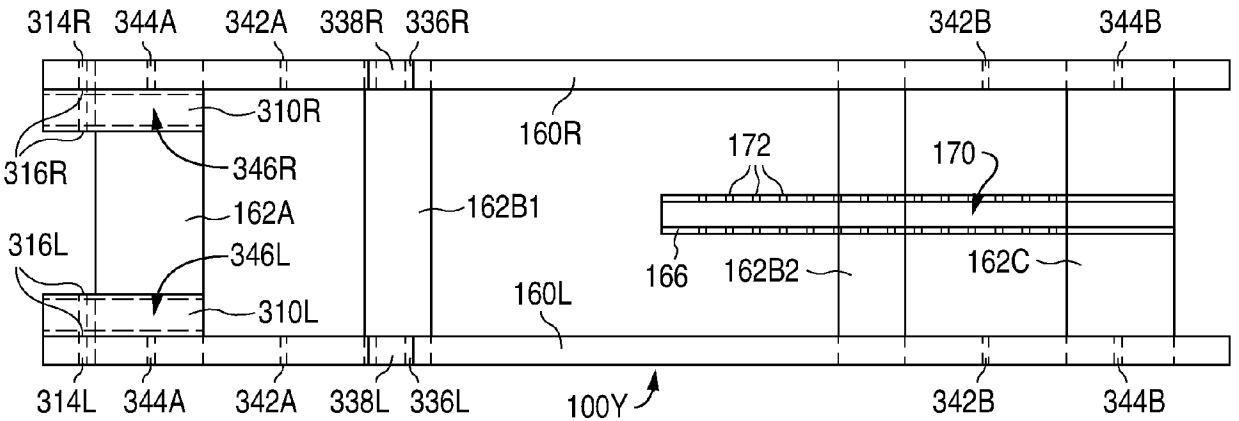
FIG. 28 is an expanded top view of the frame in the exercise machine of FIGS. 21 and 25 with hidden features indicated in dashed line.

FIG. 28 depicts frame 100Y of main assembly 116Y with hidden features similarly indicated in dashed line. Frame 100Y consists of long rails 160L and 160R (again collectively "long rails 160"), four straight cross rails 162A, 162B1, 162B2, and 162C (similarly collectively "cross rails 162"), support-rod channel portion 166, and pedaling-mechanism-reception channel portions 310. Intermediate cross rails 162B1 and 162B2 in frame 100Y replace middle cross rail 162B in frame 100 of the exercise machine of FIGS. 3-5. When frame legs 302A and 302B are in their retracted positions, they respectively contact intermediate cross rails 162B1 and 162B2 along the leg sides opposite the sides having retracted-position pads 328 and 330. See FIG. 26.

Referring to FIGS. 26-28, long rails 160L and 160R in frame 100Y respectively have slightly elevated portions 336L and 336R. In place of cross-bar sleeves 182L and 182R in the exercise machine of FIGS. 3-5, horizontal circular openings 338L and 338R respectively extend through long rails 160L and 160R generally at the locations of elevated rail portions 336L and 336R as indicated in FIG. 28. Support-rod channel portion 166 of frame 100Y is mounted on back cross rail 162C and back-most intermediate cross rail 162B2 rather than on back cross rail 162C and middle cross rail 162B as occurs in frame 100 of the exercise machine of FIGS. 3-5. Aside from these differences, long rails 160, cross rails 162, and support-rod channel portion 166 in frame 100Y are respectively configured, interconnected, and operable substantially the same as components 160, 162, and 166 in frame 100 of the exercise machine of FIGS. 3-5.

Items 342A in FIG. 28 indicate a pair of horizontal circular openings respectively through long rails 160 for pin joints of the upper members of front locking struts 304A. Items 342B similarly indicate a pair of horizontal circular openings respectively through long rails 160 for pins joints of the upper members of back locking struts 304B. Items 344A and 344B respectively indicate the locations of the pin pivots of hinges 324A and 324B.

As indicated in FIGS. 26-28, pedaling-mechanism-reception channel portions 310 extend over front cross rail 162A and between long rails 160. In particular, each channel portion 310L or 310R is fixedly connected to front cross rail 162A or/and corresponding long rail 160L or 160R. Consequently, pin openings 314L and 314R in frame 100Y respectively extend through long rails 160L and 160R. Each channel portion 310L or 310R has a rectangular cylindrical channel 346L or 346R into which corresponding connector rail 306L or 306R is inserted in connecting pedaling mechanism 112Y to frame 100Y.

Frame 100Y is of the following dimensions. Long rails 160 are 105-120 cm, typically 112 cm, in length. The width (or thickness) of rails 160 is 2-3 cm, typically 2.5 cm. Rails 160 are 4-6 cm, typically 5 cm, in height. Cross rails 162 are 25-30 cm, typically 28 cm, in length. The width of front/back cross rails 162A and 162C is 8-12 cm, typically 10 cm. The width of intermediate cross rails 162B1 and 162B2 is 5-7 cm, typically 6 cm. The height (or thickness) of intermediate cross rails 162B1 and 162B2 is 2-3 cm, typically 2.5 cm. Front/back cross rails 162A and 162C are of a height equal to that of intermediate cross rails 162B1 and 162B2 minus the total thickness of the two flanges of hinge 324A or 324B.

The spacing between long rails 160 is 20-25 cm, typically 23 cm. The distance from front cross rail 162A to the front ends of long rails 160 is 2-3 cm. The distance from back cross rail 162C to the back ends of long rails 160 is likewise 2-3 cm. The distance between intermediate cross rails 162B1 and 162B2 is 30-40 cm, typically 35 cm, with intermediate rails 162B1 and 162B2 being approximately equidistant respectively from front/back cross rails 162A and 162C.

Pedaling-mechanism-reception channel portions 310 are 12-18 cm, typically 15 cm, in length. The height of channel 346L or 346R in channel portion 310L or 310R is 1.5-2.0 cm, typically 1.7 cm. The width (or thickness) of each channel 346L or 346R is 2.5-3.0 cm, typically 2.8 cm. Support-rod channel portion 166 is 40-55 cm, typically 48 cm, in length. The width of channel 170 in channel portion 166 is 2-3 cm, typically 2.5 cm. There are 10-20 pairs, typically 16 pairs, of openings 172 in the side members of channel portion 166 at a longitudinal opening-to-opening spacing of 2-3 cm, typically 2.5 cm.

FIGS. 29*a*-29*c* illustrate how the seatback-adjoining portion of seatback-to-frame/seat connection mechanism 106 is configured relative to seatback 104 for the exercise machine of FIGS. 21 and 25. In addition to attachment brackets 120 and support rod 128 (not shown in FIGS. 29*a*-29*c*), connection mechanism 106 here includes T-shaped bar portion 180 and axial sleeve 184. T-shaped bar portion 180 is again formed with axial bar 186, cross bar 188, and cross-bar end caps 190L and 190R. Instead of extending through cross-bar sleeves 182L and 182R as occurs in the exercise machine of FIGS. 3-5, equal-length portions 188L and 188R of cross bar 188 respectively extend through openings 338L and 338R in long rails 160L and 160R. Cross bar 188 can thereby turn in openings 338L and 338R so as to turn about connection axis 130.

FIG. 29*a* depicts the bottom edge of seatback 104 in the exercise machine of FIGS. 21 and 25 as being generally straight. Similar to how FIGS. 5, 7, and 8 illustrate the bottom edge of seatback 104 in the exercise machine of FIGS. 3-5 as being of generally convex curvature, the bottom seatback edge in the machine of FIGS. 21 and 25 can be curved in a generally convex manner, especially if such curving is needed to avoid having the bottom seatback edge contact frame 100Y in such a manner as to interfere with swiveling of seatback 104 about swivel axis 122. The bottom edge of seatback 104 in the machine of FIGS. 21 and 25 can also be shaped in other ways to facilitate seatback swivel.

The configuration of T-shaped bar portion 180 in the exercise machine of FIGS. 21 and 25 is illustrated in FIGS. 30*a* and 30*b*. Axial bar 186 of T-shaped bar portion 180 here consists of a circular cylindrical cross-bar-meeting section 350, a circular cylindrical intermediate section 352, and a terminating section 354. Intermediate axial-bar section 352 is situated largely within axial sleeve 184 as depicted in FIGS. 29*a*-29*c*. The inside diameter of axial sleeve 184 is sufficiently greater than the diameter of intermediate axial-bar section 352 that it can readily rotate in axial sleeve 184. With seatback 104 being fixedly connected to axial sleeve 184, seatback 104 can again swivel about axial bar 186 and therefore about swivel axis 122. See FIG. 29*b* in which swivel axis 122 appears. As in the exercise machine of FIGS. 3-5, one or more rings of ball bearings may here be situated between axial bar 186 and axial sleeve 184 to make it easier for sleeve 184 to turn about bar 186.

Returning to FIGS. 30*a* and 30*b*, cross-bar-meeting section 350 merges into cross bar 188. The diameter of cross-bar-meeting section 350 is slightly greater than the inside diameter of axial sleeve 184. Consequently, axial sleeve 184 cannot slide (downward) onto cross-bar-meeting section 350. This prevents seatback 104 from getting so close to frame 100Y and/or seat 102 as to inhibit seatback 104 from swiveling about swivel axis 122.

Axial-bar terminating section 354 forms the remote end of axial bar 186, i.e., the end spaced apart from cross bar 188. Terminating section 354 is longitudinally of relatively flat shape and has a horizontal circular pin-receiving opening 356. The maximum lateral dimension of terminating section 354 is less than the inside diameter of axial sleeve 184 so that axial sleeve 184 can be slid over terminating section 354 and intermediate axial-bar section 352 down to cross-bar-meeting section 350 in assembling seatback-to-frame/seat connection mechanism 106.

FIGS. 31*a* and 31*b* illustrate the configuration of support rod 128 in seatback-to-frame/seat connection mechanism 106 for the exercise machine of FIGS. 21 and 25. Letting the two ends of support rod 128 again be respectively referred to as the seatback-associated end and the frame-associated end, the seatback-associated end of support rod 128 splits into a pair of tines 358 through which a pair of oppositely situated horizontal circular openings 360 respectively extend. With axial-bar terminating section 354 placed between tines 358, support rod 128 is flexibly connected to axial bar 186 via seatback-associated pin 192 (see FIGS. 26 and 27) that passes through openings 356 and 360 respectively in terminating section 354 and tines 358. A horizontal circular opening 362 extends through the frame-associated end of rod 128 for enabling it to be flexibly and adjustably connected to support-rod channel portion 166 via pin 194 (again see FIGS. 26 and 27) that passes through opening 362 and a selected pair of oppositely situated openings 172 in channel portion 166.

Subject to the preceding structural differences between seatback-to-frame/seat connection mechanism 106 in the exercise machine of FIGS. 21 and 25 and connection mechanism 106 in the exercise machine of FIGS. 3-5, components 120, 128, 180, and 184 are configured, interconnected, and operable substantially the same in the machine of FIGS. 21 and 25 as in the machine of FIGS. 3-5. Importantly, seatback 104 in the machine of FIGS. 21 and 25 can freely swivel about swivel axis 122 in the manner indicated by arrows 196 in FIGS. 3 and 9 for the machine of FIGS. 3-5.

Consistent with the dimensions given above for frame 100Y, components 102, 104, and 106 of main assembly 116Y are of the following dimensions. Seat 102 is 28-32 cm, typically 30 cm, in length and width. Seatback 104 is 65-80 cm, typically 75 cm, in length. The width of seatback 104 is approximately the same as the width of seat 102, namely 28-32 cm, typically 30 cm. Seat 102 and seatback 104 are of approximately the same thickness, 2-6 cm, typically 4 cm.

Seat 102 preferably has a metal back plate of largely the seat's length/width dimensions. Seatback 104 likewise preferably has a metal back plate of largely the seatback's length/width dimensions. In addition to providing seat 102 and (especially) seatback 104 with sufficient rigidity to generally maintain their shapes, the back plates provide structures for receiving seat handles 108 and 240, seatback handles 110 and 242, and attachment brackets 120.

As to seatback-to-frame/seat connection mechanism 106, axial sleeve 184 is 25-35 cm, typically 30 cm, in length. The inside diameter of axial sleeve 184 is 2.0-2.5 cm, typically 2.2 cm. Axial bar 186 is 35-45 cm, typically 40 cm, in length. Cross-bar-meeting section 350 of axial bar 186 has a diameter of 2.0-2.5 cm, typically 2.2 cm. The length of cross-bar-meeting section 350 is 3-5 cm, typically 4 cm. Intermediate axial-bar section 352 has a diameter of 1.6-2.2 cm, typically 1.9 cm. The length of terminating section 354 of axial bar 186 is 3-5 cm, typically 4 cm. Support rod 128 is 35-45 cm, typically 40 cm, in length.

FIGS. 32*a*-32*c* illustrate one of substantially identical frame legs 302. As indicated above, each frame leg 302A or 302B is formed with two elongated side members 320 and one associated cross member 322. Each side member 320 consists of a main portion 364 and one retracted-position pad 328. Main portion 364 of each side member 320 has two opposite ends which respectively form that side member's opposite ends. Each cross member 322 is formed with a main portion 366, two retracted-position pads 330, and two extended-position pads 332. Main portion 366 of each cross member 322 likewise has two opposite ends which respectively form that cross member's opposite ends.

Main portions 364 of side members 320 of each frame leg 302A or 302B are fixedly connected to main portion 366 of that leg's cross member 322 at the side-member ends opposite the side-member ends flexibly (hingedly) connected to frame 100Y. In the example of FIGS. 32*a*-32*c*, the connection locations are at intermediate positions along each cross member 322, preferably equidistant from its ends. Retracted-position pad 328 of each side member 320 is provided on its main portion 364 adjacent to the side-member end connected to frame 100Y. Main portion 364 of each side member 320 is recessed adjacent to its retracted-position pad 328 to keep that main portion 364 away from underlying surface 300 when its retracted-position pad 328 contacts surface 300.

Two retracted-position pads 330 are provided on each frame leg's cross-bar main portion 366 adjacent to its ends so as to face in the same direction as retracted-position pads 328 on that leg's side-member main portion 364. Each cross-bar main portion 366 is recessed between those retracted-position pads 330 to keep that main portion 366 away from underlying surface 300 when those retracted-position pads 330 contact surface 300. Two extended-position pads 332 are provided on each leg's cross-bar main portion 366 adjacent to its ends so as to face in a significantly different direction than that leg's retracted-position pads 328 and 330. Extended-position pads 332 of each leg 302A or 302B are typically substantially perpendicular to that leg's retracted-position pads 328 and 330. Main portion 366 of each cross member 322 is also recessed between that cross member's extended-position pads 332 to keep that main portion 366 away from underlying surface 300 when those extended-position pads 332 contact surface 300.

Consistent with the dimensions given above for components 102, 104, and 106 of main assembly 116Y, frame legs 302 are of the following dimensions. Side-member main portions 364 are 20-25 cm, typically 23 cm, in length. Cross-bar main portions 366 are 40-50 cm, typically 45 cm, in length. The thickness of retracted-position pads 328 and 330 and extended-position pads 332 is 0.5-0.75 cm, typically 0.6 cm. The dimension of each cross-bar main portion 366 in the facing direction of its retracted-position pads 328 and 330 is 4-5 cm, typically 4.5 cm.

In light of the preceding dimensions, switching frame legs 302 from their retracted positions to their extended positions causes main assembly 116Y to be elevated by 20-30 cm, typically 24 cm. Also, the top of seat 102 is 35-45 cm, typically 40 cm, above underlying surface 300 when legs 302 are in their extended positions.

C. Exercise Machine with Tillable Pedaling Mechanism

Figure 33:
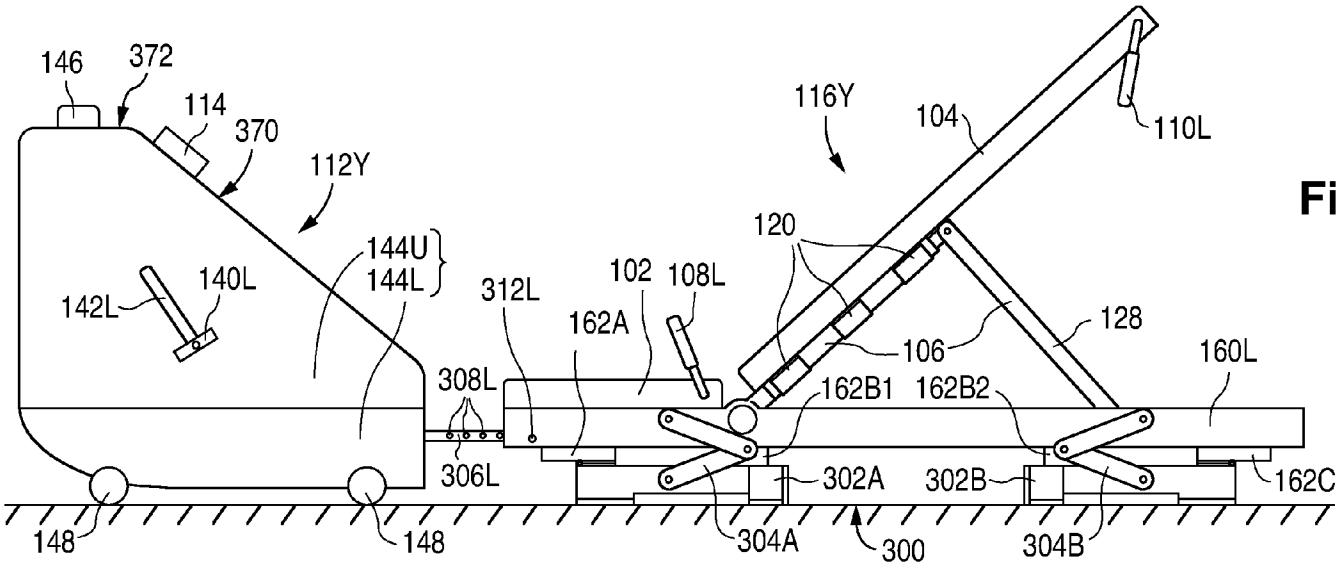
FIGS. 33, 34*a*, and 34*b* are side views of a variation, in accordance with the invention, of the multi-function exercise machine of FIGS. 21 and 25 in which the pedal-revolving pedaling mechanism is tiltable so as to remain attached to the main assembly in both cycling and exercise-bench configurations. The exercise machine of FIGS. 33, 34*a*, and 34*b* is in the cycling configuration in FIG. 33 and in extended-leg exercise-bench configurations in FIGS. 34*a* and 34*b* with the seatback flat in FIG. 34*a* and inclined in FIG. 34*b*.
Figure 34A:
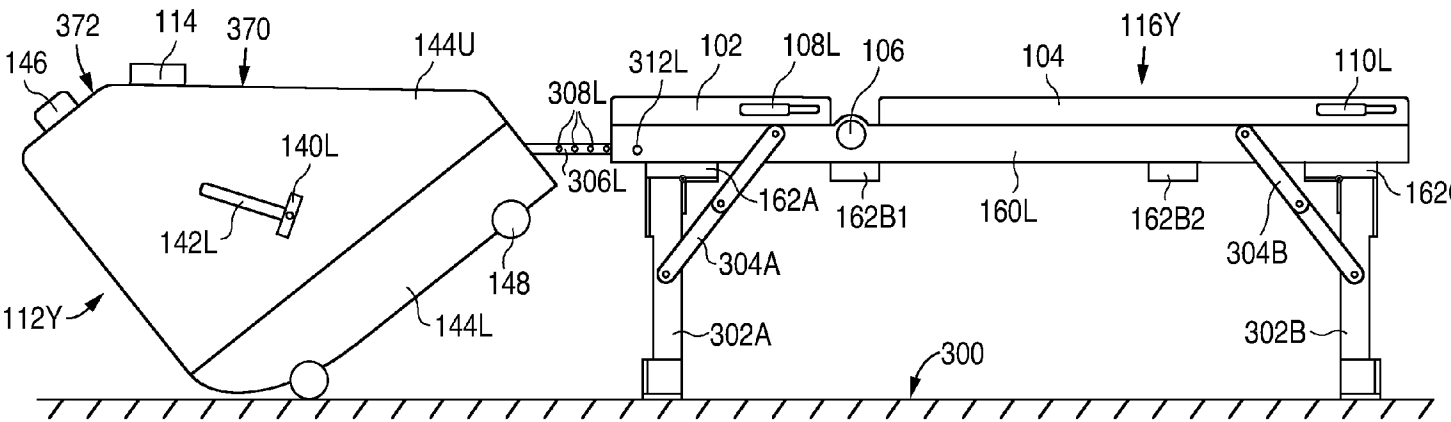
Figure 34B:
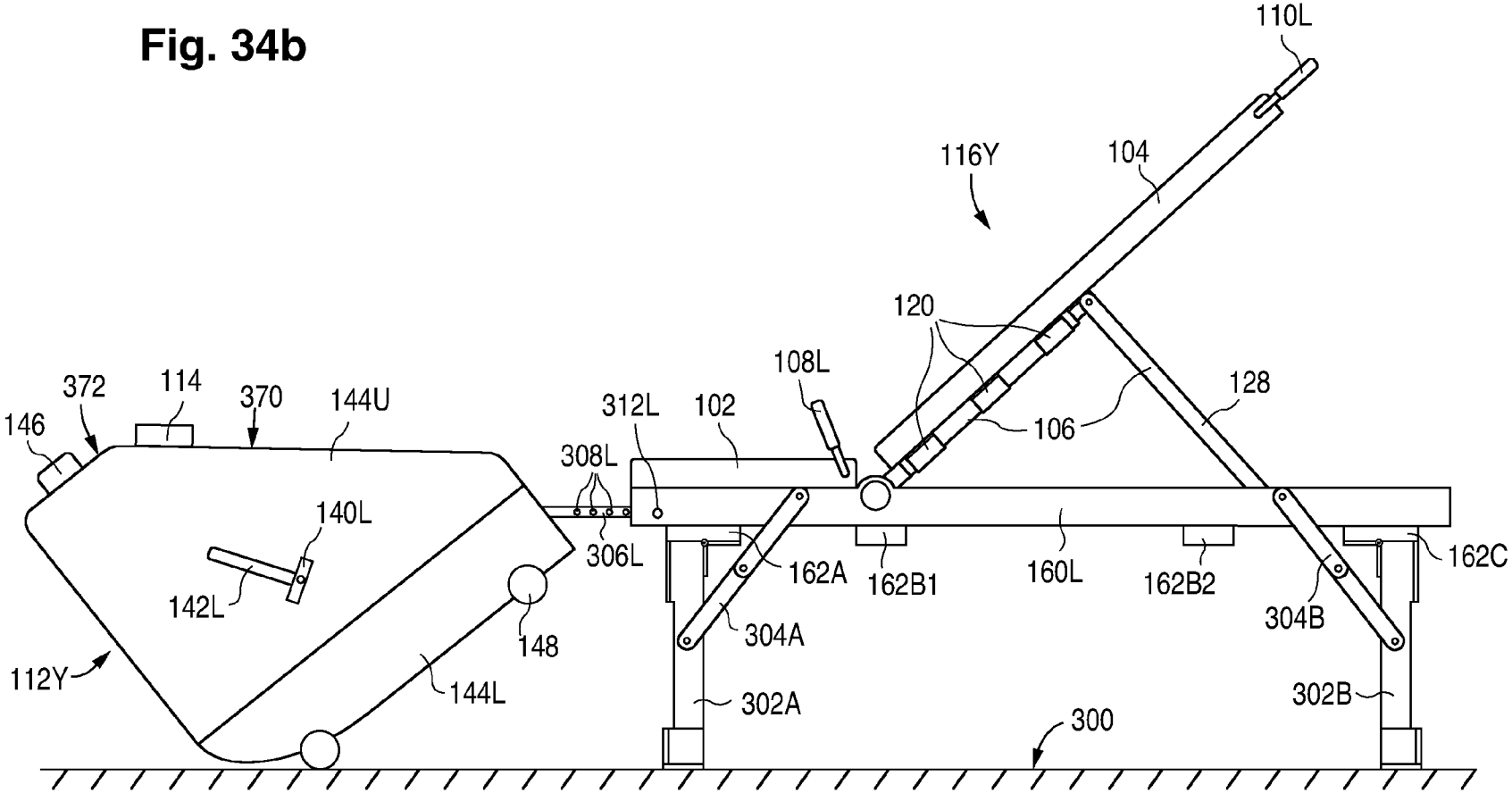

FIG. 33 and FIGS. 34*a* and 34*b* (collectively "FIG. 34") together illustrate a variation, configured in accordance with the invention, of the multi-function exercise machine of FIGS. 21 and 25. In the exercise machine of FIGS. 33 and 34, pedal-revolving pedaling mechanism 112Y can be tilted to contact underlying surface 300 without being disconnected from, and without tilting of, main assembly 116Y. As a result, the machine of FIGS. 33 and 34 can be switched between the cycling configuration and an extended-leg exercise-bench configuration without having to disconnect pedaling mechanism 112Y from main assembly 116Y.

The exercise machine of FIGS. 33 and 34 is depicted in the cycling configuration in FIG. 33 with frame legs 302 in their retracted positions. Pedaling mechanism 112Y of the machine of FIGS. 33 and 34 is not significantly tilted in the cycling configuration. All four of housing feet 148 are substantially in contact with underlying surface 300. Subject to slight changes in the shape of pedaling mechanism 112Y to accommodate its tilting as shown in FIG. 34, the machine of FIGS. 33 and 34 has largely the same appearance in the cycling configuration of FIG. 33 as the exercise machine of FIGS. 21 and 25 has in the cycling configuration of FIG. 21.

The exercise machine of FIGS. 33 and 34 is depicted in two exercise-bench configurations in FIG. 34 with pedaling mechanism 112Y tilted downward so that its two front housing feet 148 contact underlying surface 300 while its two back housing feet 148 are elevated above surface 300. Frame legs 302 in their extended positions in the exercise-bench configurations of FIG. 34. In particular, FIG. 34*a* illustrates how the machine of FIGS. 33 and 34 appears in an extended-leg exercise-bench configuration with seatback 104 lying largely flat against frame 100Y. FIG. 34*b* illustrates how the machine of FIGS. 33 and 34 appears in an extended-leg exercise-bench configuration with seatback 104 significantly inclined to seat 102.

As can be seen by examining FIG. 34, the contour of cycle housing 144 has been changed so that its slanted back surface 370 is approximately coplanar with the top of seat 102 when the exercise machine of FIGS. 33 and 34 is in an extended-leg exercise-bench configuration. Consequently, pedaling mechanism 112Y of the machine of FIGS. 33 and 34 can remain connected to main assembly 116Y during exercising in an extended-leg exercise-bench configuration without significantly interfering with exercises done in that exercise-bench configuration. In other words, the machine of FIGS. 33 and 34 avoids the necessity to connect/disconnect pedaling mechanism 112Y in switching between the cycling configuration and an extended-leg exercise-bench configuration but does not significantly limit exercising that can be done in those exercise-machine configurations.

In the exercise machine of FIGS. 33 and 34, resistance-adjustment knob 146 for adjusting the pedaling resistance has been moved from slanted back surface 370 of cycle housing 144 to its top surface 372 in order to avoid having adjustment knob 146 interfere with exercising in the extended-leg exercise-bench configurations. Readout display 114 of the machine of FIGS. 33 and 34 remains, however, on slanted back surface 370 since moving display 114 to any location other than slanted back surface 370 would make it difficult for a user to see the information on display 114 while exercising in the cycling configuration of FIG. 33. The presence of readout display 114 on slanted back surface 370 should interfere little with exercises done with the machine of FIGS. 33 and 34 while it is in the extended-leg exercise-bench configurations.

The exercise machine of FIGS. 33 and 34 is switched between the cycling configuration and an extended-leg exercise-bench configuration in largely the same manner as the exercise machine of FIGS. 21 and 25 except that pedaling mechanism 112Y normally remains connected to main assembly 116Y. All of the configuration-switching activities are done by one or more persons such as the user of the machine of FIGS. 33 and 34.

More particularly, starting from the cycling configuration of FIG. 33, the bottoms of frame legs 302 are pushed longitudinally outward until legs 302 reach their extended positions and locking struts 304 reach their extended positions. This causes pedaling mechanism 112Y to tilt downward until slanted back surface 370 of cycle housing 144 becomes approximately coplanar with the top of seat 102. As a result, the two back housing feet 148 of pedaling mechanism 112Y are pulled above underlying surface 300 while the two front housing feet of mechanism 112Y remain substantially in contact with surface 300. The locking mechanisms on struts 304 are then actuated to lock struts 304 in their extended positions. Extended-position pads 332 now substantially contact underlying surface 300. The extended-leg exercise-bench configuration of FIG. 34*b* with seatback 104 in its inclined position is thereby achieved.

If the exercise machine of FIGS. 33 and 34 is to go into the extended-leg exercise-bench configuration of FIG. 34*a* in which seatback 104 is in its flat or non-inclined position, frame-associated pin 194 is removed from support rod 128 and channel portion 166. The frame-associated end of support rod 128 is subsequently moved backward until seatback 104 lies largely flat against frame 100Y.

Largely the opposite is done in changing from the extended-leg exercise-bench configuration of FIG. 34*a* or 34*b* to the cycling configuration of FIG. 33. The locking mechanisms on locking struts 304 are released. The bottoms of frame legs 302 are pushed longitudinally inward until legs 302 each their retracted positions and struts 304 reach their compressed positions. Retracted-position pads 328 and 330 thereby substantially contact underlying surface 300. As legs 302 return to their retracted positions, pedaling mechanism 112Y rotates upward until it reaches the normal pedaling-mechanism orientation of FIG. 33. The two back housing feet 148 of pedaling mechanism 112Y come substantially into contact with surface 300.

If the exercise machine of FIGS. 33 and 34 had just been in the extended-leg seatback-flat exercise-bench configuration of FIG. 33*a*, a suitable seatback-to-seat incline is selected by moving the frame-associated end of support rod 128 to the location of a selected pair of oppositely situated openings 172 in channel portion 166. Frame-associated pin 194 is inserted through the selected pair of openings 172 and through the opening in the frame-associated end of support rod 128 to implement the selected seatback-to-seat incline.

Figure 35A:
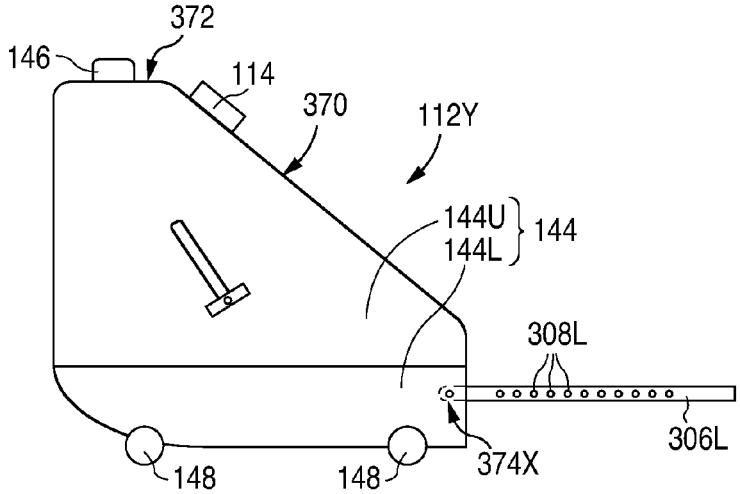
FIGS. 35*a*-35*c* are side views of the tiltable pedal-revolving pedaling mechanism in the exercise machine of FIGS. 33, 34*a*, and 34*b* respectively for the cycling configuration, the exercise-bench configuration, and a configuration in which the mechanism flexibly and adjustably connecting the pedaling mechanism to the frame is rotatably retracted for exercise-machine storage.
Figure 35B:
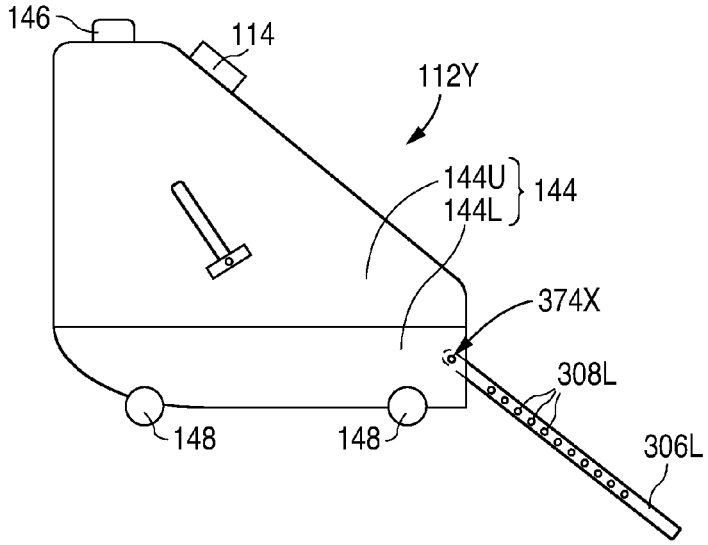

The tilting of pedaling mechanism 112Y is achieved by arranging for connector rails 306 to be capable of being rotated so as to move vertically. An understanding of the vertical rotation capability of connector rails 306 is facilitated with the assistance of FIGS. 35*a*-35*c* which illustrate rails 306 in three different positions relative to the remainder of pedaling mechanism 112Y. Referring to FIG. 35*a*, it depicts how pedaling mechanism 112Y appears when connector rails 306 are connected to main assembly 116Y for using the exercise machine of FIGS. 33 and 34 in the cycling configuration. FIG. 35*b* depicts how pedaling mechanism 112Y appears when rails 306 are connected to main assembly 116Y for using the machine of FIGS. 33 and 34 in an extended-leg exercise-bench configuration.

Connector rails 306 are connected to structure within cycle housing 144, specifically lower housing portion in 144L in the present example, via an arrangement which allows rails 306 to rotate through a suitable angle about a horizontal axis extending substantially perpendicular to the length of the exercise machine of FIGS. 33 and 34. The connector-rail rotation axis extends through lower housing portion 144L close to its back surface. Item 374X in FIGS. 35*a*-35*c* indicates the location of the connector-rail rotation axis. The connector-rail rotation arrangement can, for example, be implemented by providing the structure inside cycle housing 144 with a connector-rail pin that extends that extends along the connector-rail rotation axis. The connector-rail pin extends through respective openings in connector rails 306.

Figure 35C:
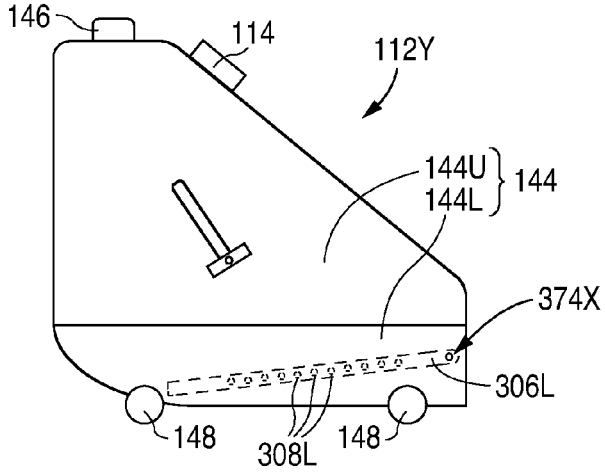

Turning to FIG. 35*c*, cycle housing 144 in pedaling mechanism 112Y can be configured to enable connector rails 306 to be rotated to a location within housing 144, again specifically lower housing portion 144L in the present example, when mechanism 112Y is not connected to main assembly 116Y. This facilitates storage of pedaling mechanism 112Y. In addition, this minimizes the risk of damaging connector rails 306 and avoids having them be a hazard to humans.

D. Exercise Machine with Adjustable-Length Support Rod

Figure 36A:
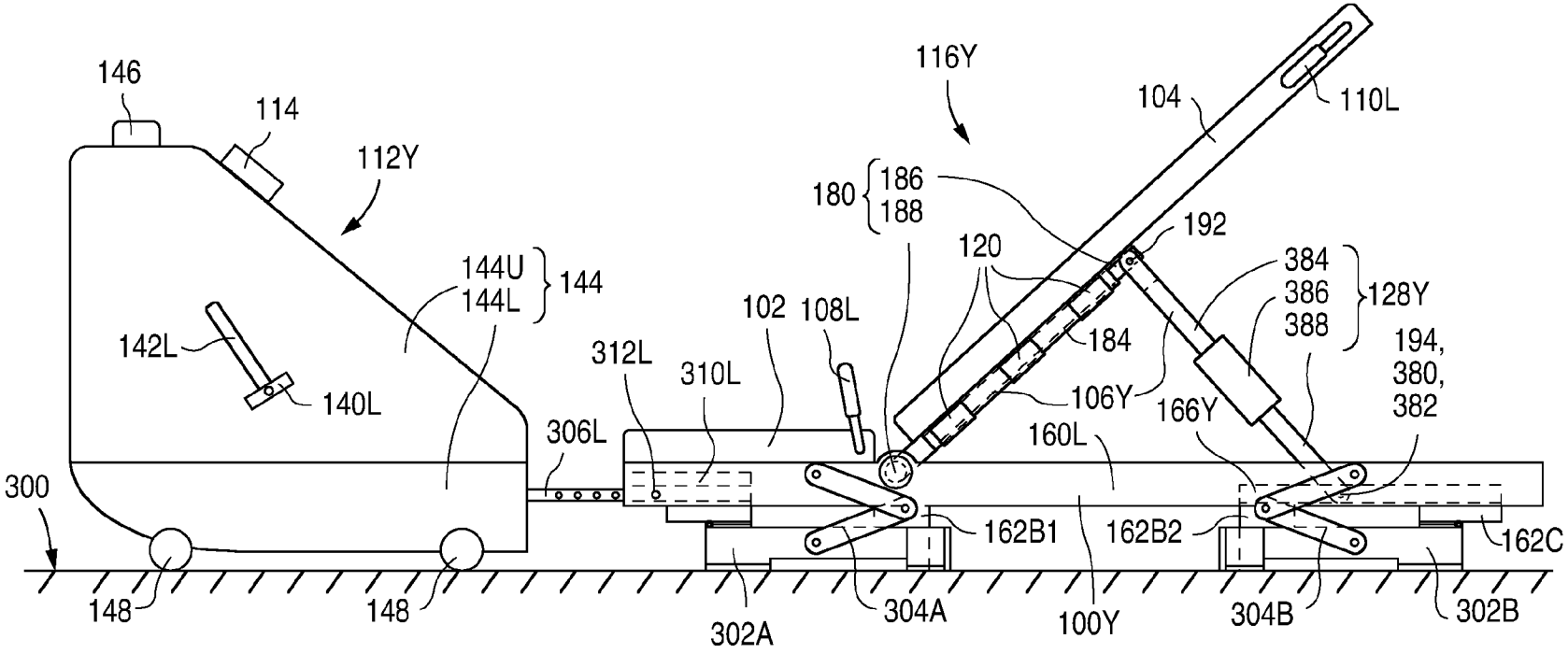
FIGS. 36*a* and 36*b* are side views of a variation, in accordance with the invention, of the multi-function exercise machine of FIGS. 33, 34*a*, and 34*b* in which the support rod of the seatback-to-frame/seat connection mechanism is of adjustable length. The exercise machine of FIGS. 36*a* and 36*b* is in the cycling configuration in FIG. 36*a* and in an extended-leg exercise-bench configuration in FIG. 36*b* with the seatback flat.
Figure 36B:
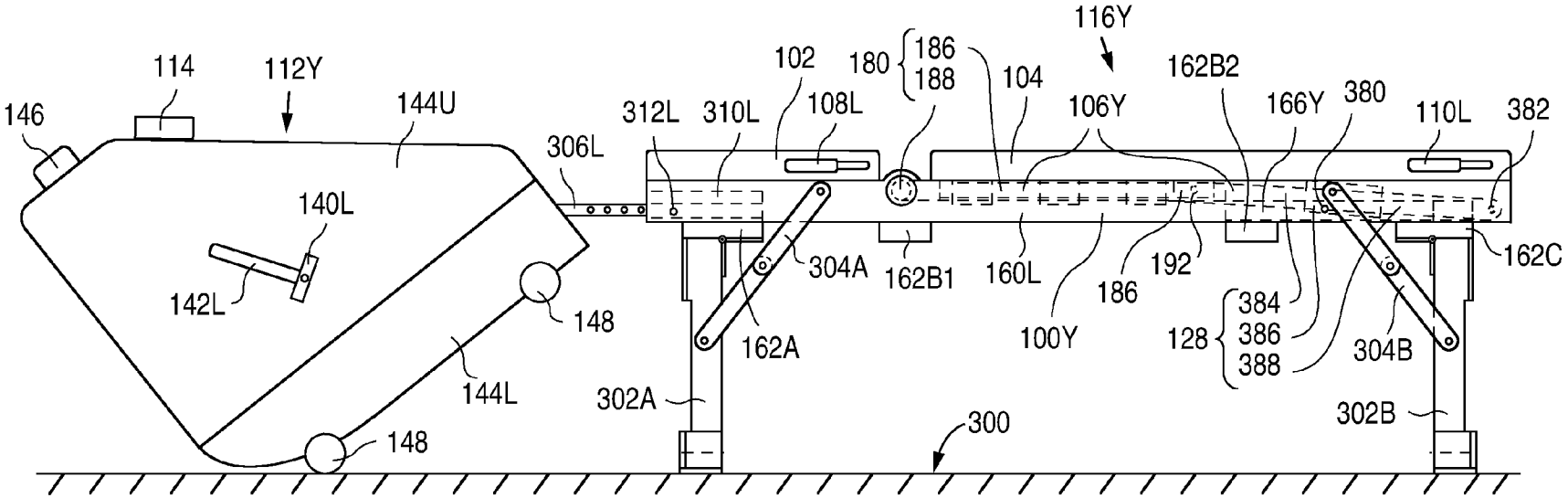

FIGS. 36*a* and 36*b* (collectively "FIG. 36") illustrate a variation, configured in accordance with the invention, of the multi-function exercise machine of FIGS. 33 and 34 in which the incline of seatback 104 to seat 102 is adjusted by adjusting the length of a variation 128Y of support rod 128 of seatback-to-frame/seat connection mechanism 106. The combination of attachment brackets 120, adjustable-length support rod 128Y, T-shaped bar portion 180, and axial sleeve 184 in the exercise machine of FIG. 36 forms a seatback-to-frame/seat connection mechanism 106Y that replaces seatback-to-frame/seat connection mechanism 106 in the machine of FIGS. 33 and 34.

Additionally, support-rod channel portion 166 of frame 100Y is replaced, in the exercise machine of FIG. 36, with a channel portion 166Y typically having a single location at which adjustable-length support rod 128Y is flexibly and removably connected. For an embodiment in which channel portion 166Y is cross-sectionally shaped generally the same as channel portion 166, this connection is typically made with frame-associated pin 194 that passes through a horizontal circular opening 380 in one side of channel portion 166Y, through a horizontal circular opening 382 in support rod 128Y, and through another horizontal circular opening 380 in the other side of channel portion 166Y. Openings 380 in the sides of channel portion 166Y are situated opposite each other. Adjusting the length of support rod 128Y thereby enables the incline of seatback 104 to seat 102 to be varied across a specified angular range. In particular, seatback 104 is at a minimum incline when support rod 128Y is at its minimum length and at a maximum incline when rod 128Y is at its maximum length.

Alternatively, channel portion 166Y may have multiple locations at which adjustable-length support rod 128Y is flexibly and removably connected to provide a greater total angular range for the incline of seatback 104 to seat 102. That is, connection of support rod 128Y to channel portion 166Y at different locations enables the seatback-to-seat incline to be adjusted across different angular ranges by adjusting the length of rod 128Y. The angular ranges for adjusting the seatback-to-seat incline typically overlap or nearly overlap. Each additional location for adjustably connecting support rod 128Y to channel portion 166Y is typically defined by an additional pair of oppositely situated horizontal circular openings 380 in the respective sides of channel portion 106Y. The number of locations for adjustably connecting adjustable-length support rod 128Y to channel portion 166Y is normally considerably less than the number of locations for adjustably connecting fixed-length support rod 128 to channel portion 166.

The exercise machine of FIG. 36 is in a cycling configuration in FIG. 36*a* with seatback 104 at a selected incline to seat 102 as determined by appropriately adjusting the length of support rod 128Y. In FIG. 36*b*, the machine of FIG. 36 is in an extended-leg exercise-bench configuration with seatback 104 lying largely flat against frame 100Y, with pedaling mechanism 112Y connected to main assembly 116Y and tilted downward to contact underlying surface 300 via the two back housing feet 148 of mechanism 112Y, and with its two front housing feet 148 elevated above surface 300. As indicated by dashed line in FIG. 36*b*, support rod 128Y is disconnected from channel portion 166Y in that extended-leg exercise-bench configuration to enable seatback 104 to lie largely flat against frame 100Y.

Support rod 128Y consists of a seatback-associated connection rod 384, a length-adjustment mechanism 386, and a frame-associated connection rod 388. Seatback-associated connection rod 384 has two ends respectively referred to here as the seatback-associated end and the adjustment end. The seatback-associated end of connection rod 384 corresponds to the seatback-associated end of support rod 128 in the exercise machine of FIGS. 21 and 25 and is flexibly connected to axial bar 186 via seatback-associated pin 192 as described above for the machine of FIGS. 21 and 25. That is, pin 192 passes through openings (360 and 356) in the seatback-associated end of connection rod 384 and in axial bar 186 of T-shaped bar portion 180.

Frame-associated connection rod 388 has two ends respectively referred to here as the frame-associated end and the adjustment end. The frame-associated end of connection rod 388 is flexibly and removably connected to channel portion 166Y via frame-associated pin 194 as described above for support rod 128Y. That is, pin 194 passes through openings 380 in channel portion 166Y and through opening 382 in the frame-associated end of connection rod 388.

The adjustment ends of connection rods 384 and 388 are adjustably connected to length-adjustment mechanism 386. Suitably adjusting length-adjustment mechanism 386 causes the total distance (a) from mechanism 386 to the seatback-associated end of connection rod 384 and (b) from mechanism 386 to the frame-associated end of connection rod 388 to be correspondingly adjusted so as to adjust the length of support rod 128Y and thereby adjust the seatback-to-seat incline. For instance, length-adjustment mechanism 386 can be adjusted by a suitable control, such as an adjustment knob, that causes one of connection rods 384 and 388 to slide into or alongside the other so as to adjust the overall support-rod length.

The exercise machine of FIG. 36 is switched between the cycling configuration and an extended-leg exercise-bench configuration in the same way as the exercise machine of FIGS. 33 and 34 except that selection of a suitable seatback-to-seat incline is done by adjusting length-adjustment mechanism 386 of support rod 128Y rather than by using a selected pair of oppositely situated openings 172 in channel portion 166 in the machine of FIGS. 33 and 34. In addition, going from the cycling configuration of FIG. 36*a* to the extended-leg seatback-flat exercise-bench configuration of FIG. 36*b* includes removing frame-associated pin 194 from support rod 128Y and channel portion 166Y after which the frame-associated end of support rod 128Y is moved backward until seatback 104 lies largely flat against frame 100Y. In returning to the cycling configuration of FIG. 36*a*, the frame-associated end of support rod 128Y is moved forward until opening 382 in the frame-associated end of rod 128 is horizontally aligned with openings 380 in channel portion 166Y. Pin 194 is then inserted through openings 380 and 382.

E. Exercise Machine with Leg-Position Control Mechanism

Figure 37A:
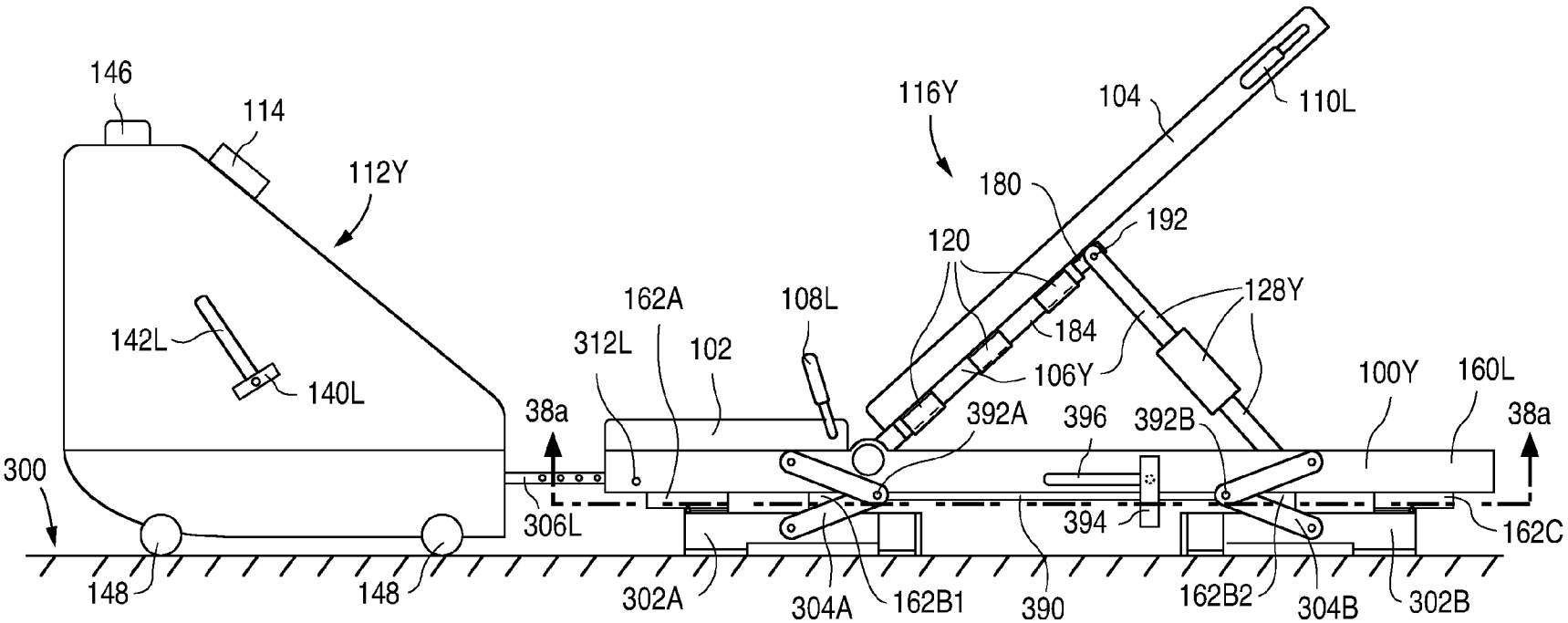
FIGS. 37*a* and 37*b* are side views of a variation, in accordance with the invention, of the multi-function exercise machine of FIGS. 36*a* and 36*b* in which a general leg-position control mechanism is used to rapidly switch the frame legs between their retracted and extended positions. The exercise machine of FIGS. 37*a* and 37*b* is in the cycling configuration in FIG. 37*a* and in an extended-leg exercise-bench configuration in FIG. 37*b* with the seatback flat.
Figure 37B:
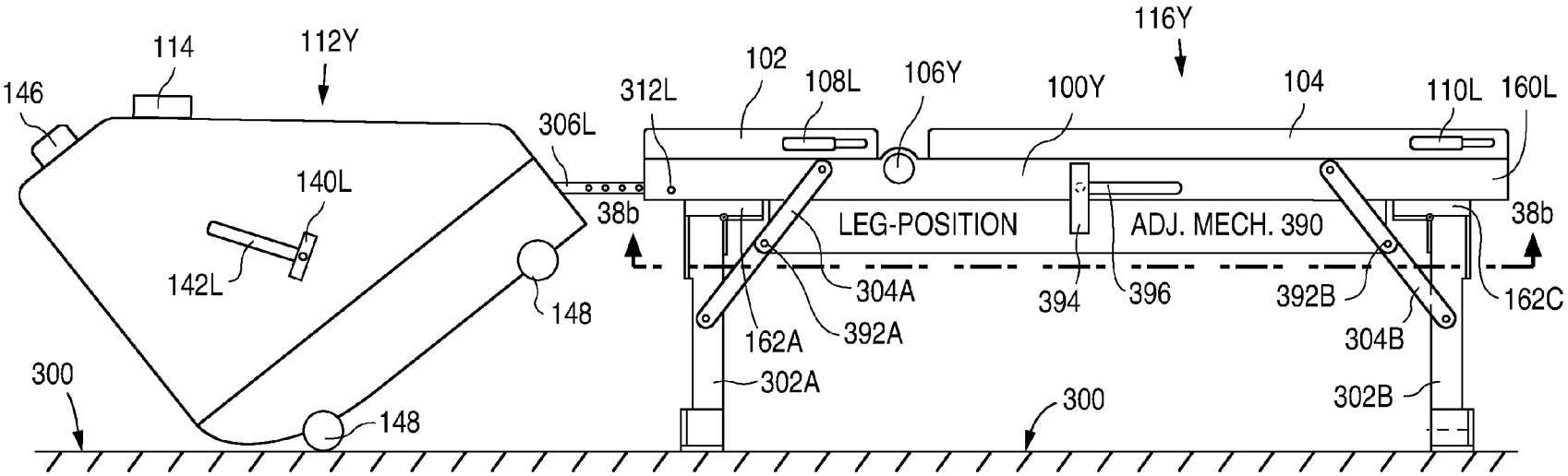

FIGS. 37*a* and 37*b* (collectively "FIG. 37") illustrate a variation, configured in accordance with the invention, of the multi-function exercise machine of FIG. 36 in which a general leg-position control mechanism actuatable by a person, such as the user, is employed to rapidly switch frame legs 302 between their retracted and extended positions. In FIG. 37*a*, legs 302 are in their retracted positions with seatback inclined to seat 102 as arises when the exercise machine of FIG. 37 is in the cycling configuration. In FIG. 37*b*, legs 302 are in their extended positions as arises when the machine of FIG. 37 is in an extended-leg exercise-bench configuration. Seatback 104 is largely flat against frame 100Y in the extended-leg exercise-bench configuration of FIG. 37*b*. Seatback 104 can also be inclined to seat 102 when the exercise machine of FIG. 37 is in an extended-leg exercise-bench configuration.

Much of the leg-position control mechanism is hidden in FIG. 37. The leg-position control mechanism can be better seen in FIGS. 38*a* and 38*b* which depict frame 100Y and the leg-position control mechanism as seen from below the exercise machine of FIG. 37. The bottom views of FIGS. 38*a* and 38*b* (collectively "FIG. 38") illustrate how the leg-position control mechanism appears when the machine of FIG. 37 is respectively in the configurations of FIGS. 37*a* and 37*b*.

With reference to FIGS. 37 and 38, the leg-position control mechanism consists of a leg-position adjustment mechanism 390, a front pin strut 392A, a back pin strut 392B, and a human-controllable device for actuating the leg-position adjustment mechanism 390. Pin struts 392A and 392B (collectively "pin struts 392") extend in the transverse direction, i.e., in the direction of the width of the exercise machine and thus perpendicular to its length. Pin strut 392A constitutes a common pin for the center pin joints of locking struts 304A for front leg 302A. Pin strut 392B similarly constitutes a common pin for the center pin joints of locking struts 304B for back leg 302B. Leg-position adjustment mechanism 390, typically situated at least partially between pin struts 392, is connected to both of struts 392.

Actuation of leg-position adjustment mechanism 390 causes the distance between pin struts 392 to increase or decrease. More particularly, front pin strut 392A moves forward as back pin strut 392B moves backward in going from the configuration of FIGS. 37*a* and 38*a* to the configuration of FIGS. 37*b* and 38*b*. In going from the configuration of FIGS. 37*b* and 38*b* back to the configuration of FIGS. 37*a* and 38*a*, front pin strut 392A moves backward as back pin strut 392B moves forward. The movement of pin struts 392 causes locking struts 304 to switch from their compressed position to their extended positions and vice versa. This, in turn, causes frame legs 302 to switch from their retracted positions to their extended positions and vice versa.

The human-controllable device for actuating leg-position adjustment mechanism 390 can be implemented in various ways. In the example of FIGS. 37 and 38, the human-controllable actuation device is formed with a control lever 394 connected to adjustment mechanism 390 through a horizontal longitudinal control slot 396 in one of long rails 160, long rail 160L in this example. When a person switches control lever 394 from one end of control slot 396 to the other end of slot 396, adjustment mechanism 390 responds by increasing or decreasing the distance between pin struts 392 depending on which way control lever 394 is moved. Hence, frame legs 302 switch from their retracted positions to their extended positions or vice versa dependent on the movement of lever 394. In the situation where seatback 104 goes to its flat position when legs 302 go to their extended positions as shown in FIG. 37*b*, the movement of lever 394 also causes seatback 104 to go to its flat position when legs 302 go to their extended positions and to return to its inclined position when legs 302 return to their retracted positions.

Starting from the cycling configuration of FIG. 37*a* in which seatback 104 is in an inclined position, a person such as the user of the exercise machine of FIG. 37 can manually switch seatback 104 to its flat or non-inclined position in the way described above for the exercise machine of FIG. 36. In particular, frame-associated pin 194 is removed from support rod 128Y and channel portion 166Y. The frame-associated end of support rod 128Y is then moved backward until seatback 104 lies largely flat against frame 100Y. Returning to the cycling configuration of FIG. 37*a* entails moving the frame-associated end of support rod suitably forward and then inserting frame-associated pin 194 through openings 380 in channel portion 166Y and through opening 382 in the frame-associated end of rod 128Y.

Alternatively, another mechanism such as that described below in connection with FIGS. 40*a* and 40*b* can be employed with the leg-position control mechanism of FIGS. 37 and 38 in order to switch seatback 104 between its inclined and flat positions. In the situation where frame legs 302 switch between their retracted and extended positions at the same time that seatback 104 switches between its inclined and flat positions, actuation of leg-position control mechanism also results in appropriate actuation of the mechanism for switching seatback 104 between its inclined and flat positions.

The exercise machine of FIG. 37 is switched between the cycling configuration and an extended-leg exercise-bench configuration in largely the same manner as the exercise machine of FIG. 36 except that leg-position adjustment mechanism 390 is used to rapidly switch frame legs 302 between their retracted and extended positions during the exercise-machine configuration switching. When seatback 104 is to be in its flat position in the extended-leg exercise-bench configuration, the exercise machine of FIG. 37 incorporates the preceding mechanism for switching seatback 104 between its inclined and flat positions if seatback 104 is not manually switched between its inclined and flat positions.

Figure 38A:
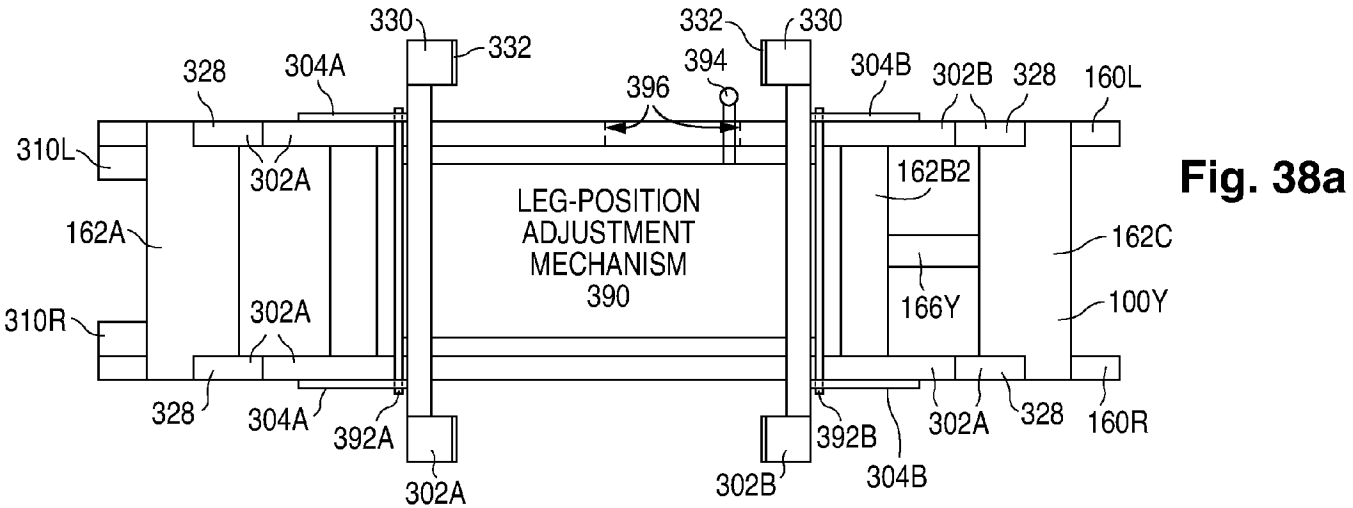
FIGS. 38*a* and 38*b* are bottom views of the frame and general leg-position control mechanism in the exercise machine of FIGS. 37*a* and 37*b*. The frame legs are in their retracted positions in the bottom view of FIG. 38*a* taken along plane 38*a*-38*a* in FIG. 37*a*. The frame legs are in their extended positions in the bottom view of FIG. 38*b* taken along plane 38*b*-38*b* in FIG. 37*b*.
Figure 38B:
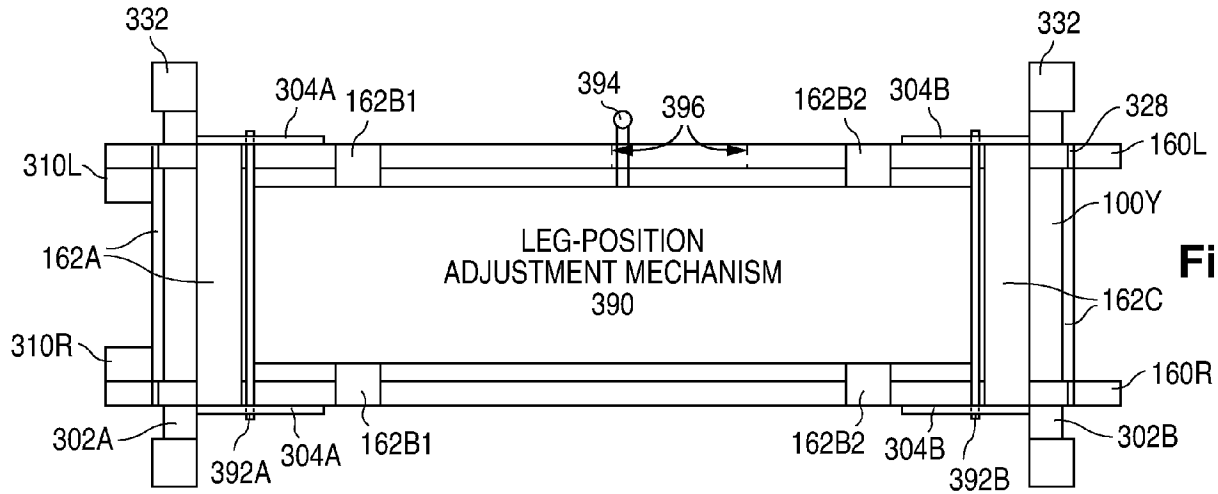
Figure 39A:
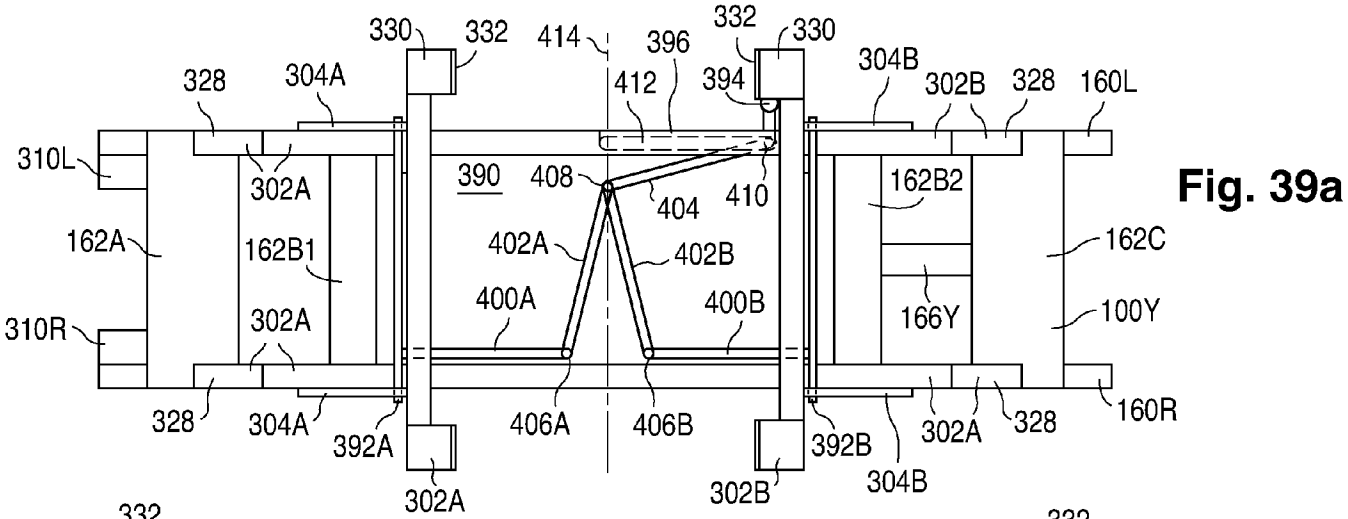
FIGS. 39*a* and 39*b* are bottom views of the frame and a typical implementation of the leg-position control mechanism in the exercise machine of FIGS. 37*a* and 37*b*. The frame legs are in their retracted positions in the bottom view of FIG. 39*a*. The frame legs are in their extended positions in the bottom view of FIG. 39*b*.
Figure 39B:
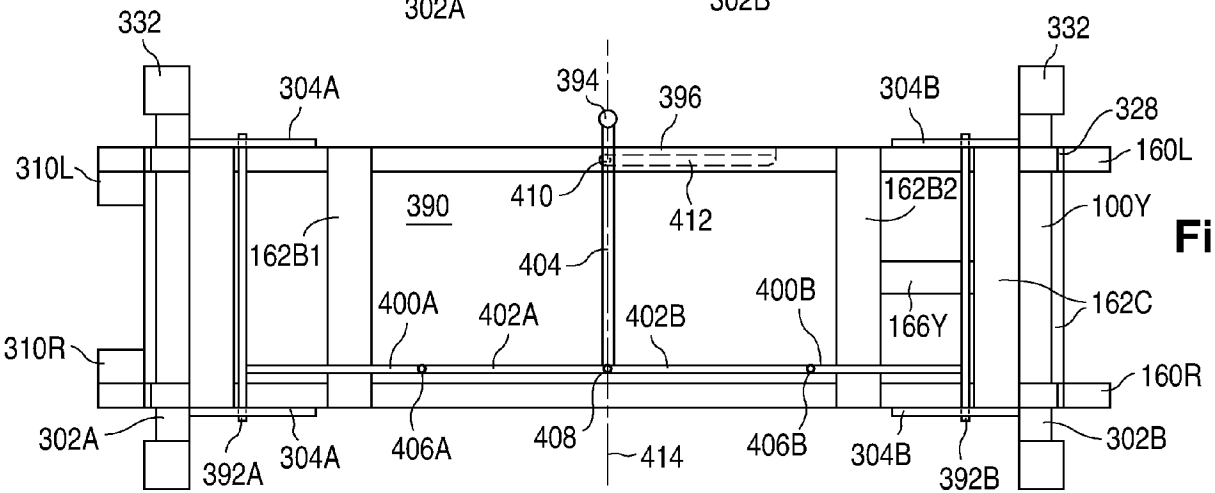

FIGS. 39*a* and 39*b* (collectively "FIG. 39"), which respectively correspond to FIGS. 38*a* and 38*b*, illustrate a typical implementation of leg-position adjustment mechanism 390 in the exercise machine of FIG. 37 as again seen from below the exercise machine. In the implementation of FIG. 39, adjustment mechanism 390 is formed with a pair of longitudinal struts 400A and 400B respectively corresponding to pin struts 392A and 392B, a pair of intermediate lever struts 402A and 402B respectively corresponding to longitudinal struts 400A and 400B, and a terminal lever strut 404.

Longitudinal struts 400A and 400B extend in the longitudinal direction, i.e., in the direction of the exercise machine's length. One end of each longitudinal strut 400A or 400B is fixedly connected to corresponding pin strut 392A or 392B near long rail 160R. The other end of longitudinal strut 400A or 400B is flexibly connected through a corresponding pin joint 406A or 406B to one end of corresponding intermediate lever strut 402A or 402B. The other ends of intermediate lever struts 402A and 402B are flexibly connected together and to one end of terminal lever strut 404 through another pin joint 408.

The other end of terminal lever strut 404 is flexibly connected through a further pin joint 410 to control lever 394. Pin joint 410 has a pin which slides in a vertical longitudinal slot 412 in long rail 160L. Since control lever 394 extends into control slot 396 in long rail 160L, the pin of pin joint 410 only moves in the longitudinal direction. Leg-position adjustment mechanism 390 in FIG. 39 may include further structure (not shown) which constrains the movements of the pins of pin joints 406A, 406B, and 408 so as to ensure that the leg-position control mechanism operates properly.

The leg-position control mechanism operates in the following manner. Leg-position adjustment mechanism 390 in FIG. 39 operates generally symmetrically about a lever axis 414 extending through pin joint 408 in the transverse direction. Starting with FIG. 39*a* which corresponds to the cycling configuration of FIG. 37*a* where frame legs 302 are in their retracted positions, control lever 394 is at a position distant from lever axis 414. Intermediate lever struts 402A and 402B are in a compressed position. Terminal lever strut 404 is slanted at a relatively large angle to lever axis 414 with pin joint 408 relatively close to long rail 160L. Pin joints 406A and 406B are relatively close to each other. Pin struts 392 are at their minimum separation. Hence, locking struts 304 are in their compressed positions as shown in FIG. 37*a*.

In going from FIG. 39*a* to FIG. 39*b* which corresponds to the extended-leg exercise-bench configuration of FIG. 37*b* where frame legs 302 are in their extended positions, a person moves control lever 394 along control slot 396 to a position close to lever axis 414. This causes the angle between terminal lever strut 404 and lever axis 414 to become relatively small. Terminal lever strut 404 may extend largely parallel to lever axis 414 as indicated in the example of FIG. 39*b*. Pin joint 408 moves away from long rail 160L which causes pin joints 406A and 406B to move longitudinally away from each other. This, in turn, causes pin struts 392 to move away from each other to their maximum separation. Locking struts 304 go to their extended positions as shown in FIG. 39*b*. Consequently, legs 302 go to their extended positions. The locking mechanisms of locking struts 304 then lock them in their extended positions.

Control lever 394 may have a mechanism (not shown) which locks lever 394 in the position close to lever axis 414. In that case, locking struts 304 may not have the above-mentioned locking mechanisms.

The reverse occurs when a person returns control lever 394 to the position distant from lever axis 414 after releasing the locking mechanism of lever 394 or/and releasing the locking mechanisms of locking struts 304. Pin joints 408, 406A, and 406B return to the positions shown in FIG. 39*a*. Locking struts 304 return to their compressed positions, causing frame legs 302 to return to their retracted positions as depicted in FIG. 39*a*.

The leg-position control mechanism can be implemented in ways other than that depicted in FIG. 39. For instance, leg-position adjustment mechanism 390 can be implemented with other combinations of struts that provide lever actions for changing the distance between pin struts 392. Pulleys can be variously used in implementing adjustment mechanism 390. Pin struts 392 can be replaced with pulleys and/or other struts. One or more electrical motors can be used to drive structure that rapidly switches frame legs 302 between their retracted and extended positions. The motor or motors can be actuated with a button, switch, or other switching mechanism which requires minimal human effort rather than moving a control lever a substantial distance.

F. Exercise Machine with Seatback-Incline Control Mechanism

Figure 40A:
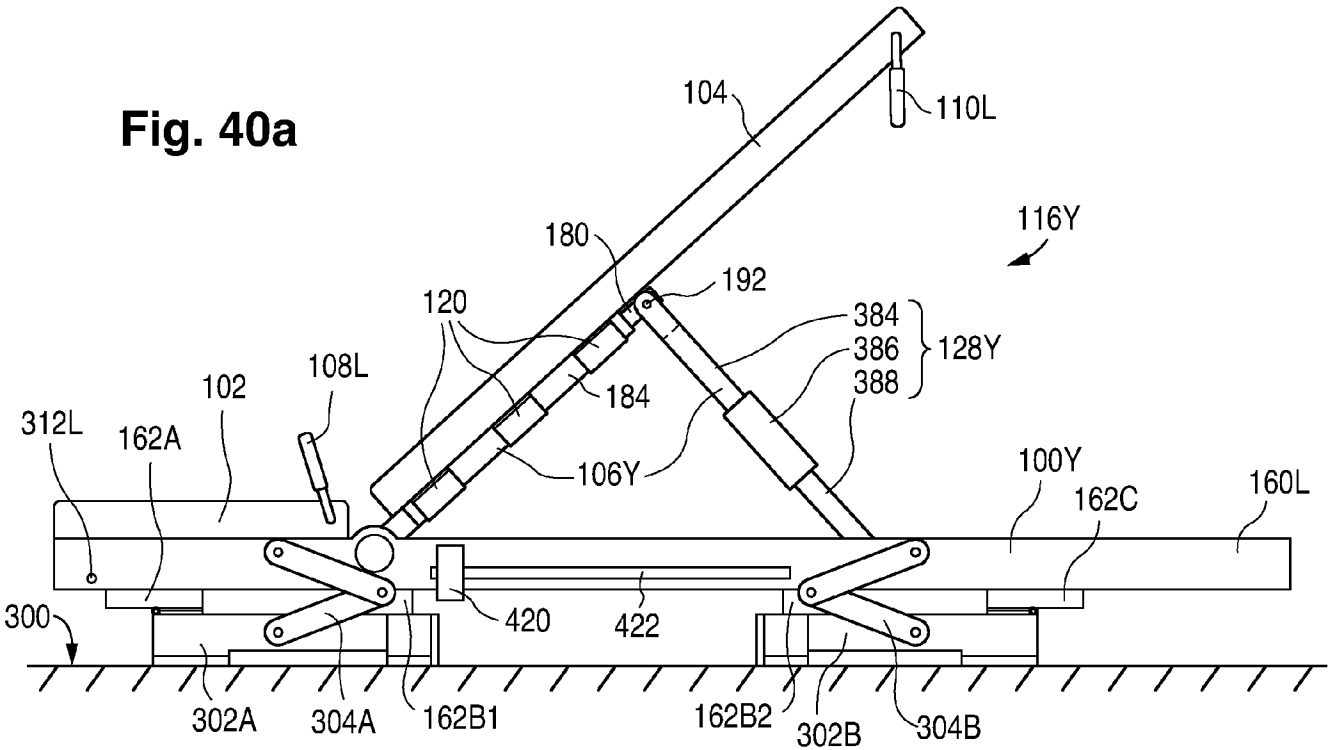
FIGS. 40*a* and 40*b* are side views of a general variation, in accordance with the invention, of the main assembly of the multi-function exercise machine of FIGS. 36*a* and 36*b* in which a seatback-incline control mechanism is used to rapidly switch the seatback between its inclined and flat positions.
Figure 40B:
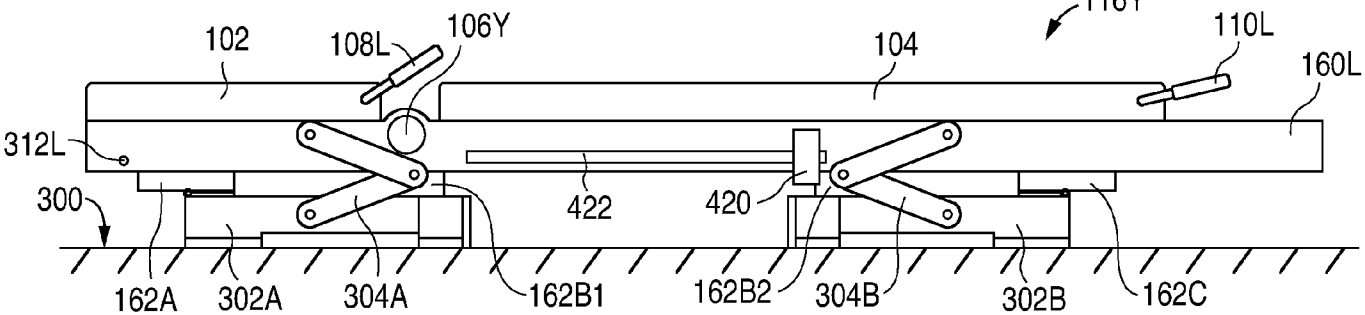

FIGS. 40*a* and 40*b* (collectively "FIG. 40") illustrate a general variation, configured in accordance with the invention, of main assembly 116Y of the multi-function exercise machine of FIG. 36 in which a seatback-incline control mechanism actuatable by a person, such as the user, is used to rapidly switch seatback 104 between its inclined and flat positions. In FIG. 40*a*, seatback 104 is inclined to seat 102. Seatback 104 is largely flat against frame 100Y in FIG. 40*b*. The seatback-incline control mechanism consists of a seatback-incline adjustment mechanism and a human-controllable device for actuating the seatback-incline adjustment mechanism.

The human-controllable device for actuating the seatback-incline adjustment mechanism can be implemented in various ways. In the example of FIG. 40, the human-controllable actuation device for the seatback-incline adjustment mechanism is formed with a control lever 420 connected to the adjustment mechanism through a horizontal longitudinal control slot 422 in one of long rails 160, long rail 160L in this example. When a person switches control lever 420 from one end of control slot 422 to the other end, the seatback-incline adjustment mechanism responds by causing the incline of seatback 104 to increase or decrease, depending on which way control lever 420 is moved, until seatback 104 reaches a predetermined incline to seat 102 or lies largely flat against frame 100Y. Control lever 420 includes a mechanism (not shown) that locks lever 420 in place after seatback 104 reaches the predetermined incline.

Figure 41A:
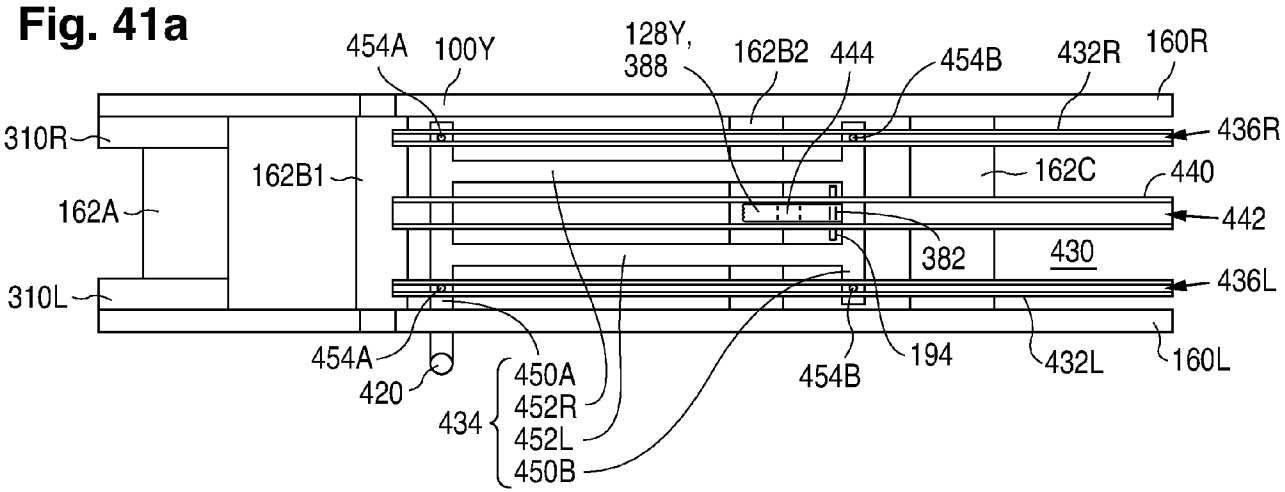
FIGS. 41*a* and 41*b* are top views of the frame and an implementation of the seatback-incline control mechanism in the exercise machine of FIGS. 40*a* and 40*b*. The top view of FIG. 41*a* represents the situation in which the seatback is in its inclined position. The top view of FIG. 41*b* represents the situation in which the seatback is in its flat position.
Figure 41B:
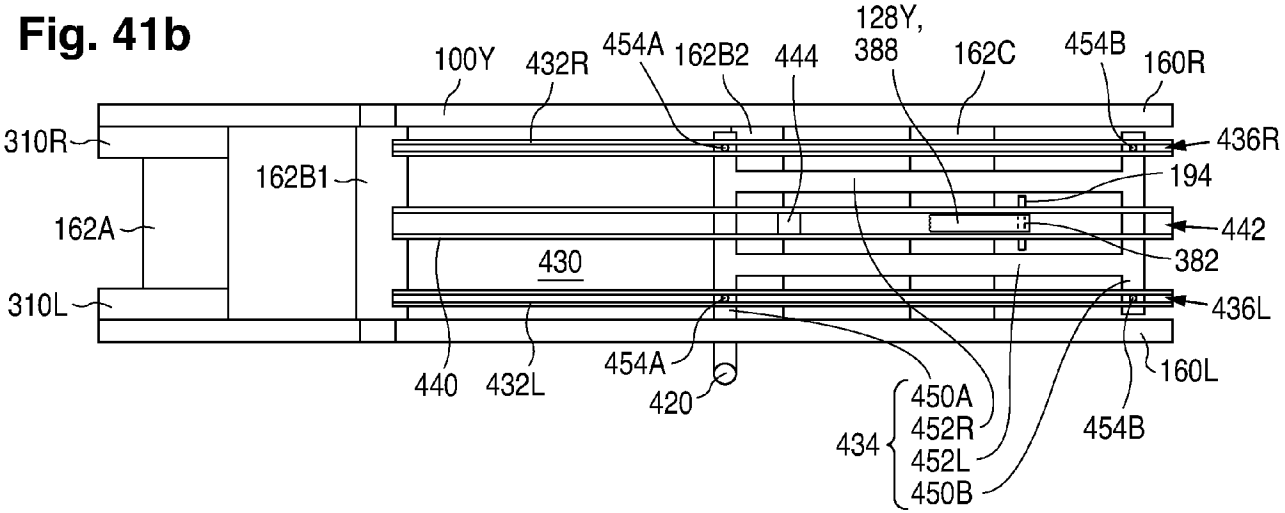
Figure 42A:
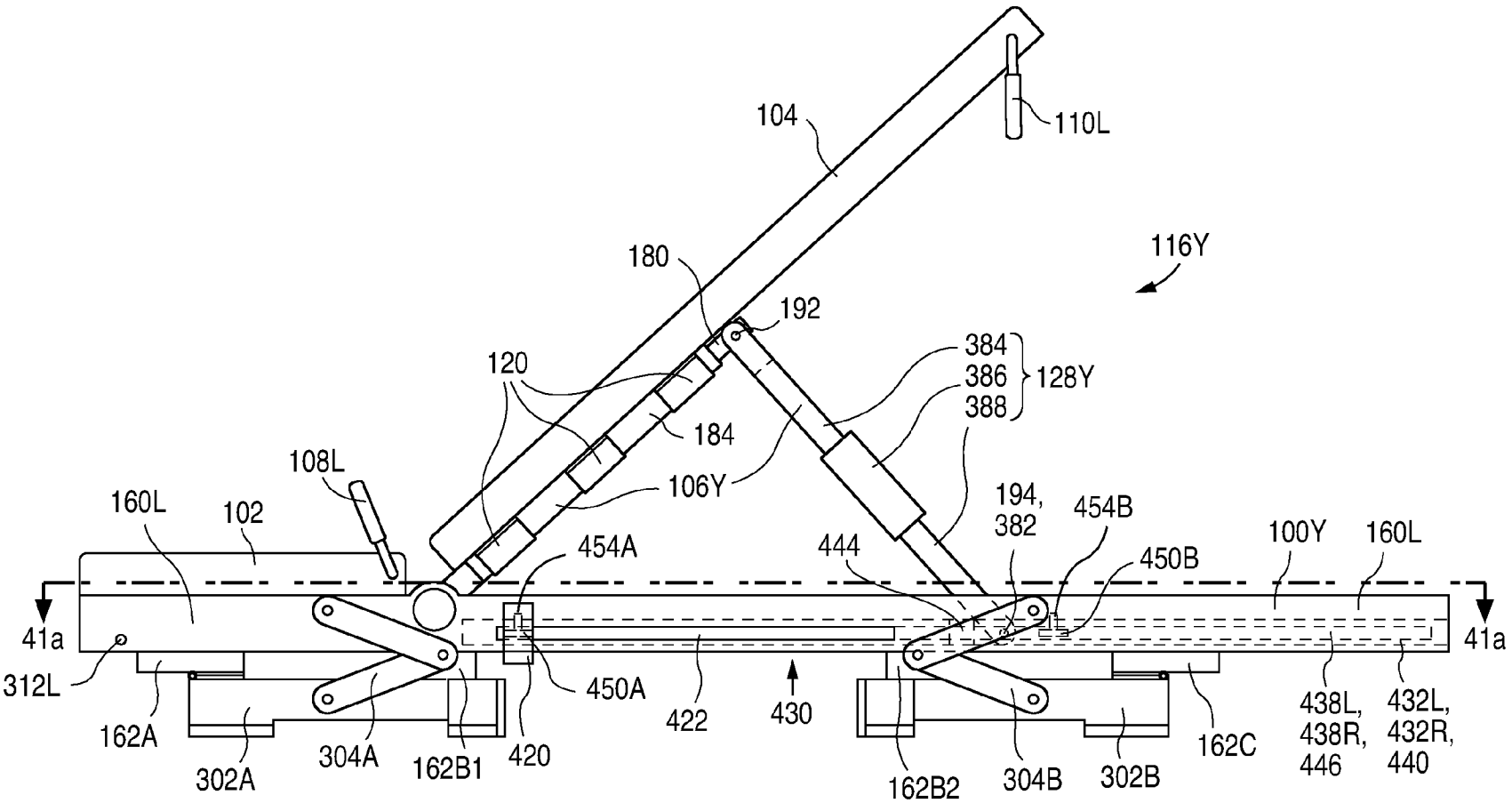
FIGS. 42*a* and 42*b* are side views of the exercise machine of FIGS. 40*a* and 40*b* as implemented with the seatback-incline control mechanism of FIGS. 41*a* and 41*b* with hidden features of the support rod and seatback-incline control mechanism indicated in dashed line. The top view of FIG. 41*a* is taken along plane 41*a*-41*a* in FIG. 42*a* in which the seatback is in its inclined position. The top view of FIG. 41*b* is taken along plane 41*b*-41*b* in FIG. 42*b* in which the seatback is in its flat position.
Figure 42B:
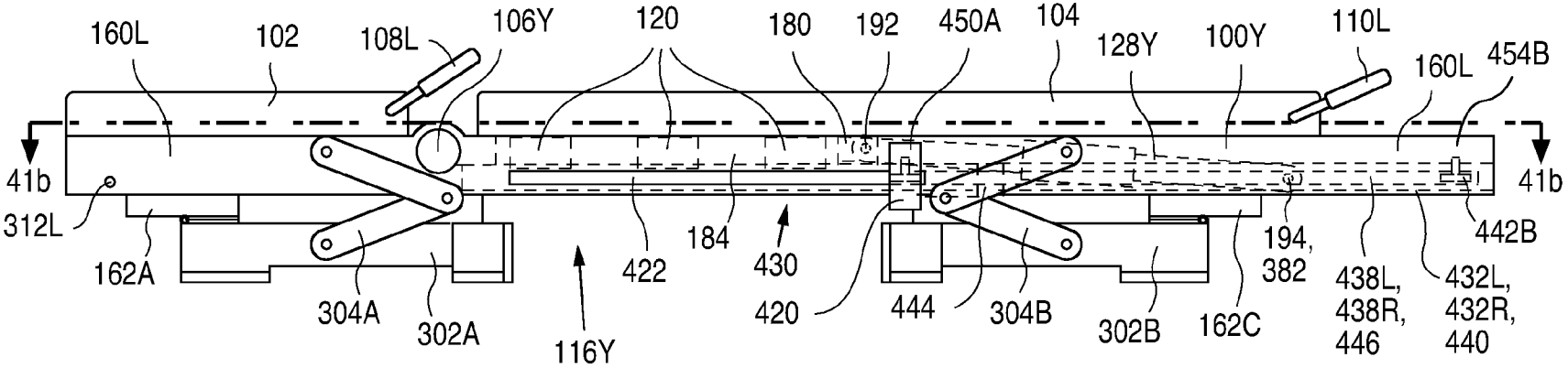

The seatback-incline adjustment mechanism is not visible in FIG. 40. An implementation 430 of the seatback-incline adjustment mechanism can be largely seen in FIGS. 41*a* and 41*b* (collectively "FIG. 41") which present top (plan) views of frame 100Y and the adjustment mechanism, generally identified by reference symbol 430. Visualization of seatback-incline adjustment mechanism 430 is further assisted with FIGS. 42*a* and 42*b* (collectively "FIG. 42") that present side views of main assembly 116Y of FIG. 40 as implemented with adjustment mechanism 430 with hidden features of mechanism 430 indicated in dashed line. FIGS. 41*a* and 42*a* illustrate how adjustment mechanism 430 appears when main assembly 116Y of FIG. 40 is in the seatback-inclined configuration of FIG. 40*a*. FIGS. 41*b* and 42*b* depict how adjustment mechanism 430 appears when main assembly 116Y of FIG. 40 is in the seatback-flat configuration of FIG. 40*b*. Long rails 160 are somewhat longer in main assembly 116Y of FIG. 40, as implemented with adjustment mechanism 430, than in main assembly 116Y of the earlier exercise machines of the invention.

Seatback-incline adjustment mechanism 430 of FIGS. 41 and 42 includes a pair of side channel portions 432L and 432R (collectively "side channel portions 432") and a slidable structure 434 (not specifically labeled in FIG. 42). Side channel portions 432 are fixedly mounted on cross rails 162B1, 162B2, and 162C between long rails 160 and extend longitudinally from front-most intermediate cross rail 162B1 largely to the back of frame 100Y. Side channel portion 432L is close to long rail 160L. Side channel portion 432R is close to long rail 160R. Side channel portions 432L and 432R have respective longitudinal channels 436L and 436R as shown in FIG. 41. The sides of each side channel portion 432L or 432R respectively have a pair of identical oppositely situated horizontal longitudinal slots 438L or 438R that extend nearly the length of side channel portions 432. Longitudinal slots 438L and 438R, although not indicated in FIG. 41, are indicated in dashed line in FIG. 42.

A variation 440 of channel portion 166Y of the exercise machine of FIG. 36 is used in seatback-incline adjustment mechanism 430. Channel portion 440 is referred to here as the central channel portion because it is situated between side channel portions 432. Central channel portion 440 is fixedly mounted on cross rails 162B1, 162B2, and 162C and extends longitudinally from front-most intermediate cross rail 162B1 largely to the back of frame 100Y. Central channel portion 440 has a longitudinal channel 442 as shown in FIG. 41. A channel stop 444 is situated in channel 442 roughly halfway between the ends of central channel portion 440. The side of central channel portion 440 have a pair of oppositely situated horizontal longitudinal slots 446 that extend from nearly the back end of channel portion 440 substantially at least up to channel stop 444. Longitudinal slots 446, although not indicated in FIG. 41, are indicated in dashed line in FIG. 42.

Slidable structure 434 consists primarily of a front bar 450A, a back bar 450B, and a pair of side bars 452L and 452R as shown in FIG. 41. Although front/back bars 450A and 450B are indicated in dashed line in FIG. 42, side bars 452L and 452R are not indicated in FIG. 42. Front bar 450A fixedly connects to control lever 420 which extends through control slot 422 in long rail 160L. As with longitudinal slots 438L, 438R, and 446, control slot 420 is indicated in FIG. 42 but not in FIG. 41. Side bars 452L and 452R extend between and are connected to, or merge into, front/back bars 450A and 450B in a largely perpendicular manner Front/back bars 450A and 450B extend through longitudinal slots 438L in side channel portion 432L, through longitudinal slots 446 in central channel portion 440, and through longitudinal slots 438R in side channel portion 432R.

Slidable structure 434 further includes two front constraining pins 454A and two back constraining pins 454B. Front constraining pins 454A are mounted on front bar 450A. Each front pin 454A extends vertically between the sides of a different one of side channel portions 432. Back constraining pins 454B are mounted on back bar 450B. Each back pin 454B likewise extends vertically between the sides of a different one of side channel portions 432. Because front/back bars 450A and 450B pass through longitudinal slots 438L and 438R in side channel portions 432, pins 454A and 454B can slide longitudinally in/along channels 436L and 436R of side channel portions 432 but cannot significantly move away from channels 436L and 436R. As a result, pins 454A and 454B constrain slidable structure 434 so that it moves largely only longitudinally.

Frame-associated pin 194 which passes through opening 382 in the frame-associated end of support rod 128Y, specifically in the frame-associated end of frame-associated connection rod 388 of rod 128Y, also now passes through longitudinal slots 446 in central channel portion 440. The frame-associated end of support rod 128Y is situated between channel stop 444 and back bar 450B of slidable structure 434. Pin 194 generally indicates the location of the frame-associated end of support rod 128Y in FIG. 42.

The frame-associated end of support rod 128Y may be connected to back bar 450B by a flexible connector which allows the distance between bar 450B and the frame-associated end of rod 128Y to be varied over a significant range while maintaining the connection. Because frame-associated pin 194 and front/back bars 450A and 450B all pass through longitudinal slots 446, the frame-associated end of support rod 128Y can move (translate) longitudinally in/along channel 442 of central channel portion 440 but cannot significantly move away from channel 442. Channel stop 444 prevents the frame-associated end of support rod 128Y from moving forward beyond channel stop 444 in/along channel 442.

With the foregoing in mind, the seatback-incline control mechanism formed with control lever 420 and seatback-incline adjustment mechanism 430 operates in the following manner with the length of support rod 128Y previously adjusted to place seatback 104 at a selected (predetermined) incline to seat 102 when seatback 104 is intended to be inclined to seat 102. Starting with the configuration of FIGS. 41*a* and 42*a* in which seatback 104 is so inclined, slidable structure 434 is in a forward position relative to long rails 160. Control lever 420 is at one end of control slot 422 in long rail 160L as shown in FIG. 42*a*. The locking mechanism (again, not shown) of control lever 420 holds it in place so that slidable structure 434 stays in its forward position.

Back bar 450B of slidable structure 434 is close to the frame-associated end of support rod 128Y, specifically the frame-associated end of frame-associated connection rod 388 of rod 128Y. If the above-mentioned flexible connector for connecting the frame-associated end of support rod 128Y to back bar 450B is not present, back bar 450B contacts the frame-associated end of rod 128Y. If the flexible connector is present, the flexible connector maintains the spacing between back bar 450B and the frame-associated end of support rod 128Y at a minimum value. In either case, the frame-associated end of support rod 128Y functions to hold seatback 104 at the predetermined incline to seat 102.

In going from the configuration of FIGS. 41*a* and 42*a* to the configuration of FIGS. 41*b* and 42*b*, a person releases the locking mechanism of control lever 420 and moves it to the other end of control slot 422. This cause slidable structure 434 to move backward to a backward position relative to long rails 160. The frame-associated end of support rod 128Y then moves backward in/along channel 442 of central channel portion 440 until seatback 104 is largely flat against frame 100Y. If the flexible connector for connecting the frame-associated end of support rod 128Y to back bar 450B is not present, seatback 104 moves to its flat or non-inclined position largely under the influence of gravity. Back bar 450B of slidable structure 434 may separate from the frame-associated end of support rod 128Y as generally indicated in FIG. 42*b*. If the flexible connector is present, the flexible connector pulls the frame-associated end of support rod 128Y backward until seatback 104 reaches its flat position. In so doing, the distance between back bar 450B and the frame-associated end of support rod 128Y may increase as the flexible connector expands.

When a person returns control lever 420 to the position of FIGS. 41*a* and 42*a* and locks lever 420 in place, slidable structure 434 returns to its forward position to force seatback 104 back to the predetermined incline to seat 102. If the flexible connector for connecting the frame-associated end of support rod 128Y to back bar 450B is not present, back bar 450B presses on the frame-associated end of support rod 128Y and moves the frame-associated end of rod 128Y forward as back bar 450B moves forward. In doing so, back bar 450B comes into contact with the frame-associated end of support rod 128Y if back bar 450B previously separated from the frame-associated end of rod 128Y. If the flexible connector is present, back bar 450B simply pushes the frame-associated end of support rod 128Y forward through the flexible connector.

The use of adjustable-length support rod 128Y is advantageous in the exercise machine of FIG. 40 as, for example, implemented with seatback-incline adjustment mechanism 430 in FIGS. 41 and 42 because the frame-associated end of rod 128Y can be moved in/along channel 442 of central channel portion 440 in rapidly switching seatback 104 between its inclined and flat positions. The frame-associated end of support rod 128Y goes farthest backward in/along channel 442 when rod 128Y is at its maximum length. Hence, the length of central channel portion 440 is determined by the maximum length of support rod 128Y.

The seatback-incline control mechanism can be implemented in ways other than using seatback-incline adjustment mechanism 430 of FIGS. 41 and 42. For instance, bars 450A, 450B, 452L, and 452R of slidable structure 433 can be merged into a single bar fixedly connected to control lever 420. Constraining pins 454A and 454B can then be placed on the single slidable bar. Front pins 454A or back pins 454B can be eliminated. One or more electrical motors can be used to drive structure that rapidly switches seatback 104 between its inclined and flat positions. A button, switch, or other switching mechanism which requires minimal human effort can be employed to actuate the motor or motors.

Another variation, configured in accordance with the invention, of the multi-function exercise machine of FIG. 36 contains both the leg-position control mechanism of FIGS. 37 and 38 and the seatback-incline control mechanism of FIG. 40. Control levers 394 and 420 can be present on opposite sides of the exercise machine. For instance, control lever 394 can extend through control slot 396 in long rail 160L for actuating leg-position adjustment mechanism 390, while control lever 420 extends through a horizontal longitudinal control slot in long rail 160R for actuating the seatback-incline adjustment mechanism, or vice versa. Either before or after actuating leg-position adjustment mechanism 390 to rapidly switch frame legs 302 between their retracted and extended positions, a person can actuate the seatback-incline adjustment mechanism to switch seatback 104 between its inclined and flat positions.

The presence of both leg-position adjustment mechanism 390 and the seatback-incline control mechanism in this variation with pedaling mechanism 112Y attached to main assembly 116Y leads to four different operational sequences and resultant exercise-machine configurations. Firstly, leg-position adjustment mechanism 390 can be actuated to switch frame legs 302 from their extended positions to their retracted positions before or after the seatback-incline control mechanism is actuated to switch seatback 104 from its flat position to its inclined position to produce the cycling configuration of FIG. 37*a*. Secondly, leg-position adjustment mechanism 390 can be actuated to switch legs 302 from their retracted positions to their extended positions before or after the seatback-incline control mechanism is actuated to switch seatback 104 from its inclined position to its flat position to produce the extended-leg seatback-flat exercise-bench configuration of FIG. 37*b*. Thirdly, leg-position adjustment mechanism 390 can be actuated to switch legs 302 from their retracted positions to their extended positions before or after the seatback-incline control mechanism is actuated to switch seatback 104 from its flat position to its inclined position to produce an extended-leg exercise-bench configuration in which seatback 104 is inclined.

Fourthly and finally, leg-position adjustment mechanism 390 can be actuated to switch frame legs 302 from their extended positions to their retracted positions before or after the seatback-incline control mechanism is actuated to switch seatback 104 from its inclined position to its flat position. Since seatback 104 is flat in the resultant configuration, it is generally difficult to stationary cycle with pedaling mechanism 112Y. Although seat 102 and seatback 104 are both close to underlying surface 300 in this configuration, it is suitable for some exercise-bench exercises and is therefore a leg-retracted exercise-bench configuration.

G. Exercise Machine with Segmented Seatback

Figure 43A:
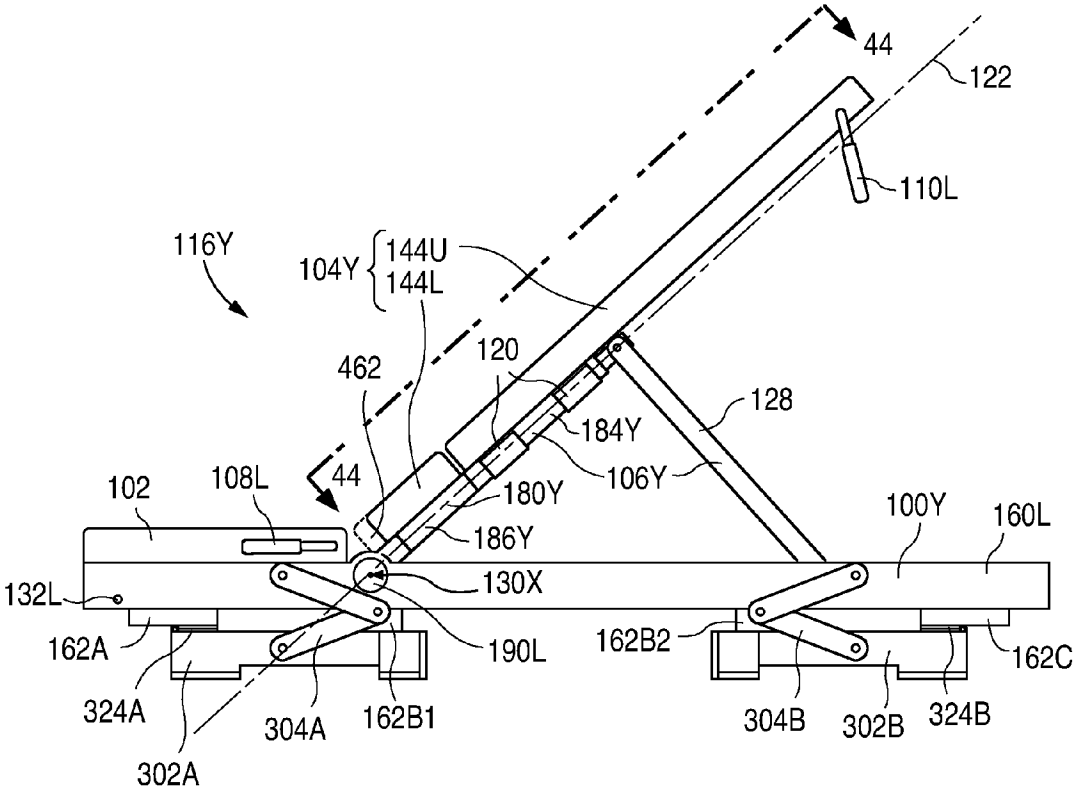
FIGS. 43*a* and 43*b* are side views of a variation, in accordance with the invention, of the main assembly of the exercise machine of FIGS. 21 and 25 in which the seatback is segmented into a swivelable segment and a seat-adjacent non-swivelable segment for facilitating seatback swivel. The main assembly of FIGS. 43*a* and 43*b* is arranged so as to be suitable for the cycling configuration in FIG. 43*a* and for an extended-leg exercise-bench configuration in FIG. 43*b* with the seatback flat.
Figure 43B:
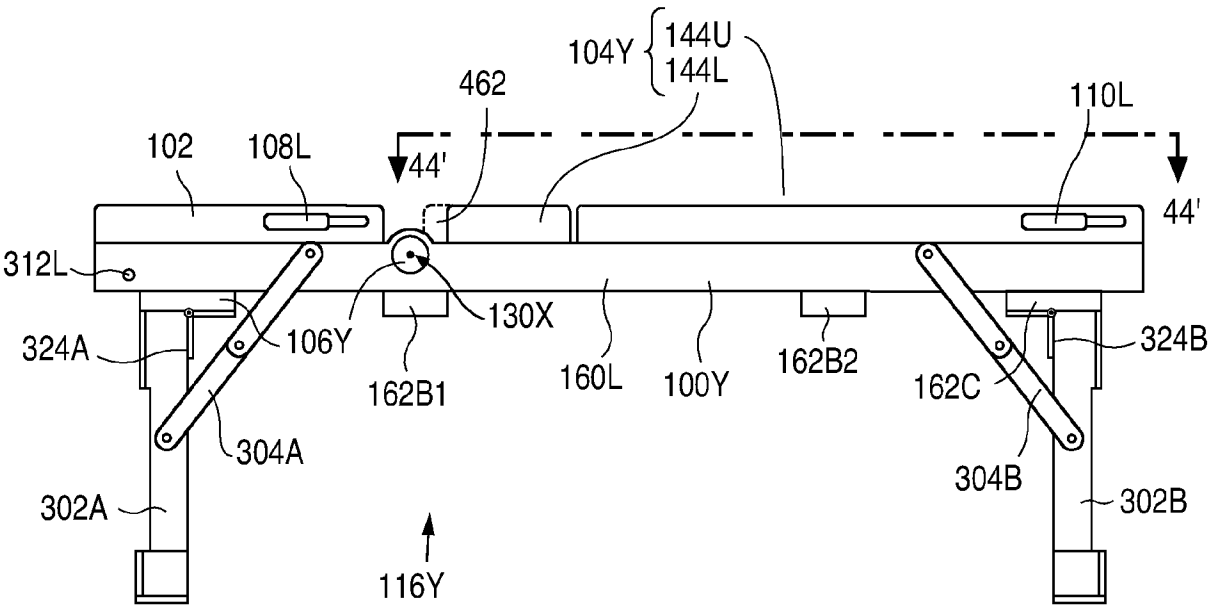

FIGS. 43*a* and 43*b* (collectively "FIG. 43") illustrate a variation, configured in accordance with the invention, of main assembly 116Y of the exercise machine of FIGS. 21 and 25 in which seatback 104 is replaced with a seatback 104Y segmented into a first segment 104L and a second segment 104U in order to facilitate seatback swivel. In FIG. 43*a*, seatback 104Y is inclined to seat 102 as occurs in the cycling configuration. Frame legs 302 are in their retracted positions in FIG. 43*a*. Accordingly, main assembly 116Y in FIG. 43*a* is also suitable for a retracted-leg seatback-inclined exercise-bench configuration.

In FIG. 43*b*, frame legs 302 are in their extended positions with seatback 104Y largely flat against frame 100Y. Main assembly 116Y in FIG. 43*b* is therefore suitable for an extended-leg seatback-flat exercise-bench configuration. By setting seatback 104 at a suitable incline to seat 102 while keeping legs 302 in their extended positions, main assembly 116Y of FIG. 43 is also suitable for an extended-leg seatback-inclined exercise-bench configuration.

Figure 44:
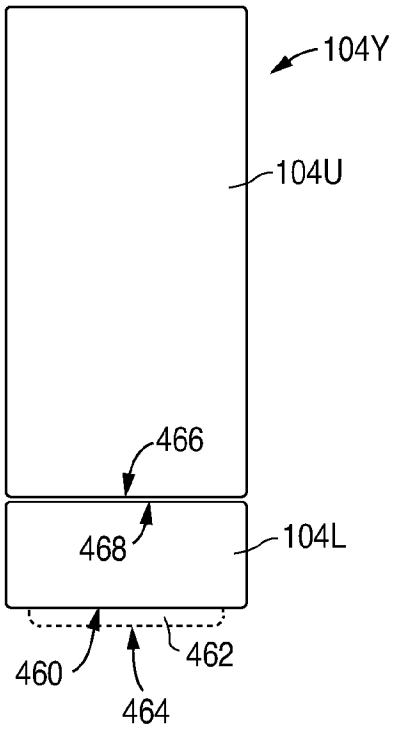
FIG. 44 is a front-side plan view of the segmented seatback in the exercise machine of FIGS. 43*a* and 43*b*. The front-side plan view of FIG. 44 is taken along plane 44-44 in FIG. 43*a* and along corresponding plane 44'-44' in FIG. 43*b*.

Seatback 104Y is separately shown in FIG. 44. Seatback segments 104L and 104U are situated close to each other. When seatback 104Y is inclined to seat 102 as shown in FIG. 43*a*, first seatback segment 104L is lower than second seatback segment 104U. Accordingly, seatback segments 104L and 104R are often referred to here respectively as the lower and upper seatback segments. Upper seatback segment 104U swivels about swivel axis 122 in the manner described above for seatback 104 and is often additionally or alternatively referred to here as the swivelable seatback segment.

Seatback-to-frame/seat connection mechanism 106Y in the exercise machine of FIG. 43 is modified to accommodate segmented seatback 104Y. In particular, connection mechanism 106Y in the machine of FIG. 43 consists of a group of attachment brackets 120, support rod 128, a variation 180Y of T-shaped bar portion 180, and a variation 184Y of axial sleeve 184. Axial sleeve 184Y extends substantially only along upper seatback segment 104U and is thus shorter than axial sleeve 184.

T-shaped bar portion 180Y consists of cross bar 188 (not visible in FIG. 43), cross-bar end caps 190, and a variation 186Y of axial bar 186. Axial bar 186Y is identical to axial bar 186 except that the cross-bar-meeting section corresponding to cross-bar-meeting section 350 in FIG. 30 is longer to accommodate the reduced length of axial sleeve 184Y compared to axial sleeve 184. Aside from these differences and possibly at least one less attachment bracket 120, components 120, 128, 180Y and 184Y of seatback-to-frame/seat connection mechanism 106Y in the exercise machine of FIG. 43 are respectively configured, interconnected, and operable substantially the same as components 120, 128, 180, and 184.

Lower segment 104L of segmented seatback 104Y rotates about connection axis 130, indicated by dot 130X in FIG. 43, as the incline of seatback 104Y to seat 102 is adjusted but does not swivel about swivel axis 122. Hence, lower seatback segment 104L is often additionally or alternatively referred to here as the non-swivelable seatback segment. To enable non-swivelable seatback segment 104L to rotate about connection axis 130 without swiveling about swivel axis 122, non-swivelable segment 104L is typically fixedly connected to T-shaped bar portion 180Y. As with T-shaped bar portion 180, T-shaped bar portion 180Y can rotate about connection axis 130 but cannot swivel about swivel axis 122.

Referring to FIG. 44, the lower edge 460 of non-swivelable seatback segment 104L is typically largely straight. Because seatback segment 104L does nor swivel about swivel axis 122, there is no need to provide lower seatback edge 460 with a special contour to avoid having frame 100Y or seatback 104Y interfere with the seatback swiveling provided by upper swivelable seatback section 104U. The segmentation of seatback 104Y into non-swivelable seatback segment 104L and swivelable seatback segment 104U thus facilitates exercise machine design to accommodate seatback swiveling.

Lower non-swivelable seatback segment 104L can alternatively be flexibly connected to frame 100Y or seat 102 by a device (not shown) which allows lower segment 104L to rotate about connection axis 130 but does not allow lower segment 104L to swivel about swivel axis 122. The connection device can, for example, include one or more hinges having a rotation axis coincident with connection axis 130. To implement this alternative, lower seatback segment 104L may have a generally rectangular protrusion 462 that extends downward sufficiently close to frame 100Y or seat 102 to make the connection. Optional seatback protrusion 462 is indicated in dotted line in FIGS. 43 and 44. For the same reasons that lower edge 460 of non-swivelable segment 104L is typically substantially straight when seatback protrusion 462 is absent, the lower edge 464 of seatback protrusion 462 is typically substantially straight when it is present.

Attachment brackets 120, two in the example of FIG. 43, fixedly connect upper swivelable seatback segment 104U to axial sleeve 184Y of seatback-to-frame/seat connection mechanism 106Y. As a result, upper seatback segment 104U can swivel about swivel axis 122 and, as the seatback-to-seat incline is adjusted, rotate about connection axis 130. The lower edge 466 of upper swivelable seatback segment 104U normally largely matches the upper edge 468 of lower non-swivelable seatback segment 104L. Seatback segment edges 466 and 468 are typically largely straight. Aside from optional seatback protrusion 462, seatback segments 104L and 104U are typically largely rectangular.

Upper swivelable seatback segment 104U normally occupies most of the length of seatback 104Y as taken in the longitudinal direction of seatback 104Y. When a typical user is sitting on seat 102 with the user's back against seatback 104Y at a typical incline to seat 102, lower non-swivelable seatback segment 104L normally does not go higher than the "small" of the user's back. Seatback segments 104L and 104U are typically of approximately the same width. The width of lower seatback segment 104L may exceed its length.

H. Exercise Machine with Elevated Main Assembly

Figure 45A:
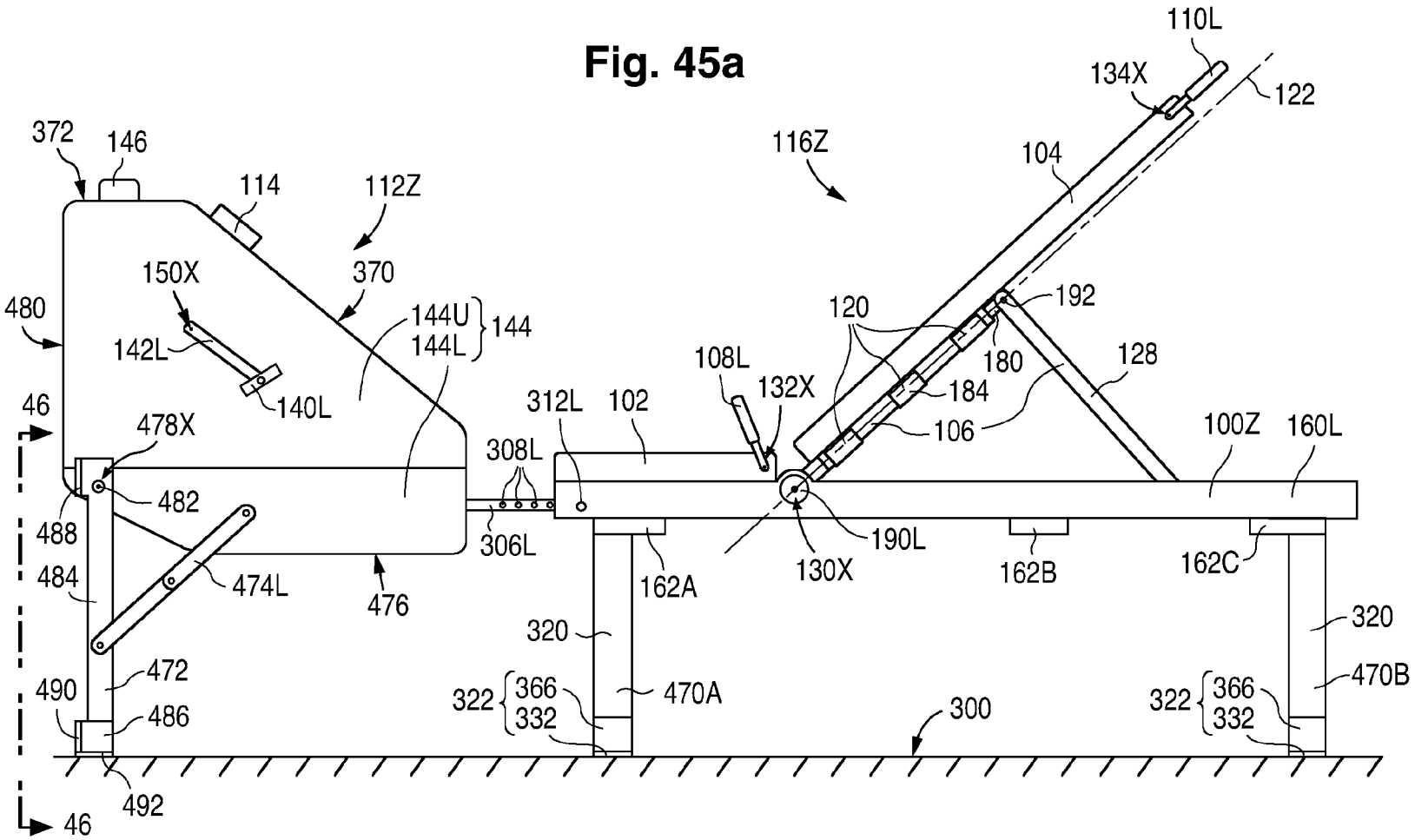
FIGS. 45*a* and 45*b* are side views of another multi-function exercise machine in accordance with the invention for exercising various muscles, including the legs and abdominal muscles, of a user. The exercise machine of FIGS. 45*a* and 45*b* is in the cycling configuration in FIG. 45*a* and in an exercise-bench configuration in FIG. 45*b* with the seatback flat.
Figure 45B:
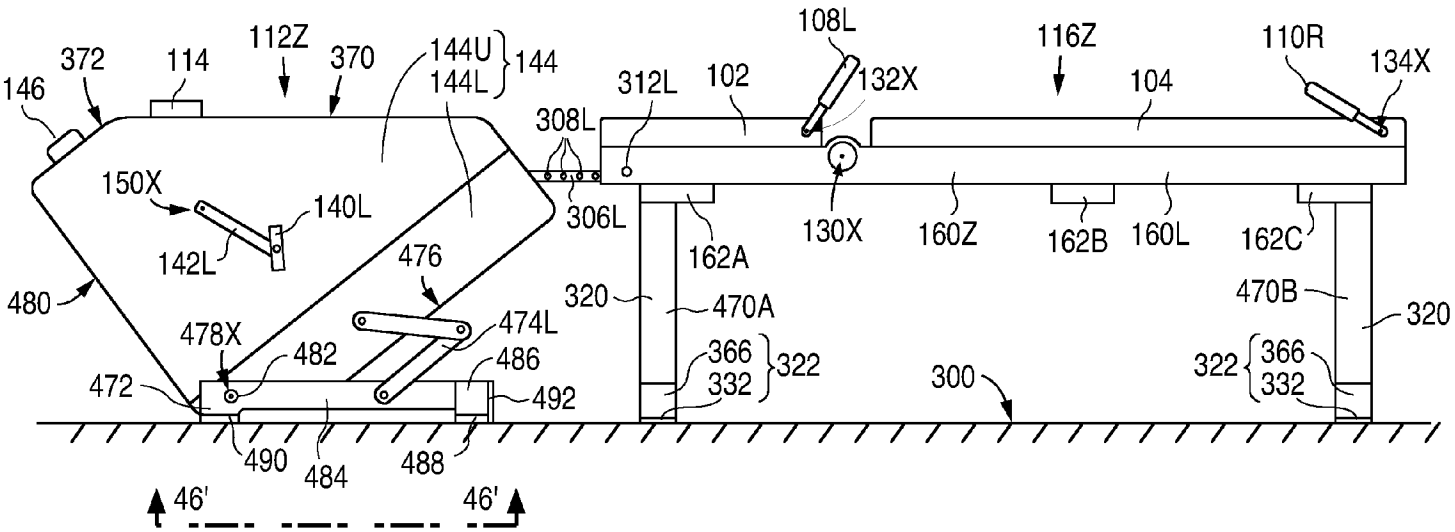

FIGS. 45*a* and 45*b* (collectively "FIG. 45") illustrate another multi-function exercise machine, configured in accordance with the invention, for exercising various muscles, including the legs and abdominal muscles, of a user. The exercise machine of FIG. 45 consists of a frame 100Z, seat 102, seatback 104, seatback-to-frame/seat connection mechanism 106, seat handles 108, seatback handles 110, a pedal-revolving pedaling mechanism 112Z, visual readout display 114, a front frame leg 470A, a back frame leg 470B, a retractable pedaling-mechanism leg 472, and a pair of pedaling-mechanism locking struts 474L and 474R (collectively "locking struts 474"). Pedaling-mechanism leg 472 and pedaling-mechanism locking struts 474 are separately illustrated in FIG. 46.

Frame 100Z, seat 102, seatback 104, seatback-to-frame/seat connection mechanism 106, handles 108 and 110, and frame legs 470A and 470B (collectively "frame legs 470") form a main assembly 116Z. Components 100Z, 102, 104, 106, 108, and 110 of main assembly 116Z are respectively configured, interconnected, and operable substantially the same as components 100, 102, 104, 106, 108, and 110 of main assembly 116 in the exercise machine of FIGS. 3-5 subject to the below-described differences.

As explained further below, frame legs 470 extend permanently downward during normal usage of the exercise machine of FIG. 45. That is, frame legs 470 are not capable of being retracted so as to switch the height of seat 102 between two values. Consequently, the top of seat 102 in the machine of FIG. 45 is permanently 30-50 cm above underlying surface 300 during normal exercise-machine usage.

Pedaling mechanism 112Z includes foot pedals 140. To enable the feet of a user to conveniently reach pedals 140 as the user stationary cycles on the exercise machine of FIG. 45, pedals 140 need to be elevated compared to where pedals 140 are located in the earlier-described exercise machines of the invention when they are used in the cycling configuration. FIG. 45*a* depicts how pedaling mechanism 112Z is arranged to have pedals 140 sufficiently high when the machine of FIG. 45 is in the cycling configuration.

With frame legs 470 extending permanently downward so that the top of seat 102 is 30-50 cm above underlying surface 300, FIG. 45*b* shows how pedaling mechanism 112Z is tilted downward in an exercise-bench configuration so as to avoid having mechanism 112Z interfere with exercising in the exercise-bench configuration. Seatback 104 is inclined to seat 102 in the pedaling-mechanism-tilted exercise-bench configuration of FIG. 45*b*. The exercise machine of FIG. 45 can also be used in a pedaling-mechanism-tilted exercise-bench configuration with seatback 104 largely flat against frame 100Z.

In addition to foot pedals 140 and associated pedal cranks 142, pedaling mechanism 112Z consists of cycle housing 144, an internal cycling apparatus (not shown) situated inside cycle housing 144, resistance-adjustment knob 146, and connector rails 306. Cycle housing 144 is again formed with high upper portion 144U and wider lower portion 144L. Readout display 114 remains on slanted back surface 370 of cycle housing 144 for the reasons given above in connection with the exercise machine of FIG. 33.

Resistance-adjustment knob 146 has again been moved to top surface 372 of cycle housing 144 so as to avoid having knob 146 interfere with exercising in an exercise-bench configuration. Cycle housing 144 has likewise again been contoured so that slanted back housing surface 370 is approximately coplanar with the top of seat 102 when the exercise machine of FIG. 45 is in the exercise-bench configuration of FIG. 45*b*. Subject to modifying the shape of cycle housing 144 to accommodate the tilting of pedaling mechanism 112Z, components 140, 142, 144, 146, and 306 and the internal cycling apparatus in pedaling mechanism 112Z of the exercise machine of FIG. 45 are configured, interconnected, and operable substantially the same as in pedaling mechanism 112Y of the exercise machine of FIG. 33.

Pedaling-mechanism leg 472 is flexibly connected to pedaling mechanism 112Z along or near the bottom surface 476 of cycle housing 144, specifically lower housing portion 144L, so that leg 472 can pivot (or rotate) about a leg-pivoting axis that extends generally parallel to the width of the exercise machine. Dot 478X in FIG. 45 indicates the location of the leg-pivoting axis. FIG. 45 specifically shows the leg-pivoting axis as being close to a slanted portion of bottom housing surface 476. The leg-pivoting axis is also typically close to the front surface 480 of cycle housing 144.

The flexible connection of pedaling-mechanism leg 472 to pedaling mechanism 112Z is of such a nature that (a) leg 472 is oriented generally vertically in an extended position when the exercise machine of FIG. 45 is in the cycling configuration of FIG. 45*a* with all of mechanism 112Z elevated significantly above underlying surface 300 and (b) leg 472 is oriented generally horizontally in a retracted position when the machine of FIG. 45 is in an exercise-bench configuration, such as that of FIG. 45*b*, with mechanism 112Z tilted downward so that bottom housing surface 476 is closer to underlying surface 300 than in the cycling configuration of FIG. 45*a*. The flexible leg-to-pedaling-mechanism connection along the leg-pivoting axis can be made with a circular cylindrical pivot rod which passes through pedaling mechanism 112Z and through leg 472 at the indicated location. Item 482 in FIG. 45 indicates such a pivot rod. Alternatively, the leg-to-pedaling-mechanism connection along the leg-pivoting axis can be made with a hinge connected to bottom housing surface 476 or possibly to front housing surface 480.

As discussed further below, pedaling-mechanism leg 472 is configured similar to frame legs 302. In particular, pedaling-mechanism leg 472 consists of a pair of elongated side members 484 and a cross member 486. One end of each side member 484 is flexibly connected to pedaling mechanism 112Z along the leg-pivoting axis. The other ends of side members 484 are connected to cross member 486.

Each side member 484 has a retracted-position pad 488. Cross member 486 has a pair of retracted-position pads 490 and a pair of extended-position pads 492. When pedaling-mechanism leg 472 is in its extended position, the surface area of extended-position pads 492 normally substantially contacts underlying surface 300. The surface area of retracted-position pads 490 and typically also retracted-position pads 488 normally substantially contacts surface 300 when leg 472 is in its retracted position. In other words, leg 472 has (a) extended-position surface area, provided by extended position pads 492, which normally substantially contacts surface 300 when leg 472 is in its extended position and (b) retracted-position surface area, provided by retracted-position pads 490 and typically also by retracted-position pads 488, which normally substantially contacts surface 300 when leg 472 is in its retracted position.

Pedaling-mechanism leg 472 is further flexibly connected to pedaling mechanism 112Z via pedaling-mechanism locking struts 474 in order to lock leg 472 in its extended position after being placed there. Locking struts 474 may also lock leg 472 in its retracted position after being placed in that position. Each locking strut 474L or 474R consists of an elongated upper strut member and an elongated lower strut member flexibly connected together through a center pin joint. The upper strut members of locking struts 474 are flexibly connected to the opposite sides of pedaling mechanism 112Z, specifically the opposite sides of lower housing portion 144L, through respective upper pin joints. The lower members of struts 474 are respectively flexibly connected to side members 484 of leg 472 through respective lower pin joints.

Locking struts 474 are in extended positions, as shown in FIG. 45*a* when pedaling-mechanism leg 472 is in its extended position. Struts 474 go into compressed positions, as depicted in FIG. 45*b*, when leg 472 goes into its retracted position. Locking mechanisms (not shown) are provided on struts 474 to lock them in their extended positions after being placed there. As a result, leg 472 is prevented from unintentionally returning to its retracted position until the locking mechanisms on struts 474 are released. After leg 472 goes into it retracted position, the locking members may also lock struts 474 in their compressed positions so that retracted-position pads 488 contact underlying surface 300.

Figure 46:
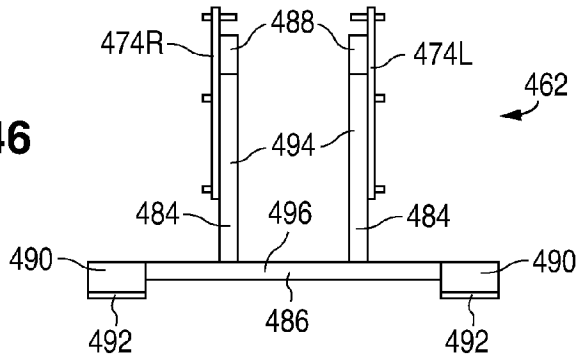
FIG. 46 is an end view of the leg and the leg-locking struts of the pedal-revolving mechanism in the exercise machine of FIGS. 45*a* and 45*b*. The end view of FIG. 46 is taken along plane 46-46 in FIG. 45*a* and along corresponding plane 46'-46' in FIG. 45*b*.

Turning particularly to FIG. 46, each side member 484 of pedaling-mechanism leg 472 consists of a main portion 494 and one retracted-position pad 488. Main portion 494 of each side member 484 has two opposite ends which respectively form that side member's opposite ends. Cross member 486 is formed with a main portion 496, two retracted-position pads 490, and two extended-position pads 492. Main portion 496 of cross member 486 likewise has two opposite ends which respectively form the cross member's opposite ends.

Main portions 494 of side members 484 of pedaling-mechanism leg 472 are fixedly connected to main portion 496 of the leg's cross member 486 at the side-member ends opposite the side-member ends flexibly connected to pedaling mechanism 112Z. In the example of FIG. 46, the connection locations are at intermediate positions along cross member 486, preferably equidistant from its ends. Retracted-position pad 488 of each side member 484 is provided on its main portion 494 adjacent to the side-member end connected to pedaling mechanism 112Z. Side-member main portions 494 are recessed adjacent to retracted-position pads 488 to keep main portions 494 away from underlying surface 300 when retracted-position pads 488 contact surface 300.

Two retracted-position pads 490 are provided on cross-bar main portion 496 adjacent to its ends so as to face in the same direction as retracted-position pads 488. Cross-bar main portion 496 is recessed between retracted-position pads 490 to keep main portion 496 away from underlying surface 300 when retracted-position pads 490 contact surface 300. Two extended-position pads 492 are provided on cross-bar main portion 496 adjacent to its ends so as to face in a significantly different direction than retracted-position pads 488 and 490. Extended-position pads 492 are typically substantially perpendicular to retracted-position pads 488 and 490. Cross-bar main portion 496 is also recessed between extended-position pads 492 to keep main portion 496 away from underlying surface 300 when extended-position pads 492 contact surface 300.

Frame 100Z is configured largely the same as frame 100Y in the exercise machine of FIGS. 21 and 25 except that center cross rail 162B replaces intermediate cross rails 162B1 and 162B2 in the machine of FIGS. 21 and 25. Hence, frame 100Z is formed with long rails 160, cross rails 162A-162C (again collectively "cross rails 162"), support-rod channel portion 166, and pedaling-mechanism-reception channel portions 310. Long rails 160, cross rails 162, and support-rod channel portion 166 in frame 100Z are configured, interconnected, and operable substantially the same as components 160, 162, and 166 in frame 100 of the exercise machine of FIGS. 3-5.

Front frame leg 470A is fixedly connected at its upper end to front cross rail 162A. Back frame leg 470B is similarly fixedly connected at its upper end to back cross rail 162C. During normal exercise-machine usage, frame legs 470 extend largely perpendicular to frame 100Z as viewed from the side. The top of seat 102 is thus permanently 30-50 cm, typically 40 cm, above underlying surface 300 during normal exercise-machine usage.

Frame legs 470 are configured similar to frame legs 302 in the exercise machine of FIGS. 21 and 25 except that legs 470 lack retracted-position pads 328 and 330. In particular, each frame leg 470A or 470B consists of two elongated side members 320 and cross member 322 connected together as described above for frame legs 302. Each cross member 322 of leg 470A or 470B is formed with main portion 366 and two extended-position pads 332, referred to here as contact pads, provided on main portion 366 at the same locations as in legs 302. Contact pads 332 contact underlying surface 300.

With the exercise machine of FIG. 45 in the cycling configuration of FIG. 45*a*, a user stationary cycles on the machine of FIG. 45 in substantially the same manner, as shown in FIG. 10, that user 200 stationary cycles on the exercise machine of FIGS. 3-5. The only significant difference is that stationary cycling with the machine of FIG. 45 is done higher above underlying surface 300 than above the (unshown) surface underlying the machine of FIGS. 3-5. Readout display 114 in the machine of FIG. 45 can be checked for cycling exercise information in substantially the same way that user 200 checks display 114 during stationary cycling with the machine of FIGS. 3-5.

A user can employ main assembly 116Z in the exercise machine of FIG. 45 as an exercise bench for doing exercises in basically the same ways, described above, that a user can employ main assembly 116V or 116W as an exercise bench. As with main assembly 116Y, additional handles 240, 242, and 250 may be present on main assembly 116Z to increase the number of exercises that can be done when it serves as an exercise bench. Upon substituting main assembly 116Z for main assembly 116W in FIGS. 19*a*-19*c*, these three figures illustrate examples of exercises that can be done with handles 108, 110, 240, 242, and 250 when using main assembly 116Z as an exercise bench. Upon similarly substituting main assembly 116Z for main assembly 116W in FIGS. 20*a* and 20*b*, these two additional figures illustrate examples of how user 200 can exercise with free weights 292 when main assembly 116Z is used as an exercise bench.

The exercise machine of FIG. 45 is switched between the cycling configuration of FIG. 45*a* and a pedaling-mechanism-tilted exercise-bench configuration such as that of FIG. 45*b* in the following way. Starting from the cycling configuration of FIG. 45*a* in which seatback 104 is in an inclined position, the locking mechanisms on locking struts 474 are released. The bottom of pedaling-mechanism leg 472 is pushed backward until leg 472 reaches its retracted position and struts 474 reach their compressed positions. Retracted-position pads 490 and typically also retracted-position pads 488 substantially contact underlying surface 300. As legs 302 go to their retracted positions, pedaling mechanism 112Z tilts downward until slanted back surface 370 of cycle housing 144 become approximately coplanar with the top of seat 102.

If seatback 104 is to lie largely flat against frame 100Z as in the pedaling-mechanism-tilted exercise-bench configuration of FIG. 45*b*, frame-associated pin 194 is removed from support rod 128 of seatback-to-frame/seat connection mechanism 106 and channel portion 166 of frame 100Z. The frame-associated end of support rod 128 is moved backward until seatback 104 reaches its flat or non-inclined position. All of these activities are done by one or more persons such as the user of the exercise machine of FIG. 45.

Largely the opposite is done in changing from a pedaling-mechanism-tilted exercise-bench configuration, such as that of FIG. 45*b*, to the cycling configuration of FIG. 45*a*. The bottom of pedaling-mechanism leg 472 is pushed forward until leg 472 reaches its extended position and locking struts 474 reach their extended positions. This causes pedaling mechanism 112Z to rotate upward until it reaches the normal pedaling-mechanism orientation of FIG. 45*a*. The locking mechanisms on struts 474 are actuated to lock struts 474 in their extended positions. Extended-position pads 492 now substantially contact underlying surface 300.

If seatback 104 is lying largely flat against frame 100Z, the frame-associated end of support rod 128 is moved to the location of a selected pair of oppositely situated openings 172 in channel portion 166 to select a suitable seatback-to-seat incline. Frame-associated pin 194 is inserted through the selected pair of openings 172 and through the opening in the frame-associated end of support rod 128 to fixedly place seatback 104 at the selected incline.

The exercise machine of FIG. 45 may include adjustable-length support rod 128Y and associated support-rod channel portion 166Y in place of fixed-length support rod 128 and associated support-rod channel portion 166. Selection of a suitable seatback-to-seat incline is then done by adjusting length-adjustment mechanism 386 of support rod 128Y instead of using a selected pair of oppositely situated openings 172 in channel portion 166. Additionally or alternatively, the exercise machine of FIG. 45 may include the seatback-incline control mechanism described above in connection with FIG. 40. In that case, the seatback-incline control mechanism is used in the machine of FIG. 45 to rapidly adjust the seatback-to-seat incline.

I. Variations

While the invention has been described with reference to particular embodiments, this description is solely for the purpose of illustration and is not to be construed as limiting the scope of the invention as claimed below. For instance, pedal-revolving pedaling mechanism 112Y or 112Z can be replaced with a variation of pedal-translating pedaling mechanism 220 modified in largely the same way that pedal-revolving pedaling mechanism 112 is modified to produce pedal-revolving pedaling mechanism 112Y or 112Z. In such a replacement, the back end of cycle housing 228 in the variation of pedal-translating mechanism 220 is provided with a pair of connector rails corresponding to, and typically largely identical to, connector rails 306 of pedal-revolving mechanism 112Y or 112Z. The connector rails in the variation of pedal-translating mechanism 220 have connector openings corresponding to, and typically matching, connector openings 308 in connector rails 306.

When such a variation of pedal-translating mechanism 220 is used in place of pedal-revolving mechanism 112Z, the variation of pedal-translating mechanism 220 is also provided with a pedaling-mechanism leg and a pair of locking struts respectively corresponding to pedaling-mechanism leg 472 and locking struts 474 in pedal-revolving mechanism 112Z.

Pedal-revolving pedaling mechanism 112Y or 112Z and the preceding variation of pedal-translating pedaling mechanism 220 can be removably connected to opposite ends of a corresponding variation of main assembly 116Y or 116Z. More particularly, the back end of the variation of main assembly 116Y or 116Z is provided with a pair of straight pedaling-mechanism-reception channels portions corresponding to pedaling-mechanism-reception channels portions 310 at the front end of main assembly 116Y or 116Z. A pair of pedaling-mechanism-reception channels portions are thereby present at each end of the variation of main assembly 116Y or 116Z.

Pin openings corresponding to pin openings 314 near the front ends of long rails 160 are provided in rails 160 near their back ends in the variation of main assembly 116Y or 116Z. Pin openings corresponding to pin openings 316 in channel portions 310 are similarly provided in the pedaling-mechanism-reception channels portions at the back end of the variation of main assembly 116Y or 116Z. One of pedal-revolving mechanism 112Y and the replacement variation of pedal-translating mechanism 220 is removably connected to the front end of the variation of main assembly 116Y or 116Z via connector pins 312 inserted into pin openings 314 and 316. The other of pedal-revolving mechanism 112Y and the replacement variation of pedal-translating mechanism 220 is removably connected to the back end of the variation of main assembly 116Y or 116Z via a pair of connector pins inserted appropriately into the pin openings corresponding to pin openings 314 and 316.

The internal pedaling apparatus of pedal-revolving mechanism 112Y or 112Z can be implemented with equipment that provides cycling resistance magnetically. The same applies to the internal translating apparatus in the preceding variations of pedal-translating mechanism 220.

Segmented seatback 104Y in main assembly 116Y of FIG. 43 can replace non-segmented seatback 104 in the exercise machines of FIGS. 21 and 25, FIGS. 33 and 34, FIG. 36, FIG. 37, and FIG. 45 and in main assembly 116Y of FIG. 40. In that case, the variation of seatback-to-frame/seat connection mechanism 106Y employed in main assembly 116Y of FIG. 43 is also utilized in the machines of FIGS. 21 and 25, FIGS. 33 and 34, FIG. 36, FIG. 37, and FIG. 45 and in main assembly 116Y of FIG. 40.

Similar to how seatback-to-frame/seat connection mechanism 106U in FIGS. 15*a*, 15*b*, and 16 is recessed into the back of seatback 104U, connection mechanism 106 or 106Y in the machines of FIGS. 21 and 25, FIGS. 33 and 34, FIG. 36, FIG. 37, and FIG. 45 and in main assembly 116Y of FIG. 40 or 43 can be replaced with a variation recessed fully into the back of a corresponding variation of seatback 104 or 104Y. In so doing, cross-bar sleeves 182L and 184R are typically replaced with elevated long-rail portions 336L and 336R and associated openings 338L and 338R through elevated portions 336L and 336R.

Frame legs 302 and 470 and pedaling-mechanism leg 472 can be configured differently than described above. For instance, cross member 322 of each frame leg 302 or 470 can be deleted so that side members 320 become a pair of separate legs. Extended-position pads 332 are then transferred to the bottoms of side members 320. Retracted-position pads 330 of each so-modified version of frame leg 302 are also transferred to side members 320. Cross member 486 of pedaling-mechanism leg 472 can likewise be deleted. Retracted-position pads 490 and extended-position pads 492 are then appropriately transferred to the resultant separate legs respectively formed by side members 484.

Alternatively, each leg 302, 470, or 472 can be furnished with one or more additional cross members which connect that leg's side members 320 or 484. When legs 302, 470, or 472 are in their extended positions, side members 320 or 484 can slant laterally outward instead of extending largely perpendicular to frame 100Y or 100Z.

Instead of pedaling-mechanism leg 472 in the exercise machine of FIG. 45 having retracted-position pads 488 and 490 that substantially contact underlying surface 300 when leg 472 is in its retracted position, part of pedaling mechanism 112Z can itself contact surface 300. That part of pedaling mechanism 112Z can be provided with one or more feet for contacting surface 300 when leg 472 is in its retracted position. Non-retractable frame legs 470 in the machine of FIG. 45 can be replaced with legs that are readily removable from frame 100Z to facilitate exercise-machine storage and shipping.

Frame legs 302 and 470 can be replaced with frame legs configured to enable the top of seat 102 to be placed at any of two or more distances above underlying surface 300. Since the top of seat 102 is situated at a distance above underlying surface when the replacements for retractable frame legs 302 are in their retracted positions, the top of seat 102 can thereby be placed at any of three or more distances above surface 300. When such replacements are used for frame legs 470 in the exercise machine of FIG. 45, pedaling-mechanism leg 472 is replaced with a pedaling-mechanism leg similarly configured to enable slanted back surface 370 of cycle housing 144 of pedaling mechanism 112Z to be placed at any of two or more corresponding distances above surface 300 so that slanted back housing surface 370 can be largely coplanar with the top of seat 102 when the resultant exercise machine is in an exercise-bench configuration.

Cross-bar sleeves 182L and 184R can be utilized in frame 100Y or 100Z to replace elevated long-rail portions 336L and 336R and associated openings 338L and 338R through elevated portions 336L and 336R.

Openings 172 in support-rod channel portion 166, connector openings 308 in connector rails 306, pin openings 314 in long rails 160 of frame 100Y, pin openings 316 in pedaling-mechanism-reception channel portions 310, opening 356 in axial bar 186 of T-shaped-bar portion 180 of seatback-to-frame/seat connection mechanism 106, the corresponding opening in axial bar 186Y of T-shaped-bar portion 180Y of seatback-to-frame/seat connection mechanism 106Y, openings 360 and 362 in support rod 128, openings 380 in channel portion 166Y, and opening 382 in support rod 128Y need not be circular. In that case, pins 192, 194, and 312 need not be circular cylinders.

Channel portion 166 of frame 100Y or 100Z can be replaced with a further rail having a plurality of openings respectively corresponding to the pairs of oppositely situated openings 172 in channel portion 166. The openings in the further rail define corresponding interface connection locations at which the frame-associated end of support rod 128 can be adjustably and flexibly connected to the rail via a frame-associated pin, such as pin 194, that passes through the opening in the frame-associated end of rod 128 and through any selected one of the openings in the rail. The frame-associated end of support rod 128 can split into a pair of tines through which a pair of oppositely situated openings respectively extend. In that case, support rod 128 is adjustably and flexibly connected to the further rail via a pin that passes through both openings in the frame-associated end of rod 128 and through one of the openings in the rail.

The roles of the ends of support rod 128 in regard to how they are connected to axial bar 186 or 186Y and frame 100Y or 100Z can be reversed. That is, the seatback-associated end of rod 128 can be adjustably and flexibly connected to axial bar 186 or 186Y by configuring bar 186 or 186Y so that its remote end flexibly receives the seatback-associated end of rod 128 at any one of a plurality of seatback-associated flexible connection locations. This can be achieved by providing the remote end of axial bar 186 or 186Y with a plurality of openings respectively corresponding to the connection locations. Support rod 128 is flexibly connected to axial bar 186 or 186Y at any selected one of the seatback-associated connection locations via a pin that passes through openings 360 in tines 358 at the seatback-associated end of rod 128 and through one of the openings in the remote end of bar 186 or 186Y.

Alternatively, the remote end of axial bar 186 or 186Y can be configured as a channel member, similar to channel portion 166, having a plurality of pairs of oppositely situated openings where each pair of the oppositely situated openings defines a different one of the connection locations. Instead of having tines 358 with openings 360, the seatback-associated end of support rod 128 can have a single opening. Support rod 128 is then adjustably and flexibly connected to axial bar 186 or 186Y via a pin that passes through the opening in the seatback-associated end of rod 128 and through a selected one of the pairs of openings in the channel member at the remote end of bar 186 or 186Y.

A ball-joint arrangement can be used in place of seatback-associated pin 192 for flexibly connecting support rod 128 to axial bar 186 or 186Y when rod 128 is to be flexibly connected to bar 186 or 186Y at only one location. Likewise, a ball-joint arrangement can be used in place of frame-associated pin 194 for flexibly connecting support rod 128 to frame 100Y or 100Z when rod 128 is to be flexibly connected to frame 100Y or 100Z at only one location.

The seatback-associated end of support rod 128 can be adjustably and flexibly connected to axial bar 186 or 186Y at any one of a plurality of seatback-associated flexible connection locations while the frame-associated end of rod 128 is adjustably and flexibly connected to frame 100Y or 100Z at any one of a plurality of frame-associated flexible connection locations. These adjustable and flexible connections for both ends of support rod 128 can be done in any of the ways described above.

Rather than using openings 308 in connector rails 306 for adjustably connecting pedaling mechanism 112Y or 112Z to main assembly 116Y or 116Z, connector rails 306 can be replaced with connector rails having teeth. Connector pins 312 are then replaced with connector controls, each consisting of an adjustment knob, a cog wheel, and a pin connecting the cog wheel to the adjustment knob. The cog wheels have cogs which engage the teeth of the replacements for connector rails 306. The pins extend through openings in frame 100Y or 100Z with the pins situated outside frame 100Y or 100Z. The knobs are turned to turn the cog wheels for adjusting the connection of pedaling mechanism 112Y or 112Z to frame 100Y or 100Z of main assembly 116Y or 116Z. The connection is adjusted while the knobs are pulled outward slightly. For any selected adjustment, the connection is locked by pressing the knobs inward sufficiently to engage respective locking mechanisms.

In the examples of handles 108, 110, 240, 242, and 250 shown in the drawings, each of handles 108, 110, 240, 242, and 250 is open-ended and generally shaped like an "L". One leg of each of handles 108, 110, 240, 242, and 250 extends approximately along its handle axis (see FIGS. 5, and 17) and thus rotates about that axis. Instead of being turned about handle axes, seat handles 108 and 240 can pivot about respective ball joints (not shown) connected to seat 102 or/and frame 100Y or 100Z. Similarly, frame handles 242 can pivot about respective ball joints connected to frame 100Y or 100Z rather than being turned about handle axes. Seatback handles 110 and 250 can pivot about respective ball joints connected to seatback 104, 104U, or 104Y or/and seatback-to-frame/seat connection mechanism 106, 106U, or 106Y instead of being turned about handle axes.

Handles 108, 110, 240, 242, and 250 can have other shapes and can be positioned differently than described above. For instance, some or all of handles 108, 110, 240, 242, and 250 can be closed-ended. Seatback handles 110 can be received along the top edge of seatback 104, 104U, or 104Y or/and along the top of connection mechanism 106, 106U, or 106Y.

For the situation in which seatback handles 110, seat handles 240, or frame handles 242 turn around axes, the average distance from handles 110, 240, or 242 to another exercise machine part has been described above as being measured from those axes. More generally, the average distance from handles 110, 240, or 242 to another exercise machine part is measured from the average location of the common center of mass of handles 110, 240, or 242 to that other exercise machine part. These two ways of measuring distance from handles 110, 240, or 242 produce largely the same distance value as when handles 110, 240, or 242 turn about axes.

Similar generalizations apply to the above statement that the average distance from foot pedals 140 to another exercise machine part is measured from pedaling axis 150 and to the above statement that the average distance from foot pedals 224 to another machine part is measured from translator reference line 236. That is, the average distance from pedals 140 or 224 to another exercise machine part is more generally measured from the average location of the common center of mass of pedals 140 or 224 to that other exercise machine part.

When the exercise machine of FIG. 11 is modified to include seat handles 240 and frame handles 242, user 200 can exercise in various crouched, crouched-to-prone, and largely prone positions using pedal-translating pedaling mechanism 220 as disclosed in U.S. patent application Ser. No. 11/508,424. By including handles 240 and/242 in any of the exercise machines of the invention, a user can likewise variously exercise in the crouched, crouched-to-prone, and largely prone positions using pedal-revolving mechanism 112Y or 112Z similar to how user 200 respectively exercises in those positions using pedal-translating pedaling mechanism 220.

A user may grip only one of handles 108, 110, 240, 242, and 250, typically with only one of the user's hands, in using the exercise machines of the invention to do handle-gripping non-cycling exercises of the type generally shown in FIGS. 19*a*-19*c*. In using the exercise machines of the invention as exercise benches, weight-lifting non-cycling exercises of the type generally shown in FIGS. 20*a* and 20*b* may be done with barbells as well as dumbbells. Consequently, a user may lift only one free weight in doing weight-lifting exercises. Either or both of the user's hands may grip the single free weight.

The dimensions of frame 100Y or 100Z may be adjusted to better accommodate users of varying heights or to accommodate users considerably shorter or taller than typical adult users. Various modifications and applications may thus be made by those skilled in the art without departing from the true scope of the invention as defined in the appended claims.

We claim:

1. An exercise machine placeable on an underlying surface, the exercise machine comprising:

a frame;

a seat situated over the frame;

a seatback situated over the frame, the seatback having a longitudinal centerline;

a connection mechanism for flexibly or/and adjustably connecting the seatback to the frame or/and the seat, the connection mechanism having a swivel axis about which at least part of the connection mechanism is turnable to enable the seatback to swivel, the swivel axis extending generally parallel to the longitudinal centerline of the seatback;

a pedaling mechanism connectable to the frame and having a pair of movable pedals, the seat located laterally between the pedaling and connection mechanisms; and a pair of frame legs flexibly connected to the frame, each frame leg switchable between (a) an extended position in which extended-position surface area of that leg substantially contacts the underlying surface and (b) a retracted position in which retracted-position surface area of that leg substantially contacts the underlying surface such that the frame is farther from the underlying surface when the legs are in their extended positions than when the legs are in their retracted positions.

2. An exercise machine as in claim 1 wherein:

the frame has a front end and a back end opposite the front end;

a front one of the frame legs is flexibly connected to the frame at or near its front end; and a back one of the frame legs is flexibly connected to the frame at or near its back end.

3. An exercise machine as in claim 1 wherein each frame leg comprises:

a pair of elongated side members, each having a first end and a second end opposite the first end, the side members being flexibly connected to the frame at their first ends; and a cross member connected to the side members at or near their second ends.

4. An exercise machine as in claim 1 wherein:

the seatback has a longitudinal centerline; and the connection mechanism has a swivel axis about which at least part of the connection mechanism is turnable to enable the seatback to swivel, the swivel axis extending generally parallel to the longitudinal centerline of the seatback.

5. An exercise machine as in claim 1 wherein the connection mechanism is adjustable for adjusting incline of the seatback to the seat.

6. An exercise machine comprising:

a frame;

a seat situated over the frame;

a seatback situated over the frame, the seatback having a longitudinal centerline;

a connection mechanism for flexibly or/and adjustably connecting the seatback to the frame or/and the seat, the connection mechanism having a swivel axis about which at least part of the connection mechanism is turnable to enable the seatback to swivel, the swivel axis extending generally parallel to the longitudinal centerline of the seatback;

a pedaling mechanism connectable to the frame and having a pair of movable pedals, the seat located laterally between the pedaling and connection mechanisms; and a seatback-incline control mechanism actuatable by a person for switching the seatback between (a) a flat position in which the seatback is largely non-inclined to the seat and (b) an inclined position in which the seatback is significantly inclined to the seat.

7. An exercise machine as in claim 6 wherein the seatback lies largely flat against the frame when the seatback is in its flat position.

8. An exercise machine as in claim 6 wherein:

the seatback has a longitudinal centerline; and the connection mechanism has a swivel axis about which at least part of the connection mechanism is turnable to enable the seatback to swivel, the swivel axis extending generally parallel to the longitudinal centerline of the seatback.

9. An exercise machine as in claim 6 wherein the connection mechanism is adjustable for adjusting incline of the seatback to the seat.

10. An exercise machine as in claim 9 wherein the connection mechanism comprises:

a seatback-attaching portion attached to the seatback; and a support rod extending between the seatback-attaching portion and the frame and being of adjustable length so as to adjust incline of the seatback to the seat.

11. An exercise machine as in claim 6 further including a pair of frame legs flexibly connected to the frame, each frame leg switchable between (a) an extended position in which extended-position surface area of that leg substantially contacts a surface underlying the exercise machine and (b) a retracted position in which the extended-position surface area of that leg is closer to the frame than when that leg is in the extended position.

12. An exercise machine as in claim 11 further including a leg-position control mechanism actuatable by a person for switching the legs between their extended and retracted positions.

13. An exercise machine comprising:

a frame;

a seat situated over the frame;

a seatback having a longitudinal centerline, the seatback comprising a swivelable segment and a seat-adjacent segment situated between the seat and the swivelable segment;

a connection mechanism for flexibly or/and adjustably connecting the seatback to the frame or/and the seat, the connection mechanism having a swivel axis about which at least part of the connection mechanism is turnable to enable the swivelable segment to swivel without significant swivel of the seat-adjacent segment, the swivel axis extending generally parallel to the longitudinal centerline of the seatback; and a pedaling mechanism connectable to the frame and having a pair of movable pedals, the seat located laterally between the pedaling and connection mechanisms.

14. An exercise machine as in claim 13 wherein the connection mechanism is adjustable for adjusting incline of the seatback to the seat.

15. An exercise machine as in claim 14 further including a seatback-incline control mechanism actuatable by a person for switching the seatback between (a) a flat position in which the seatback is largely non-inclined to the seat and (b) an inclined position in which the seatback is significantly inclined to the seat.

16. An exercise machine as in claim 13 further including a pair of frame legs flexibly connected to the frame, each frame leg switchable between (a) an extended position in which extended-position surface area of that leg substantially contacts a surface underlying the exercise machine and (b) a retracted position in which the extended-position surface area of that leg is closer to the frame than when that leg is in the extended position.

17. An exercise machine as in claim 16 further including a leg-position control mechanism actuatable by a person for switching the legs between their extended and retracted positions.

18. An exercise machine as in claim 1 further including a leg-position control mechanism actuatable by a person for switching the legs between their extended and retracted positions.

19. An exercise machine as in claim 5 further including a seatback-incline control mechanism actuatable by a person for switching the seatback between (a) a flat position in which the seatback is largely non-inclined to the seat and (b) an inclined position in which the seatback is significantly inclined to the seat.

20. A method comprising switching each frame leg of the exercise machine of claim 1 between the extended and retracted positions.

21. A method as in claim 20 further including physically exercising using the exercise machine, the act of physically exercising being performed by a human.

* * * * *